US012577690B2

(12) United States Patent
Kashi et al.

(10) Patent No.: US 12,577,690 B2
(45) Date of Patent: Mar. 17, 2026

(54) SYSTEMS AND METHODS FOR ETHYLENE PRODUCTION

(71) Applicant: Twelve Benefit Corporation, Berkeley, CA (US)

(72) Inventors: Ajay R. Kashi, Berkeley, CA (US); Aya K. Buckley, Berkeley, CA (US); Sichao Ma, Dublin, CA (US); Kendra P. Kuhl, Oakland, CA (US); Sara Hunegnaw, Oakland, CA (US); Etosha R. Cave, Berkeley, CA (US); Luka Stevic, Novi Sad (RS)

(73) Assignee: Twelve Benefit Corporation, Berkeley, CA (US)

( * ) Notice: Subject to any disclaimer, the term of this patent is extended or adjusted under 35 U.S.C. 154(b) by 531 days.

(21) Appl. No.: 18/063,508

(22) Filed: Dec. 8, 2022

(65) Prior Publication Data

US 2023/0175146 A1 Jun. 8, 2023

Related U.S. Application Data

(60) Provisional application No. 63/265,144, filed on Dec. 8, 2021.

(51) Int. Cl.

| | |
|---|---|
| ***C25B 3/26*** | (2021.01) |
| ***C25B 1/23*** | (2021.01) |
| ***C25B 3/03*** | (2021.01) |
| ***C25B 3/25*** | (2021.01) |
| ***C25B 9/19*** | (2021.01) |

(Continued)

(52) U.S. Cl.

CPC ..... *C25B 3/26* (2021.01); *C25B 1/23* (2021.01); *C25B 3/03* (2021.01); *C25B 3/25* (2021.01); *C25B 9/19* (2021.01); *C25B 9/21* (2021.01); *C25B 9/23* (2021.01); *C25B 9/70* (2021.01); *C25B 15/083* (2021.01);

(Continued)

(58) Field of Classification Search

CPC ..... C25B 1/23

See application file for complete search history.

(56) References Cited

U.S. PATENT DOCUMENTS

| | | | |
|---|---|---|---|
| 2,650,245 | A | 8/1953 | Boaden et al. |
| 3,755,099 | A | 8/1973 | Haupin |

(Continued)

FOREIGN PATENT DOCUMENTS

| | | | |
|---|---|---|---|
| CA | 2950294 | C | 7/2022 |
| CN | 101981744 | A | 2/2011 |

(Continued)

OTHER PUBLICATIONS

Gabardo et al, Continuous Carbon Dioxide Electroreduction to Concentrated Multi-carbon Products Using a Membrane Electrode Assembly, Joule, vol. 3, No. 11, Nov. 2019, pp. 2777-2791 (Year: 2019).*

(Continued)

*Primary Examiner* — Harry D Wilkins, III

(74) *Attorney, Agent, or Firm* — Weaver Austin Villeneuve & Sampson LLP

(57) ABSTRACT

Systems and methods for increasing the concentration of a desired $CO_x$ reduction reaction product are described. In some embodiments, the systems and methods include ethylene purification.

20 Claims, 17 Drawing Sheets

(51) Int. Cl.

| | |
|---|---|
| ***C25B 9/21*** | (2021.01) |
| ***C25B 9/23*** | (2021.01) |
| ***C25B 9/70*** | (2021.01) |
| ***C25B 11/075*** | (2021.01) |
| ***C25B 15/08*** | (2006.01) |

(52) U.S. Cl.
CPC ..... *C25B 15/085* (2021.01); *C25B 15/087* (2021.01); *C25B 11/075* (2021.01)

(56) References Cited

U.S. PATENT DOCUMENTS 3,766,027 A * 10/1973 Gregory ..... C10L 3/08 205/462
4,042,496 A 8/1977 Tsushima et al.
4,089,758 A 5/1978 McAloon
4,116,889 A 9/1978 Chlanda et al.
4,176,215 A 11/1979 Molnar et al.
4,253,900 A 3/1981 Dege et al.
4,355,116 A 10/1982 Lee et al.
4,609,440 A 9/1986 Frese, Jr. et al.
4,761,207 A 8/1988 Stewart, Jr. et al.
4,766,161 A 8/1988 Chlanda et al.
4,790,946 A 12/1988 Jansen
4,828,941 A 5/1989 Sterzel
4,921,586 A 5/1990 Molter
5,039,389 A 8/1991 McMichael
5,601,937 A 2/1997 Isenberg
5,992,008 A 11/1999 Kindler
6,358,651 B1 3/2002 Chen et al.
6,685,821 B2 2/2004 Kosek et al.
7,605,293 B2 10/2009 Olah et al.
7,608,356 B2 10/2009 Risen, Jr. et al.
7,704,369 B2 4/2010 Olah et al.
7,883,817 B2 2/2011 Hori et al.
8,075,746 B2 12/2011 Hartvigsen et al.
8,131,859 B2 3/2012 Fujii et al.
8,137,859 B2 3/2012 Shin et al.
8,268,026 B2 9/2012 Norbeck et al.
8,277,631 B2 10/2012 Eastman et al.
8,366,902 B2 2/2013 Hawkes et al.
8,535,502 B2 9/2013 Littau et al.
8,592,633 B2 11/2013 Cole et al.
8,652,104 B2 2/2014 Goral et al.
8,652,704 B2 2/2014 Sano et al.
8,658,016 B2 2/2014 Lakkaraju et al.
8,697,129 B2 4/2014 Qian et al.
8,721,866 B2 5/2014 Sivasankar et al.
8,741,244 B2 6/2014 Jones
8,778,156 B2 7/2014 Eisaman et al.
8,845,875 B2 9/2014 Teamey et al.
8,845,878 B2 9/2014 Cole et al.
8,956,990 B2 2/2015 Masel et al.
9,012,345 B2 4/2015 Masel et al.
9,108,894 B1 8/2015 Foody et al.
9,145,615 B2 9/2015 Zhai et al.
9,181,625 B2 11/2015 Masel et al.
9,193,593 B2 11/2015 Masel et al.
9,238,598 B2 1/2016 Hammad et al.
9,370,773 B2 6/2016 Masel et al.
9,464,359 B2 10/2016 Masel et al.
9,481,939 B2 11/2016 Masel et al.
9,486,480 B2 11/2016 Ayoub et al.
9,486,771 B2 11/2016 Lane et al.
9,555,367 B2 1/2017 Masel et al.
9,566,574 B2 2/2017 Masel et al.
9,580,824 B2 2/2017 Masel et al.
9,586,181 B2 3/2017 Eisaman et al.
9,587,071 B2 3/2017 Sun et al.
9,631,284 B2 4/2017 Braun et al.
9,692,060 B2 6/2017 Chokai et al.
9,914,683 B2 3/2018 Eisaman
9,920,437 B2 3/2018 Reytier et al.
9,929,412 B2 3/2018 Ueyama et al.
9,937,471 B1 4/2018 Eisaman
10,092,661 B2 10/2018 Qian et al.
10,280,378 B2 5/2019 Masel
10,329,676 B2 6/2019 Kaczur et al.
10,648,091 B2 5/2020 Kuhl et al.
10,822,709 B2 11/2020 Kuhl et al.
10,975,480 B2 4/2021 Masel
10,975,481 B2 4/2021 Guo et al.
11,011,756 B2 5/2021 Pintauro et al.
11,142,832 B2 10/2021 O'Brien et al.
11,221,330 B2 1/2022 Alocilja et al.
11,268,200 B2 3/2022 Oener et al.
11,271,220 B2 3/2022 Morin et al.
11,512,403 B2 11/2022 Kuhl et al.
11,643,736 B2 * 5/2023 Yamaguchi ..... C25B 9/19 205/345
11,680,328 B2 6/2023 Huo et al.
11,939,284 B2 3/2024 Stevic
12,286,716 B2 4/2025 Flanders et al.
12,305,304 B2 5/2025 Zhao et al.
12,320,022 B2 6/2025 Flanders et al.
2002/0017463 A1 2/2002 Merida-Donis
2003/0059658 A1 3/2003 Kohler et al.
2005/0147859 A1 7/2005 Kiefer et al.
2005/0239912 A1 10/2005 Arcella et al.
2006/0016685 A1 1/2006 Hawkins et al.
2006/0211777 A1 9/2006 Severinsky
2008/0045401 A1 2/2008 Zhou et al.
2008/0283411 A1 11/2008 Eastman et al.
2008/0318093 A1 12/2008 Lee et al.
2009/0014336 A1 1/2009 Olah et al.
2009/0117436 A1 5/2009 Choi et al.
2009/0155102 A1 6/2009 Park et al.
2010/0059377 A1 3/2010 Littau et al.
2010/0137457 A1 6/2010 Kaplan
2010/0142123 A1 6/2010 Smith et al.
2010/0159347 A1 6/2010 Choi et al.
2010/0193370 A1 8/2010 Olah et al.
2010/0273087 A1 10/2010 Choi et al.
2010/0324256 A1 12/2010 Ooms et al.
2011/0206566 A1 8/2011 Stoots et al.
2012/0171583 A1 7/2012 Bocarsly et al.
2012/0228150 A1 9/2012 Kang et al.
2012/0252091 A1 10/2012 Rasmussen et al.
2012/0328942 A1 12/2012 Thomas-Alyea et al.
2013/0058857 A1 3/2013 Stern et al.
2013/0105304 A1 5/2013 Kaczur et al.
2013/0118911 A1 5/2013 Sivasankar et al.
2013/0341201 A1 12/2013 McCormick et al.
2013/0345325 A1 12/2013 Lecomte et al.
2014/0027303 A1 1/2014 Cole et al.
2014/0034506 A1 2/2014 Teamey et al.
2014/0093799 A1 4/2014 Masel et al.
2014/0151240 A1 6/2014 Bedell et al.
2014/0206894 A1 7/2014 Cole et al.
2014/0206896 A1 7/2014 Sivasankar et al.
2015/0010804 A1 1/2015 Laramie et al.
2015/0030888 A1 1/2015 Popat et al.
2015/0057458 A1 2/2015 Schjodt et al.
2015/0064602 A1 3/2015 Lee et al.
2015/0068915 A1 3/2015 Hoch et al.
2015/0217266 A1 8/2015 Sherwood
2015/0232999 A1 8/2015 Busskamp et al.
2015/0329979 A1 11/2015 Reytier et al.
2016/0017503 A1 1/2016 Kaczur et al.
2016/0032787 A1 2/2016 Hong et al.
2016/0107154 A1 4/2016 Masel et al.
2016/0151739 A1 6/2016 Jakobsson et al.
2016/0152905 A1 6/2016 Kelfkens et al.
2016/0161869 A1 6/2016 Avneri et al.
2016/0194766 A1 7/2016 Eastman et al.
2016/0251766 A1 * 9/2016 Masel ..... C25B 3/25 204/252
2016/0369415 A1 12/2016 Masel et al.
2016/0369688 A1 12/2016 Hamad et al.
2017/0037522 A1 2/2017 Kaczur et al.
2017/0183789 A1 6/2017 Matthews et al.
2017/0218404 A1 8/2017 Simpson et al.
2017/0321333 A1 11/2017 Kuhl et al.
2017/0321334 A1 11/2017 Kuhl et al.

(56) References Cited

U.S. PATENT DOCUMENTS

| | | | |
|---|---|---|---|
| 2017/0328239 | A1 | 11/2017 | Fleischer et al. |
| 2018/0057950 | A1 | 3/2018 | Co et al. |
| 2018/0086984 | A1 | 3/2018 | Chen et al. |
| 2018/0086985 | A1 | 3/2018 | Von Olshausen et al. |
| 2018/0127668 | A1 | 5/2018 | Masel |
| 2018/0151890 | A1 | 5/2018 | Ishida et al. |
| 2018/0171495 | A1 | 6/2018 | Masel et al. |
| 2018/0194632 | A1 | 7/2018 | Jakobsson et al. |
| 2018/0257057 | A1 | 9/2018 | Motoshige et al. |
| 2018/0264429 | A1 | 9/2018 | Sugano et al. |
| 2018/0265440 | A1 | 9/2018 | Kudo et al. |
| 2019/0016594 | A1 | 1/2019 | Singh et al. |
| 2019/0032228 | A1 | 1/2019 | Krause et al. |
| 2019/0036143 | A1 | 1/2019 | Yan et al. |
| 2019/0062931 | A1 | 2/2019 | Stark et al. |
| 2019/0093241 | A1 | 3/2019 | Baldauf et al. |
| 2019/0127865 | A1 | 5/2019 | Li et al. |
| 2019/0134570 | A1 | 5/2019 | Pintauro et al. |
| 2019/0211463 | A1 | 7/2019 | Masel |
| 2019/0226103 | A1 | 7/2019 | Kuhl et al. |
| 2019/0233350 | A1 | 8/2019 | Sankaranarayanan et al. |
| 2019/0359894 | A1 | 11/2019 | Heidel et al. |
| 2019/0360005 | A1 | 11/2019 | Baldauf et al. |
| 2019/0376190 | A1 | 12/2019 | O'Brien et al. |
| 2020/0095124 | A1 | 3/2020 | Rueger |
| 2020/0153013 | A1 | 5/2020 | Herrmann et al. |
| 2020/0208278 | A1 | 7/2020 | Li et al. |
| 2020/0216968 | A1 | 7/2020 | Hunegnaw et al. |
| 2020/0220185 | A1 | 7/2020 | Ma et al. |
| 2020/0240023 | A1 | 7/2020 | Cave et al. |
| 2020/0308718 | A1 | 10/2020 | Patru et al. |
| 2020/0370188 | A1 | 11/2020 | Oener et al. |
| 2020/0376479 | A1 | 12/2020 | Masel |
| 2021/0002775 | A1 | 1/2021 | Matsumoto et al. |
| 2021/0031137 | A1 | 2/2021 | Goetheer et al. |
| 2021/0047743 | A1 | 2/2021 | Goetheer et al. |
| 2021/0079537 | A1 | 3/2021 | Spurgeon |
| 2021/0123146 | A1 | 4/2021 | Berlinguette et al. |
| 2021/0164116 | A1 | 6/2021 | Kuhl et al. |
| 2021/0180196 | A1 | 6/2021 | Siemens |
| 2021/0207275 | A1 | 7/2021 | Huo et al. |
| 2021/0285111 | A1 | 9/2021 | Fernández Sanchis et al. |
| 2021/0292924 | A1 | 9/2021 | Sargent et al. |
| 2021/0381116 | A1 | 12/2021 | Kashi et al. |
| 2021/0387139 | A1 | 12/2021 | Voskian et al. |
| 2021/0395908 | A1 | 12/2021 | Kuhl et al. |
| 2022/0025527 | A1* | 1/2022 | Yamaguchi ..... C25B 3/26 |
| 2022/0119636 | A1 | 4/2022 | Wang et al. |
| 2022/0119641 | A1 | 4/2022 | Wang et al. |
| 2022/0119964 | A1 | 4/2022 | Morimoto et al. |
| 2022/0136119 | A1 | 5/2022 | Flanders et al. |
| 2022/0152556 | A1 | 5/2022 | Hoshino |
| 2022/0153656 | A1 | 5/2022 | Flanders et al. |
| 2022/0227684 | A1 | 7/2022 | Hashimoto |
| 2022/0227701 | A1 | 7/2022 | Bulan et al. |
| 2022/0235479 | A1 | 7/2022 | Scheiff et al. |
| 2022/0246966 | A1 | 8/2022 | Brown |
| 2022/0267916 | A1 | 8/2022 | Zhao et al. |
| 2023/0041781 | A1 | 2/2023 | Okuno et al. |
| 2023/0155153 | A1 | 5/2023 | Huo et al. |
| 2023/0175088 | A1 | 6/2023 | Cintron et al. |
| 2023/0202840 | A1 | 6/2023 | Flanders et al. |
| 2023/0256380 | A1 | 8/2023 | Singh et al. |
| 2023/0264148 | A1 | 8/2023 | Boettcher et al. |
| 2023/0265572 | A1 | 8/2023 | Kuhl et al. |
| 2023/0392265 | A1 | 12/2023 | Winkler |
| 2023/0415104 | A1 | 12/2023 | Huo et al. |
| 2023/0417189 | A1 | 12/2023 | Ross |
| 2024/0011165 | A1 | 1/2024 | Flanders et al. |
| 2024/0051909 | A1 | 2/2024 | Stevic |
| 2024/0141514 | A1 | 5/2024 | Zhao et al. |
| 2024/0158928 | A1 | 5/2024 | Wu et al. |
| 2024/0174590 | A1 | 5/2024 | Stevic |
| 2024/0200208 | A1 | 6/2024 | Huo et al. |
| 2024/0254641 | A1 | 8/2024 | Wu et al. |
| 2025/0109513 | A1 | 4/2025 | Huo et al. |
| 2025/0215580 | A1 | 7/2025 | Flanders et al. |

FOREIGN PATENT DOCUMENTS

| | | | |
|---|---|---|---|
| CN | 102308028 | A | 1/2012 |
| CN | 102978653 | A | 3/2013 |
| CN | 106148992 | A | 11/2016 |
| CN | 106463743 | A | 2/2017 |
| CN | 107180985 | A | 9/2017 |
| CN | 107699915 | A | 2/2018 |
| CN | 109921060 | A | 6/2019 |
| CN | 110391441 | A | 10/2019 |
| CN | 112994054 | A | 6/2021 |
| DE | 102006012313 | A1 | 10/2007 |
| DE | 102007037672 | A1 | 2/2009 |
| DE | 102013000255 | A1 | 7/2014 |
| DE | 102015201132 | A1 | 7/2016 |
| DE | 102015214592 | A1 | 2/2017 |
| DE | 102016207420 | A1 | 10/2017 |
| DE | 102018210303 | A1 | 1/2020 |
| EP | 2163294 | A1 | 3/2010 |
| EP | 3378968 | A1 | 9/2018 |
| EP | 3434810 | A1 | 1/2019 |
| EP | 3626861 | A1 | 3/2020 |
| EP | 3670700 | A1 | 6/2020 |
| EP | 3126038 | B1 | 6/2021 |
| GB | 1269841 | A | 4/1972 |
| JP | H06145379 | A | 5/1994 |
| JP | 2007206055 | A | 8/2007 |
| JP | 2009540130 | A | 11/2009 |
| JP | 2010526214 | A | 7/2010 |
| JP | 2014152219 | A | 8/2014 |
| JP | 2015054994 | A | 3/2015 |
| JP | 2015056315 | A | 3/2015 |
| JP | 2015513615 | A | 5/2015 |
| JP | 2015513616 | A | 5/2015 |
| JP | 2016538420 | A | 12/2016 |
| JP | 2017048442 | A | 3/2017 |
| JP | 2017053013 | A | 3/2017 |
| JP | 2017073356 | A | 4/2017 |
| JP | 2017527701 | A | 9/2017 |
| JP | 2019044238 | A | 3/2019 |
| JP | 2019205997 | A | 12/2019 |
| KR | 100962903 | B1 | 6/2010 |
| KR | 20150073651 | A | 7/2015 |
| KR | 20160000940 | A | 1/2016 |
| KR | 20190028595 | A | 3/2019 |
| KR | 20190133914 | A | 12/2019 |
| RU | 2012148408 | A | 5/2014 |
| WO | WO-2007041872 | A1 | 4/2007 |
| WO | WO-2007108014 | A1 | 9/2007 |
| WO | WO-2008124538 | A1 | 10/2008 |
| WO | WO-2011100581 | A1 | 8/2011 |
| WO | WO-2011108546 | A1 | 9/2011 |
| WO | WO-2012006240 | A1 | 1/2012 |
| WO | WO-2012050530 | A1 | 4/2012 |
| WO | WO-2013006710 | A2 | 1/2013 |
| WO | WO-2013016447 | A2 | 1/2013 |
| WO | WO-2014018091 | A1 | 1/2014 |
| WO | WO-2014032000 | A1 | 2/2014 |
| WO | WO-2014042781 | A2 | 3/2014 |
| WO | WO-2014043651 | A2 | 3/2014 |
| WO | WO-2014046797 | A2 | 3/2014 |
| WO | WO-2014154253 | A1 | 10/2014 |
| WO | WO-2014160529 | A1 | 10/2014 |
| WO | WO-2015035521 | A1 | 3/2015 |
| WO | WO-2015184388 | A1 | 12/2015 |
| WO | WO-2016039999 | A1 | 3/2016 |
| WO | WO-2016108603 | A1 | 7/2016 |
| WO | WO-2016124494 | A1 | 8/2016 |
| WO | WO-2017014635 | A1 | 1/2017 |
| WO | WO-2017021083 | A1 | 2/2017 |
| WO | WO-2017116307 | A1 | 7/2017 |
| WO | WO-2017171115 | A1 | 10/2017 |
| WO | WO-2018001637 | A1 | 1/2018 |
| WO | WO-2018044720 | A1 | 3/2018 |
| WO | WO-2019020239 | A1 | 1/2019 |

(56) References Cited

FOREIGN PATENT DOCUMENTS

| | | | |
|---|---|---|---|
| WO | WO-2019051069 | A1 | 3/2019 |
| WO | WO-2019051609 | A1 | 3/2019 |
| WO | WO-2019120812 | A1 | 6/2019 |
| WO | WO-2019136018 | A2 | 7/2019 |
| WO | WO-2019144135 | A1 | 7/2019 |
| WO | WO-2019157507 | A1 | 8/2019 |
| WO | WO-2019206882 | A1 | 10/2019 |
| WO | WO-2020057998 | A1 | 3/2020 |
| WO | WO-2020125868 | A1 | 6/2020 |
| WO | WO-2020245070 | A1 | 12/2020 |
| WO | WO-2021002183 | A1 | 1/2021 |
| WO | WO-2021108446 | A1 | 6/2021 |
| WO | WO-2021252535 | A2 | 12/2021 |
| WO | WO-2022031726 | A2 | 2/2022 |
| WO | WO-2022061392 | A1 | 3/2022 |
| WO | WO-2022235304 | A1 | 11/2022 |
| WO | WO-2023081846 | A1 | 5/2023 |
| WO | WO-2023205671 | A2 | 10/2023 |
| WO | WO-2023212597 | A1 | 11/2023 |

OTHER PUBLICATIONS

Hernandez et al, Syngas production from electrochemical reduction of CO2: current status and prospective implementation, Green Chemistry, vol. 19, No. 10, May 2017, pp. 2326-2346 (Year: 2017).*

Aeshala, L.M. et al., "Effect of solid polymer electrolyte on electrochemical reduction of CO2, Separation and Purification Technology," 94, (2012), pp. 131-137.

Ahlfield J., et al., "PEM/AEM Junction Design for Bipolar Membrane Fuel Cells," Journal of The Electrochemical Society, 2017, vol. 164 (12), pp. F1165-F1171.

AU Office Action dated Sep. 7, 2022, in Application No. AU2019210132.

Badami, M. "Leakage effects on the performance characteristics of a regenerative blower for the hydrogen recirculation of a PEM fuel cell," Energy Conversion and Management, vol. 55, Mar. 2012, pp. 20-25.

Badami, M., "Theoretical model with experimental validation of a regenerative blower for hydrogen recirculation in a PEM fuel cell system," Energy Conversion and Management, vol. 51, Issue 3, Mar. 2010, pp. 553-560.

Bakshi M., et al., "How Surfactants Control Crystal Growth of Nanomaterials," ACS Crystal Growth & Design, 2016, vol. 16, pp. 1104-1133.

Balster, J. et al., "Tailoring the Interface Layer of the Bipolar Membrane", Journal of Membrane Science, vol. 365, No. 1-2, Dec. 2010, pp. 389-398.

Blaszczyk, J., "In-Situ Anode Recirculation Rate Measurement Method (Draft)," Ogura Industrial Corporation, Ballard Power Systems, Full Cell Seminar & Exposition 2011, Oct. 31-Nov. 3, 2011, 22 pages.

BR Office Action dated Nov. 28, 2022, in Application No. BR112020014938 1 with English translation.

Casebolt, R., et al., "Effect of Electrolyte Composition and Concentration on Pulsed Potential Electrochemical CO2 Reduction," ChemElectroChem, Chemistry Europe, Accepted Manuscript, 25 pp.

CN Office Action dated Jan. 4, 2023, in CN Application No. CN201980021305.1 with English translation.

Delacourt et al., "Design of an Electrochemical Cell Making Syngas (CO + H2) from CO2 and H2O Reduction at Room Temperature," Journal of The Electrochemical Society, 155 (1), (2008), pp. B42-B49.

Endrodi, B., "Multilayer Electrolyzer Stack Converts Carbon Dioxide to Gas Products at High Pressure with Multilayer Electrolyzer Stack Converts Carbon," acs Energy Lett. 2019, 4, 1770-1777.

EP search report dated Sep. 14, 2021, in application No. EP19741371.9.

Gangeri, M et al., "Fe and Pt Carbon Nanotubes for the Electrocatalytic Conversion of Carbon Dioxide to Oxygenates", Catalysis Today, May 2009, vol. 143, pp. 57-63.

Hori, Y., "Chapter 48: Co2-reduction, catalyzed by metal electrodes," Handbook of Fuel Cells—Fundamentals, Technology and Applications, vol. 2, Electrocatalysis, 2003. pp. 720-733.

Hori, Y., et al., "Electroreduction of CO to CH4 and C2H4 at a Copper Electrode in Aqueous Solutions at Ambient Temperature and Pressure", Journal of the American Chemical Society, Aug. 5, 1987, vol. 109, pp. 5022-5023.

Hori, Y et al., "Silver-coated Ion Exchange Membrane Electrode Applied to Electrochemical Reduction of Carbon Dioxide", Electrochimica Acta, Aug. 2003, vol. 48, pp. 2651-2657.

IN Office Action dated Feb. 16, 2022, in Application No. IN202037034886.

International Preliminary Report on Patentability dated Dec. 22, 2022, in PCT Application No. PCT/US2021/036475.

International Preliminary Report on Patentability dated Feb. 16, 2023 in PCT Application No. PCT/US2021/044378.

International Preliminary Report on Patentability issued on Jun. 10, 2021, in PCT Application No. PCT/US2019/063471.

International Search Report and Written Opinion dated Apr. 10, 2023 in PCT Application No. PCT/US2022/079335.

International Search Report and Written Opinion dated Apr. 30, 2019, for application No. PCT/US19/014586.

International Search Report and Written Opinion dated Feb. 28, 2022, in Application No. PCT/US2021/044378.

International Search Report and Written Opinion dated Jan. 10, 2022, in Application No. PCT/US2021/036475.

International Search Report and Written Opinion dated Mar. 7, 2023 in PCT Application No. PCT/US2022/081034.

International Search Report and Written Opinion dated Mar. 10, 2023 in PCT Application No. PCT/US2022/079570.

James, B.D., et al. 2017 DOE Hydrogen and Fuel Cells Program Review, Fuel Cell Systems Analysis, Strategic Analysis, Project IDI FC163, Jun. 8, 2017, 34 pages.

JP Office Action dated Jan. 4, 2023, in Application No. JP2020-561577 with English translation.

Kim, C., et al., "Impact of Pulsed Electrochemical Reduction of CO2 on the formation of C2+ Products over Cu," ACS Catal., 2020, 10, 12403-12413.

Kimura, K.W., et al., "Selective Electrochemical CO2 Reduction During Pulsed Potential Stems From Dynamic Interface," ACS Catalysis, ACS Paragon Plus Environment, University of Illinois at Urbana-Champaign, Downloaded from pubs.acs.org on Jun. 30, 2020, 31 pages.

Kriescher, Stefanie M.A. et al., "A membrane electrode assembly for the electrochemical synthesis of hydrocarbons from C02(g) and Ho2(g), Electrochemistry Communications," 50 (2015), pp. 64-68.

Li, et al., "Electrolysis of Co2 to Syngas in Bipolar Membrane-Based Electrochemical Cells," ACS Publications, ACS Energy Letters, 2016, 1, pp. 1149-1153.

Li, et al., "Electrolytic Conversion of Bicarbonate into CO in a Flow Cell," Cell Press, Joule 3, Jun. 19, 2019, pp. 1487-1497.

Liew, F. et al., "Gas Fermentation—A Flexible Platform for Commercial Scale Production of Low-Carbon-Fuels and Chemicals from Waste and Renewable Feedstocks", Frontiers in Microbiology, May 11, 2016, vol. 7, No. 694, pp. 1-28.

Liu C., et al., "Constructing a Multifunctional Interface Between Membrane and Porous Transport Layer for Water Electrolyzers," ACS Applied Materials & Interfaces, 2021, vol. 13, pp. 16182-16196.

Ma, M., et al., "Insights into the Carbon Balance for C02 Electroreduction on Cu using Gas Diffusion Electrode Reactor Designs", Energy & Environmental Science, Feb. 12, 2020, vol. 13, pp. 977-985.

Mandal M., et al., "Improved Polymer Electrolyte Membrane Water Electrolyzer Performance by Using Carbon Black as a Pore Former in the Anode Catalyst Layer," Journal of Power Sources, 2022, vol. 541, pp. 1-13.

Mayerhofer B., et al., "Bipolar Membrane Electrode Assemblies for Water Electrolysis," ACS Applied Energy Materials, 2020, vol. 3, pp. 9635-9644.

(56) References Cited

OTHER PUBLICATIONS

Mcdonald M., et al., "Graphene Oxide as a Water Dissociation Catalyst in the Bipolar Membrane Interfacial Layer," ACS Applied Materials & Interfaces, 2014, vol. 6, pp. 13790-13797.
Morsy S., et al., "Role of Surfactants in Nanotechnology and Their Applications," International Journal of current Microbiology and Applied Sciences, 2014, vol. 3(5), pp. 237-260.
Office Action issued on Apr. 1, 2021, in U.S. Appl. No. 16/254,255.
Patru, A., et al., "Design Principles of Bipolar Electrochemical Co-Electrolysis Cells for Efficient Reduction of Carbon Dioxide from Gas Phase at Low Temperature," Journal of The Electrochemical Society, 166 (2), (2019), pp. F34-F43.
Phan C., et al., "Role of Capping Agent in Wet Synthesis of Nanoparticles," The Journal of Physical Chemistry A, 2017, vol. 121, pp. 3213-3219.
Sharma, et al., "Electrocatalytic conversion of carbon dioxide to fuels: a review on the interaction between CO2 and the liquid electrolyte," WIREs Energy Environ 2017, 6:e239. doi: 10.1002/wene.239, pp. 1-21.
Shi, L. et al., "A shorted membrane electrochemical cell powered by hydrogen to remove $CO_2$from the air feed of hydroxide exchange membrane fuel cells", Nature Energy, Mar. 2022, vol. 7, 36 pages.
Spets et al. "Direct Glucose Fuel Cell With Anion Exchange Membrane in the Near Neutral State Electrolyte, International Journal of Electrochemical Science," 7, 11696-11705, Dec. 1, 2012, entire document, http.electrochemsci .org/papers/vol? /71211696 .pdf.
Srinivasan, S. et al., "Advances in Solid Polymer Electrolyte Fuel Cell Technology with Low Platinum Loading Electrodes," Journal of Power Sources, 22 (1988) pp. 359-375.
U.S. Notice of Allowance dated Sep. 1, 2022 in U.S. Appl. No. 16/254,255.
U.S. Non-Final office Action dated Jan. 20, 2023 in U.S. Appl. No. 17/452,395.
U.S. Non-Final Office Action dated Mar. 14, 2023 in U.S. Appl. No. 17/342,406.
US Non-Final Office Action dated Oct. 22, 2021, in U.S. Appl. No. 16/254,255.
U.S. Appl. No. 18/051,944, inventors Kuhl et al., filed Nov. 2, 2022.
U.S. Appl. No. 18/053,945, inventors Huo et al., filed Nov. 9, 2022.
U.S. Appl. No. 18/295,412, inventors Flanders et al., filed Apr. 4, 2023.
U.S. Appl. No. 18/324,929, inventors Huo Ziyang et al., filed May 26, 2023.
U.S. Appl. No. 18/327,835, inventors Zhao S, et al., filed Jun. 1, 2023.
U.S. Restriction Requirement dated Dec. 15, 2022 in U.S. Appl. No. 17/452,395.
U.S. Restriction requirement dated Jun. 23, 2023, in U.S. Appl. No. 17/444,356.
Verma, et al., "The effect of electrolyte composition on the electroreduction of CO2 to CO on Ag based gas diffusion electrodes," Phys. Chem. Chem. Phys., 2016, 18, pp. 7075-7084.
Voskian, S. et al., "Faradaic electro-swing reactive adsorption for $CO_2$ capture", Energy & Environmental Science, 2019, vol. 12, pp. 3530-3547.
Xia, Chuan, et al., "Continuous production of pure liquid fuel solutions via electrocatalytic CO2 reduction using solid electrolyte devices," Nature Energy, http://www.nature.com/natureenergy ; https://doi.org/10.1038/s41560-019-0451-x.
Xu, Y., et al., "Self-Cleaning CO2 Reduction Systems: Unsteady Electrochemical Forcing Enables Stability," ACS Energy Letters, 2021, 6, pp. 809-815.
Zhu, Wenlei et al., "Monodisperse Au Nanoparticles for Selective Electrocatalytic Reduction of CO2 to CO.Journal of the American Chemical Society," 2013, 135, pp. 16833-16836.
CA Office Action dated Apr. 22, 2025 in CA Application No. 3187895.
CA Office Action dated Feb. 6, 2025 in CA Application No. 20193089119.
Hu L., et al., "A Scalable Membrane Electrode Assembly Architecture for Efficient Electrochemical Conversion of CO2 to Formic Acid," Nature Communications, 2023, vol. 14 (7605), pp. 1-11.
Hu L., et al., "A Scalable Membrane Electrode Assembly Architecture for Efficient Electrochemical Conversion of $CO_2$ to Formic Acid," Supporting Information, pp. 1-15.
International Preliminary Report on Patentability and Written Opinion dated Apr. 24, 2025 in PCT Application No. PCT/US2023/075864.
International Preliminary Report on Patentability and Written Opinion dated Jan. 2, 2025 in PCT Application No. PCT/US2023/024184.
International Preliminary Report on Patentability and Written Opinion dated Jul. 3, 2025 in PCT Application No. PCT/US2023/085244.
International Preliminary Report on Patentability and Written Opinion dated Jun. 20, 2024 in PCT Application No. PCT/US2022/081034.
International Preliminary Report on Patentability and Written Opinion dated Jun. 20, 2024 in PCT Application No. PCT/US2022/081209.
International Preliminary Report on Patentability and Written Opinion dated May 16, 2024 in PCT Application No. PCT/US2022/079335.
International Preliminary Report on Patentability and Written Opinion dated May 23, 2024 in PCT Application No. PCT/US2022/079570.
International Preliminary Report on Patentability and Written Opinion dated Oct. 17, 2024 in PCT Application No. PCT/US2023/017576.
International Preliminary Reporton Patentability and Written Opinion dated Feb. 27, 2025 in PCT Application No. PCT/US2023/024371.
International Search Report and Written Opinion dated Apr. 26, 2024 in PCT Application No. PCT/US2023/075864.
International Search Report and Written Opinion dated Dec. 23, 2024, (Applicant first notified on Dec. 17, 2024) for Application No. PCT/US2024/048988.
International Search Report and Written Opinion dated Jul. 19, 2024 in PCT Application No. PCT/US2023/085244.
International Search Report and Written Opinion dated May 6, 2024 in PCT Application No. PCT/US2022/081209.
International Search Report and Written Opinion dated May 29, 2024 in PCT Application No. PCT/US2023/077221.
International Search Report and Written Opinion dated Oct. 9, 2024, (Applicant first notified on Oct. 2, 2024) for Application No. PCT/US2024/024559.
Invitation to Pay Additional Fees dated Aug. 14, 2024 in PCT Application No. PCT/US2024/024559.
Invitation to Pay Additional Fees dated May 28, 2024 in PCT Application No. PCT/US2023/085244.
JP Office Action dated Apr. 9, 2025 in JP Application No. 2023-507462 with English translation.
JP Office Action dated Jul. 1, 2025 in JP Application No. 2022-575454, with EnglishTranslation.
JP Office Action dated Sep. 17, 2024 in JP Application No. 2023-507462 with English translation.
KR Office Action dated Aug. 20, 2024 in KR Application No. 10-2020-7024266 with English translation.
KR Office Action dated Feb. 24, 2025 in KR Application No. 10-2020-7024266, with English Translation.
Lyons W., et al., "Standard Handbook of Petroleum and Natural Gas Engineering", Ideal Gas Laws, 3rd Edition, 2016, vol. 2, pp. 148-149.
Nakashima T., et al., "Preparation of Fusion Materials Based on Ionic Liquids and Cationic Gold Nanoparticles", Polymer Journal, 2015, vol. 47, pp. 171-176.
Pang X., et al., "Membrane-free electrochemical $CO_2$ conversion using serially connected porous flow-through electrodes," Cell Press, Joule 6, 2022, pp. 2745-2761.
Pappijn, C., et al., "Challenges and Opportunities of Carbon Capture and Utilization: Electrochemical Conversion of CO2 to Ethylene," Original research, 2020, vol. 8, pp. 1-12.

(56) References Cited

OTHER PUBLICATIONS

Rickard J., et al., New Device Architecture Enables Streamlined Production of Formic Acid From CO2 Using Renewable Electricity, News & Feature Stories, pp. 1-4.
Sabatino F., et al., "Evaluation of a Direct Air Capture Process Combining Wet Scrubbing and Bipolar Membrane Electrodialysis", Industrial & Engineering Chemistry Research, vol. 59(15), 2020, pp. 7007-7020.
Seo M.H., et al., "Synthesis, Characterization, and Electrocatalytic Properties of a Polypyrrole-composited Pd/C Catalyst," International Journal of Hydrogen Energy, 2011, vol. 36(18), pp. 11545-11553.
Sturman, M., et al., "Process Parameters in the Electrochemical Reduction of Carbon Dioxide to Ethylene," ChemBioEng, 2021, vol. 8(3), pp. 1-41.
Taniguchi I., et al., "Low Energy CO2 Capture by Electrodialysis", Energy Procedia, vol. 114, 2017, pp. 1615-1620.
U.S. Corrected Notice of Allowance dated Feb. 24, 2025 in U.S. Appl. No. 17/452,395.
U.S. Final Office Action dated Apr. 24, 2024 in U.S. Appl. No. 18/324,929.
U.S. Final Office Action dated Feb. 27, 2025 in U.S. Appl. No. 18/324,929.
U.S. Final Office Action dated Jul. 2, 2024 in U.S. Appl. No. 18/327,835.
U.S. Final Office Action dated Jul. 15, 2025 in U.S. Appl. No. 18/295,412.
U.S. Final Office Action dated Jul. 26, 2024 in U.S. Appl. No. 18/495,406.
U.S. Final Office Action dated Jun. 5, 2024 in U.S. Appl. No. 17/444,356.
U.S. Non-Final Office Action dated Dec. 11, 2024 in U.S. Appl. No. 17/342,406.
U.S. Non-Final Office Action dated Feb. 3, 2025 in U.S. Appl. No. 18/295,412.
U.S. Non-Final Office Action dated Jul. 25, 2024 in U.S. Appl. No. 18/328,524.
US Non-Final Office Action dated Jun. 10, 2025 in U.S. Appl. No. 17/342,406.
U.S. Non-Final Office Action dated Jun. 17, 2024 in U.S. Appl. No. 17/342,406.
U.S. Non-Final Office Action dated Jun. 17, 2024 in U.S. Appl. No. 18/623,555.
U.S. Non-Final Office Action dated Mar. 26, 2024 in U.S. Appl. No. 17/452,395.
U.S. Non-Final Office Action dated Mar. 27, 2025 in U.S. Appl. No. 18/509,058.
US Non-Final Office Action dated May 19, 2025 in U.S. Appl. No. 18/053,945.
U.S. Non-Final Office Action dated Sep. 24, 2024 in U.S. Appl. No. 18/324,929.
U.S. Notice of Allowance dated Apr. 14, 2025 in U.S. Appl. No. 18/328,524.
U.S. Notice of Allowance dated Feb. 3, 2025 in U.S. Appl. No. 17/444,356.
U.S. Notice of Allowance dated Jan. 23, 2025 in U.S. Appl. No. 18/327,835.
U.S. Notice of Allowance dated Nov. 6, 2024 in U.S. Appl. No. 17/444,356.
U.S. Notice of Allowance dated Nov. 20, 2024 in U.S. Appl. No. 17/452,395.
U.S. Appl. No. 19/219,252, inventors Huo Z et al., filed May 27, 2025.
U.S. Restriction Requirement dated May 13, 2025, in U.S. Appl. No. 18/062,459.
Xie K., et al., "Bipolar Membrane Electrolyzers Enable High Single Pass $CO_2$ Electroreduction to Multicarbon Products," Nature Communications 2022, vol. 13 (1), pp. 1-13.
Adabi, et al., "High-performing Commercial Fe—N—C Cathode Electrocatalyst for Anion-exchange Membrane Fuel Cells, "Nature Energy, 2021, pp. 1-10.
Chen, et al., "Poly(Alkyl-terphenyl Piperidinium) Ionomers and Membranes With an Outstanding Alkaline-membrane Fuel-cell Performance of 2.58 Wcm@2, "Fuel Cells Hot Paper, 2021, vol. 60, pp. 7710-7718.
Chen, et al., "Poly(Fluorenyl Aryl Piperidinium) Membranes and Ionomers for Anion Exchange Membrane Fuel Cells," Nature Communications, 2021, vol. 12, pp. 1-12.
Chen L., et al., "Design Principles for Water Dissociation Catalysts in High-performance Bipolar Membranes," Nature Communications, 2022, vol. 13 Article No. 3846, pp. 1-10.
Digdaya, et al., "A Direct Coupled Electrochemical System for Capture and Conversion of Co2 From Oceanwater," Nature Communications, 2020, vol. 11, pp. 1-10.
Eisaman, M D., et al., $CO_2$ Separation Using Bipolar Membrane Electrodialysis, Energy and Environmental Science, 2011, vol. 4(4), pp. 1319-1328.
European Office Action dated Sep. 4, 2023 in Application No. EP19741371.9.
Fan, et al., "Poly(Bis-arylimidazoliums) Possessing High Hydroxide Ion Exchange Capacity and High Alkaline Stability," Nature Communications, 2019, vol. 10, pp. 1-10.
Ganji P., et al., "Toward Commercial Carbon Dioxide Electrolysis", Advanced Sustainable Systems, Wiley, US, Jun. 9, 2020, vol. 4(8), 22 Pages.
Gao, M., et al., "The Role of Adsorbed Oleylamine on Gold Catalysts During Synthesis for Highly Selective Electrocatalytic Reduction of CO2 to CO," The Royal Society of Chemistry, 2020, vol. 56, pp. 7021-7024.
Ge, et al., "Oxygen Reduction in Alkaline Media: From Mechanisms to Recent Advances of Catalysts," ACS Catalysis, 2015,vol. 5, pp. 1-97.
Gerhardt, et al., "Along-the-channel Impacts Ofwater Management and Carbon-dioxide Contamination in Hydroxide-exchange-membrane Fuel Cells: a Modeling Study," Journal of the Electrochemical Society, 2019, vol. 166(7), pp. F3180-F3192.
Gu, et al., "Electrochemical Energy Engineering: a New Frontier of Chemical Engineering Innovation," Annual Review of Chemical and Biomolecular Engineering, 2014, vol. 5, pp. 429-454.
Gurkan, B., et al., "Quinone Reduction in Ionic Liquids for Electrochemical CO 2 Separation," ACS Sustainable Chemistry & Engineering, Jun. 5, 2015, vol. 3(7), pp. 1394-1405.
Hao, J.H. et al., "Preparation of Solvent-resistant Anion-exchange Membranes", Desalination, Jun. 2000, vol. 129, No. 1, pp. 15-22.
Hassan, N., et al., "Achieving High-Performance and 2000 h Stability in Anion Exchange Membrane Fuel Cells by Manipulating Ionomer Properties and Electrode Optimization," Advanced Energy Materials, 2020, pp. 1-8.
Huang, et al., "Composite Poly(Norbornene) Anion Conducting Membranes for Achieving Durability, water Management and High Power 3.4 W/cm2) in Hydrogen/oxygen Alkaline Fuel Cells," Journal of The Electrochemical Society, 2019, vol. 10, pp. F637-F644.
Inaba, et al., "Effects of Carbon Dioxide on the Performance of Anion-exchange Membrane Fuel Cells," Electrochemistry, 2011, vol. 79(5), pp. 322-325.
International Preliminary Report on Patentability and Written opinion dated Jun. 9, 2022 in Application No. PCT/US2020/062080.
International Search Report and Written Opinion dated Feb. 23, 2022, in Application No. PCT/US2021/55902.
International Preliminary Report on Patentability dated May 4, 2023, in Application No. PCT/US2021/055900.
International Preliminary Report on Patentability dated May 4, 2023, in Application No. PCT/US2021/055902.
International Search Report and Written Opinion dated Feb. 24, 2022, in Application No. PCT/US2021/055900.
International Search Report and Written Opinion dated Jul. 20, 2023, in Application No. PCT/US2023/017576.
International Search Report and Written Opinion dated Nov. 27, 2023 in PCT Application No. PCT/US2023/024184.

(56) References Cited

OTHER PUBLICATIONS

International Search Report and Written Opinion dated Sep. 21, 2023, in Application No. PCT/US2023/024371.
International Search Report and Written Opinion issued in PCT Application No. PCT/US2020/062080 on Mar. 16, 2021.
Jones J H., "The Cativa Process for the Manufacture Plant of Acetic Acid," Platinum Metals, 2000, vol. 44(3), pp. 94-105.
JP Office Action dated Jan. 16, 2024 in JP Application No. 2023-507462 with English translation.
JP Office Action dated Jul. 11, 2023 in Application No. JP2023-507462 with English translation.
Kalck, P., et al., "Recent Advances in the Methanol Carbonylation Reaction Into Acetic Acid," Coordination Chemistry Reviews, 2020, vol. 402, 58 pages.
Kang, J S., et al., "Redox-responsive Sorbents and Mediators for Electrochemically Based $Co_2$ Capture," Current Opinion in Green and Sustainable Chemistry, Oct. 1, 2021, vol. 31, p. 100504.
Keith, et al., "A Process for Capturing Co2 From the Atmosphere," Cell Press, 2018, vol. 2, pp. 1573-1594.
KR Office Action dated Nov. 7, 2023 in KR Application No. 10-2020-7024266, with English Translation.
Kungas R., "Review—Electrochemical CO2 Reduction for CO Production: Comparison of Low- and High- Temperature Electrolysis Technologies," Journal of The Electrochemical Society, 2020, vol. 167, 044508, 12 Pages.
Liu, Y., et al., "Electrochemically Mediated Carbon Dioxide Separation with Quinone Chemistry in Salt-concentrated Aqueous Media," Nature Communications, May 8, 2020, vol. 11(1), pp. 1-11.
Lu, et al., "Halloysite-derived Nitrogen Doped Carbon Electrocatalysts for Anion Exchange Membrane Fuel Cells," Journal of Power Sources, 2017, vol. 372, pp. 82-90.
Machine translation of Kang et al KR20150073651A, 2015.
Machine translation of Shin et al WO2016108603A1, 2016.
Matz, et al., "Demonstration of Electrochemically-driven Co2 Separation Using Hydroxide Exchange Membranes," Journal of the Electrochemical Society, 2021, vol. 168, pp. 1-12.
Muroyama, et al., "Review—CO2 Separation and Transport via Electrochemical Methods," Journal of the Electrochemical Society, 2020, vol. 167, pp. 1-13.
Peng, et al., "Nitrogen-doped Carbon-coox Nanohybrids: a Precious Metal Free Cathode That Exceeds 1.0 Wcm@2 Peak Power and 100 H Life in Anion- Exchange Membrane Fuel Cells," Angewandte Chemie, 2019, vol. 58(4), pp. 1058-1063.
Peng, et al., "Using Operando Techniques to Understand and Design High Performance and Stable Alkaline Membrane Fuel Cells," Nature Communications, 2020, vol. 11, pp. 1-10.
Qi J et al., "Selective Methanol Carbonylation to Acetic Acid on Heterogeneous Atomically Dispersed ReO4/SiO2 Catalysts," Journal of the American Chemical Society, 2020, vol. 142(33), pp. 14178-14189.
Rucareanu S., et al., 4-(N,N-Dimethylamino)pyridine-Protected Au Nanoparticles: Versatile Precursors for Water and Organic-Soluble Gold Nanoparticles, Chem. Mater, 2006, vol. 18, pp. 4674-4680.
SA Office Action dated Sep. 26, 2023, in application No. SA522441684 with English Translation.
Sharifian, et al., "Electrochemical Carbon Dioxide Capture to Close the Carbon Cycle," Energy & Environmental Science, 2021, vol. 14, pp. 781 814.
Shi, et al., "Editors' Choice—uncovering the Role of Alkaline Pretreatment for Hydroxide Exchange Membrane Fuel Cells," Journal of the Electrochemical Society, 2020, vol. 167, pp. 1-10.
Shi, X., et al., "Sorbents for the Direct Capture of Co2 From Ambient Air," Angewandte Chemie, 2020, vol. 59(18), pp. 1-25.
Shu, Q., et al., "Electrochemical Regeneration of Spent Alkaline Absorbent from Direct Air Capture," Environmental science & technology, 2020, vol. 54(14), pp. 8990-8998.
U.S. Corrected Notice of Allowance dated Sep. 20, 2023, in U.S. Appl. No. 18/328,581.
U.S. Final office Action dated Aug. 21, 2023 in U.S. Appl. No. 17/452,395.
U.S. Final Office Action dated Aug. 30, 2023, in U.S. Appl. No. 17/342,406.
U.S. Final Office Action dated Feb. 8, 2024 in U.S. Appl. No. 18/327,835.
U.S. Final Office Action dated Mar. 12, 2024 in U.S. Appl. No. 18/328,524.
U.S. Final office Action dated Nov. 21, 2022 in U.S. Appl. No. 17/247,036.
U.S. Non-Final Office Action dated Aug. 15, 2023, in U.S. Appl. No. 18/328,524.
U.S. Non-Final Office Action dated Dec. 1, 2023 in U.S. Appl. No. 18/295,412.
U.S. Non-Final Office Action dated Jan. 10, 2024 in U.S. Appl. No. 18/495,406.
U.S. Non-Final Office Action dated May 24, 2022, in U.S. Appl. No. 17/247,036.
U.S. Non-Final Office Action dated Nov. 15, 2023 in U.S. Appl. No. 18/324,929.
U.S. Non-Final Office Action dated Oct. 5, 2023, in U.S. Appl. No. 17/444,356.
U.S. Non-Final Office Action dated Sep. 22, 2023, in U.S. Appl. No. 18/327,835.
U.S. Notice of Allowance dated Feb. 10, 2023 in U.S. Appl. No. 17/247,036.
U.S. Notice of Allowance dated Mar. 2, 2023 in U.S. Appl. No. 17/247,036.
U.S. Notice of Allowance dated Nov. 8, 2023 in U.S. Appl. No. 18/328,581.
U.S. Appl. No. 18/300,380, inventors Ziyang Huo et al., filed Apr. 13, 2023.
U.S. Appl. No. 18/306,928, inventors Kendra P. Kuhl et al., filed Apr. 25, 2023.
U.S. Appl. No. 18/328,524, inventors Wu, Y., et al., filed Jun. 2, 2023.
U.S. Appl. No. 18/437,574, inventor Stevic L., filed Feb. 9, 2024.
U.S. Appl. No. 18/495,406 , inventors Wu Y, et al., filed Oct. 26, 2023.
U.S. Appl. No. 18/509,058, inventors Huo Z, et al., filed Nov. 14, 2023.
U.S Restriction requirement dated Aug. 1, 2023 in U.S. Appl. No. 18/324,929.
U.S. Restriction requirement dated Jul. 28, 2023, in U.S. Appl. No. 17/451,630.
Van Bavel, S., et al., "Integrating $CO_2$ Electrolysis into the Gas-to-Liquids-Power-to-Liquids Process," ACS Energy Letters, Jul. 24, 2020, vol. 5(8), pp. 2597-2601.
Wallace, G G., et al., "Manipulating and Monitoring Biomolecular Interactions with Conducting Electroactive Polymers," Advanced Materials, VCH Publishers, DE, Jul. 4, 2002, vol. 14(13-14), pp. 953-960.
Wang, et al., "Approaches for the preparation of non-linear amphiphilic polymers and their applications to drug delivery", Advanced Drug Delivery Reviews, 2012, vol. 64, pp. 852-865.
Wang, L., et al., "A High Conductivity Ultrathin Anion-exchange Membrane With 500+ H Alkali Stability for Use in Alkaline Membrane Fuel Cells That Can Achieve 2 W $Cm^{-2}$ at 80° C ," Journal of Materials Chemistry A, 2018, vol. 6, pp. 15404-15412.
Wang, L., "Radiation-grafted anion-exchange membranes: the switch from low- to high-density polyethylene leads to remarkably enhanced fuel cell performance," Energy and Environmental Science, 2019, vol. 12, 1575-1579.
Wang, Y., et al., "Synergistic Mn—Co Catalyst Outperforms Pt on High-rate Oxygen Reduction for Alkaline Polymer Electrolyte Fuel Cells," Nature Communications, 2019, vol. 10(1), pp. 1-8.
Woo, J., et al., "Promoting Oxygen Reduction Reaction Activity of Fe—N/C Electrocatalysts by Silica-Coating-Mediated Synthesis for Anion-Exchange Membrane Fuel Cells," Chemistry of Materials, 2018, vol. 30, pp. 6684-6701.
Wurzbacher, J., et al., "Concurrent Separation of Co2 and H2o From Air by a Temperature-vacuum Swing Adsorption/desorption Cycle," Environmental science & technology, 2012, vol. 46(16), pp. 9191-9198.

(56) References Cited

OTHER PUBLICATIONS

Xin, L., et al., Carbon Supported Ag Nanoparticles as High Performance Cathode Catalyst for H2/O2 anion exchange membrane fuel cell, Frontiers in Chemistry, 2013, vol. 1(16), pp. 1-5.
Xu, C. et al., Preparation of PVA-GA-CS/PVA-Fe-SA Bipolar Membrane and Its Application in Electro-generation of 2,2-dimethyl-3-hydroxypropionic Acid, Journal of Membrane Science, vol. 307, No. 2, Jan. 2008, pp. 218-224.
Yang, B. et al., "Preparation of a Bipolar Membrane by Photografting Polymerization", Frontiers of Chemistry in China, vol. 3, No. 1, Jan. 2008, pp. 10-13.
Zhan, et al., "Multiarm Star Poly(epsilon-caprolactone) with Hyperbranched Polyamidoamine as Core Capable of Selective Accommodating Cationic or Anionic Guests", Chinese Journal of Polymer Science, 2015. vol. 33, No. 6, pp. 920-930.
Zhang, J., et al., "Recent Insights on Catalyst Layers for Anion Exchange Membrane Fuel Cells," Advanced Science, 2021, vol. 8(15), pp. 1-26.
Zheng, et al., "Hyperbranched polymers: advances from synthesis to applications", Chemical Society Reviews, 2015, vol. 44, pp. 4091-4130.
Zheng, et al., "Editors' Choice—power-generating Electrochemical Co2 Scrubbing From Air Enabling Practical Aemfc Application," Journal of the Electrochemical Society, 2012, vol. 168, pp. 1-8.
Zheng, Y., et al., Quantifying and Elucidating the Effect of Co2 On the Thermodynamics, Kinetics and Charge Transport of AEMFC, Energy and Environmental Science, 2019, vol. 12, pp. 1-14.

* cited by examiner

SYSTEMS AND METHODS FOR ETHYLENE PRODUCTION

STATEMENT OF GOVERNMENT SUPPORT

This invention was made with Government support under Award Number 1738554 awarded by the National Science Foundation and under Award Number DE-SC0018831-01 awarded by the Department of Energy Office of Science. The Government has certain rights in the invention.

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in their entireties and for all purposes.

TECHNICAL FIELD

This disclosure relates generally to the electrolytic carbon oxide reduction field, and more specifically to systems and methods for electrolytic carbon oxide reactor operation for production of carbon monoxide, methane, and multicarbon products.

BACKGROUND

Membrane electrode assemblies (MEAs) for carbon oxide ($CO_x$) reduction can include a cathode layer, an anode layer, and a polymer electrolyte membrane (PEM) that provides ionic communication between the cathode layer and the anode layer. Carbon oxide ($CO_x$) reduction reactors (CRRs) that include such MEAs electrochemically reduce $CO_x$ and produce products such CO, hydrocarbons such as methane and ethylene, and/or oxygen and hydrogen containing organic compounds such as methanol, ethanol, and acetic acid. It can be difficult to obtain high concentration of gas phase products.

Background and contextual descriptions contained herein are provided solely for the purpose of generally presenting the context of the disclosure. Much of this disclosure presents work of the inventors, and simply because such work is described in the background section or presented as context elsewhere herein does not mean that such work is admitted prior art.

DESCRIPTION

Figure 1:
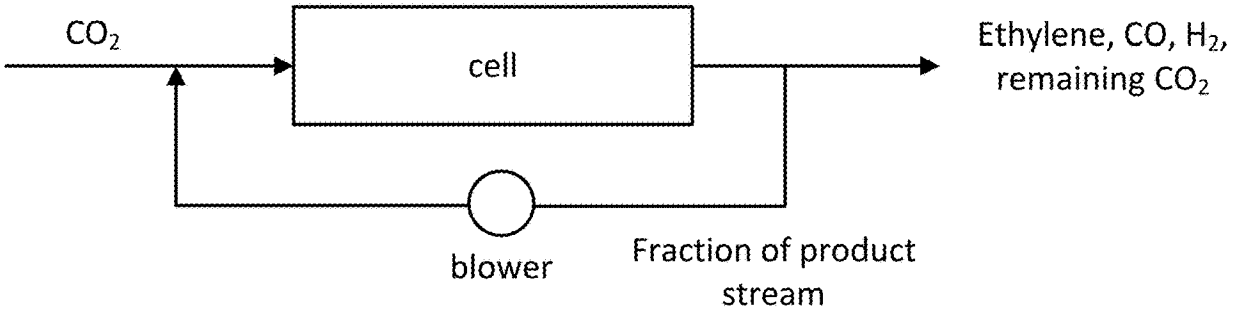
FIG. 1 shows an example of a system with an electrochemical cell and a recycle loop according to certain embodiments.

Provided herein are systems and methods for operating carbon oxide ($CO_x$) reduction reactors (CRRs) for producing high concentrations of gas phase products including carbon monoxide (CO) and many electron gas products such as methane ($CH_4$) and ethylene ($C_2H_4$).

Membrane electrode assemblies (MEAs) for carbon oxide ($CO_x$) reduction can include a cathode layer, an anode layer, and a polymer electrolyte membrane (PEM) that provides ionic communication between the cathode layer and the anode layer. CRRs that include such MEAs electrochemically reduce $CO_x$ and produce products such CO, hydrocarbons such as methane and ethylene, and/or oxygen and hydrogen containing organic compounds such as methanol, ethanol, and acetic acid.

$CO_2$ electrolysis can produce a range of products depending on the catalyst, MEA design, and operating conditions used. Hydrogen is also produced as a byproduct of $CO_2$ electrolysis. This can be useful for some applications where a mixture of $H_2$ and $CO_2$ electrolysis product are desired, but in many cases only the $CO_2$ electrolysis product is desired and it is useful to limit the amount of hydrogen in the product stream. Various catalysts in the cathode of a CRR cause different products or mixtures of products to form from $CO_x$ reduction reactions.

The number of electrons needed to generate $CO_2$ electrolysis products varies depending on the product. Two electron products, like CO, require two electrons per product molecule. "Many electron products" and "multielectron products" refers to products from reactions that use more than two electrons per product molecule. Examples of possible two electron reactions and many electron reactions at the cathode from CO and $CO_2$ electrolysis are given below:

$$CO_2+2H^++2e\text{-}\rightarrow CO+H_2O(2\text{electron})$$

$$2CO_2+12H^++12e^-\rightarrow CH_2CH_2+4H_2O(12\text{electron})$$

$$2CO_2+12H^++12e^-\rightarrow CH_3CH_2OH+3H_2O(12\text{electron})$$

$CO_2+8H_+8e^- \rightarrow CH_4+2H_2O$ (8 electron)

$2CO+8H^++8e^- \rightarrow CH_2CH_2+2H_2O$ (8 electron)

$2CO+8H^++8e^- \rightarrow CH_3CH_2OH+H_2O$ (8 electron)

$CO+6H^++6e^- \rightarrow CH_4+H_2O$ (6 electron)

CO and $CO_2$ electrolysis reactions when water is the proton source:

$CO_2+H_2O+2e^- \rightarrow CO+2OH^-$ (2 electron)

$2CO_2+8H_2O+12e^- \rightarrow CH_2CH_2+12OH^-$ (12 electron)

$2CO_2+9H_2O+12e^- \rightarrow CH_3CH_2OH+12OH^-$ (12 electron)

$CO_2+6H_2O+8e^- \rightarrow CH_4+8OH^-$ (8 electron)

$2CO+10H_2O+8e^- \rightarrow CH_2CH_2+8OH^-$ (8 electron)

$2CO+7H_2O+8e^- \rightarrow CH_3CH_2OH+8OH^-$ (8 electron)

$CO+5H_2O+6e^- \rightarrow CH_4+6OH^-$ (6 electron)

Further, at levels of electrical potential used for cathodic reduction of $CO_2$, hydrogen ions may be reduced to hydrogen gas in a parasitic reaction:

$2H^++2e^- \rightarrow H_2$(2electron)

Even at relatively low current efficiencies, the electrolyzer will produce relative high amounts of low electron gas products like CO and $H_2$. As an example, an electrolyzer that has a 30% current efficiency for ethylene and a 5% current efficiency for hydrogen results in a 1:1 molar $C_2H_2$:$H_2$ in the gas outlet stream. This is due to ethylene needing 6 times the number of electrons as hydrogen.

While some many electron products (e.g., ethanol) are liquid at common operating temperatures, many electron products like methane, ethane, ethylene, propane, and propylene are gas phase and mixed with other gas phase products and unreacted $CO_x$ in the product stream.

Another challenge with many electron gas products is water management. Water may be produced during the electrochemical reduction of $CO_x$ per the equations above and/or travel to the cathode side of the electrochemical cell where $CO_x$ reduction occurs through the polymer electrolyte membrane through diffusion, migration, and/or drag. The water should be removed from the electrochemical cell to prevent it from accumulating and blocking reactant $CO_x$ from reaching the catalyst layer.

Higher input flow rates of $CO_x$ will help remove water from the cell. Lower flow rates of $CO_x$ may not be sufficient to push out water, leading to cell flooding, the build-up of water in all or part of the MEA catalyst layer, cathode gas diffusion layer, or flow field. In flooded areas, $CO_x$ will not be able to reach the catalyst at rates necessary to support high current efficiency at high current density, which results in the production of undesired hydrogen gas in place of reduction of $CO_x$ to the desired product.

The gas flow needed through a cell to prevent flooding depends on the flow field design, current density, and gas pressure in the cell. According to various embodiments, a 100 $cm^2$ cell may have a flow of at least 100 sccm, 300 sccm, 450 sccm, or 750 sccm to prevent flooding.

While relatively high flow rates can be used for water management, low flow rates are needed for high $CO_x$ utilization for multielectron products. $CO_x$ utilization is the percent of $CO_x$ input to the electrochemical reactor that is converted to a product. Single pass $CO_x$ utilization is the $CO_x$ utilization if the gas passes through the reactor a single time. Parameters such as current density, input $CO_x$ flow rate, current efficiency, and number of electrons needed to reduce $CO_x$ to a product determine the single pass $CO_x$ utilization.

The below examples illustrate how higher $CO_x$ utilization for multielectron products results in lower flow rates. CO Reference Example is a reference example for CO production from 450 sccm of input $CO_2$ to a 100 $cm^2$ electrochemical cell at 600 mA/$cm^2$, with Examples 1 and 2 showing single pass utilization and output gas stream composition and flow rate for $CH_4$ production. Example 1 has the same input flow rate as CO Reference Example and Example 2 has the same single pass utilization.

TABLE 1

Input $CO_2$ flows and single pass $CO_2$ utilization for $CH_4$ production compared with CO production

| | CO Reference Example: CO production | Example 1: $CH_4$ production | Example 2: $CH_4$ production |
|---|---|---|---|
| Input $CO_2$ flow | 450 sccm | 450 sccm | 112.5 sccm |
| Current efficiency | 90% for CO<br>10% for $H_2$ | 90% for $CH_4$<br>10% for $H_2$ | 90% for $CH_4$<br>10% for $H_2$ |
| Single pass $CO_2$ utilization | 84% | 21% | 84% |
| Output gas stream | 14.7% $CO_2$<br>76.8% CO<br>8.5% H2. | 72.3% $CO_2$<br>19.2% methane<br>8.5% $H_2$ | 11.7% $CO_2$<br>61.1% methane<br>27.2% $H_2$ |
| Output gas flow rate | 492 sccm | 492 sccm | 154.5 sccm |

In the CO Reference Example, 450 sccm results in 84% $CO_2$ utilization. Using the same input flow rate results in only 21% utilization for methane production in Example 1. To get to a $CO_2$ utilization of 84%, a lower input flow of 112.5 sccm is used (Example 2). This is four times lower than the input flow required to convert 84% of $CO_2$ in the input stream to CO (a 2 electron product) at the outlet, vs the flow rate needed to get 84% utilization of $CO_2$ to methane (an 8 electron product).

Products that contain multiple carbon atoms further exacerbate these difficulties. The flow rate of gas through the electrolyzer is further decreased if multiple gas phase $CO_2$ molecules are converted to a single gas phase molecule of multicarbon product. Table 2, below, includes Examples 3-5, which show input $CO_2$ flow rates and single pass utilization for examples of ethylene production.

TABLE 2

Input $CO_2$ flows and single pass $CO_2$ utilization for $CH_2CH_2$ production

| | Example 3: $CH_2CH_2$ production | Example 4: $CH_2CH_2$ production | Example 5: $CH_2CH_2$ production |
|---|---|---|---|
| Input $CO_2$ flow | 450 sccm | 150 sccm | 450 sccm |
| Current efficiency | 90% for $CH_2CH_2$<br>10% for $H_2$ | 90% for $CH_2CH_2$<br>10% for $H_2$ | 33% for $CH_2CH_2$<br>33% for liquid products (e.g., $CH_2CH_2OH$)<br>33% for $H_2$ |
| Single pass $CO_2$ utilization | 28% | 84% | |
| Output gas stream | 78.7% $CO_2$<br>12.8% ethylene<br>8.5% $H_2$ | 45.3% $CO_2$<br>32.8% ethylene<br>21.9% $H_2$ | 68.9% $CO_2$<br>4.4% ethylene<br>26.7% $H_2$ |
| Output gas flow rate | 429 sccm | 129 sccm | 519.3 sccm |

The product concentration and flow rate are much lower than is possible when a two electron product is made as in the CO Reference Example. In addition, as the gas travels through the reactor, the total flow rate gets lower and lower, making water management more difficult in cases of higher $CO_2$ utilization.

In Example 5, some of the $CO_2$ is reacted to form liquid products, which make up 33% of the current efficiency but are not present in the gas phase output of the electrolyzer. Six times as much $H_2$ is produced compared to ethylene due to the difference in the number of electrons needed to make each product.

The above examples highlight the effect that even small current efficiencies for $H_2$ have on the concentration of the multielectron $CO_2$ reduction product coming out of the electrochemical cell. In the CO Reference Example, the $H_2$ concentration in the output gas stream is 8.5%. To achieve the same utilization, the $CH_4$ output gas stream contains 27.2% $H_2$ (Example 2) and the $CH_2CH_2$ output gas stream contains 21.9% $H_2$ (Example 4).

In some embodiments, CO is the starting reactant. This can mitigate some of the above described problems because fewer electrons are used to make the each of the many electron products compared to using $CO_2$ as the starting reactant. Table 3 below shows example output gas streams for $CH_4$ produced from CO reduction in a 100 $cm^2$ cell.

TABLE 3

Input CO flows and single pass CO utilization for $CH_4$

| | Example 6: $CH_4$ from CO | Example 7: $CH_4$ from CO |
|---|---|---|
| Input CO flow | 450 sccm | 150 sccm |
| Current efficiency | 90% for $CH_4$<br>10% for $H_2$ | 90% for $CH_4$<br>10% for $H_2$ |
| Single pass $CO_2$ utilization | 28% | 84% |
| Output gas stream | 65.9% CO<br>25.6% $CH_4$<br>8.5% $H_2$ | 12.5% CO<br>65.6% for $CH_4$<br>21.9% $H_2$ |
| Output gas flow rate | 492 sccm | 192 sccm |

Examples 6 and 7 can be compared to Examples 1 and 2, respectively. To get to a CO utilization of 84% (Example 7), the input flow rate is 33% higher for CO than for $CO_2$ (Example 2).

Provided herein are systems and methods for increasing the concentration of desired product in gas phase output streams of $CO_x$ electrolyzers. While the description below chiefly refers to gas phase many electron products such methane, ethane, ethylene, propane, and propylene, the systems and methods may also be implemented to increase concentration of CO for electrolyzers configured for CO production.

In the below examples, reference is made to MEAs including bipolar membrane MEAs and MEAs that include only an anion exchange membrane or only a cation exchange membrane. Further details of MEAs are included below. In particular embodiments, MEAs with bipolar membranes and those with anion exchange membranes (AEMs) may be used. Examples of MEAs for methane and ethylene are provided below with additional description of MEAs for these and other products below. In particular, bipolar membrane MEAs are discussed with reference to FIGS. 9 and 10 and AEM-only MEAs are discussed with reference to FIGS. 11 and 12. Further description may be found in U.S. patent application Ser. No. 17/247,036, filed Nov. 24, 2020, incorporated by reference herein for its description of MEAs.

In a first example, a bipolar membrane MEA for the production of methane can include a gas distribution layer (GDL), a cathode catalyst layer, a bipolar membrane, and an anode catalyst layer as follows:

GDL:
- Sigracet 39BC (5% PTFE-treated microporous layer on carbon fiber, 0.325 mm-thick)

Catalyst Layer:
- 0.16 $mg/cm^2$ of 20 nm 40% Premetek Cu/Vulcan XC-72 (360-410 nm particle size)
- 19 wt. % anion-exchange polymer electrolyte (FumaTech FAA-3)
- 1-2 μm catalyst layer thickness Membrane:
- 10-12 μm-thick anion-exchange (AEM) polymer electrolyte on Nafion (PFSA) 212 (50.8 μm thickness) Proanode (Fuel Cell Etc) membrane Anode:
- 3 $mg/cm^2$ IrRuOx anode In another example, a bipolar membrane MEA for the production of methane can include a GDL, a cathode catalyst layer, a bipolar membrane, and an anode catalyst layer as follows:

GDL:
- Single or multiple, stacked 5-20% PTFE-treated microporous layer-coated carbon fiber substrate(s) (SGL Carbon, Freudenberg Performance Materials, AvCarb Material Solutions, or other GDL manufacturers, 0.25-0.5 mm thick)

Catalyst Layer:
- 0.1-3.0 mg/cm2 of 20-100 nm Cu nanoparticles supported on carbon, for example, Premetek Cu/Vulcan XC-72 (20%-60% Cu loading)
- 5-50 wt. % anion exchange polymer electrolyte (Fumatech BWT GmbH, Ionomr Innovations Inc, or other anion exchange polymer electrolyte manufacturers)
- 1-5 μm catalyst layer thickness Membrane:
- 5-20 μm-thick anion exchange polymer electrolyte on cation exchange membrane such as Nafion® membranes (25-254 μm thickness)

Anode:
- 0.5-3 mg/cm2 IrRuOx or IrOx anode catalyst layer and porous Ti gas diffusion layer In another example, a bipolar MEA for the production of ethylene can include a GDL, a cathode catalyst layer, a bipolar membrane, and an anode catalyst layer as follows:

GDL:
- Sigracet 39BC (5% PTFE-treated microporous layer on carbon fiber, 0.325 mm-thick)

Catalyst Layer:
- 0.35 mg/cm2 of 100% Sigma Aldrich Cu (80 nm particle size)
- 19 wt. % anion-exchange polymer electrolyte (FumaTech FAA-3)
- 2-3 μm thickness Membrane:
- 20-24 μm-thick AEM polymer electrolyte on Nafion (PFSA) 115 (50.8 um thickness) Proanode (Fuel Cell Etc) membrane Anode:
- 3 mg/cm2 IrRuOx anode In another example, a bipolar MEA for the production of ethylene can include a gas distribution layer (GDL), a cathode catalyst layer, a bipolar membrane, and an anode catalyst layer as follows:

GDL:

Single or multiple, stacked 5-20% PTFE-treated microporous layer-coated carbon fiber substrate(s) (SGL Carbon, Freudenberg Performance Materials, AvCarb Material Solutions, or other GDL manufacturers, 0.25-0.5 mm thick)

Catalyst layer:

0.1-3.0 mg/cm$^2$ of pure Cu nanoparticles or Cu-based alloy nanoparticles (5-150 nm particle size) deposited via ultrasonic spray deposition, e-beam evaporation, magnetron-sputtering, or other analogous coating process 5-50 wt. % anion exchange polymer electrolyte (Fumatech BWT GmbH, Ionomr Innovations Inc, or other anion exchange polymer electrolyte manufacturers)

1-5 μm catalyst layer thickness

Membrane:

5-20 μm-thick anion-exchange (AEM) polymer electrolyte (Fumatech BWT GmbH, Ionomr Innovations Inc, or other anion exchange polymer electrolyte manufacturers) on cation exchange membrane such as Nafion® membranes (25-254 μm thickness)

Anode:

0.5-3 mg/cm2 IrRuOx or IrOx anode catalyst layer and porous Ti gas diffusion layer In another example, an AEM-only MEA for the production of ethylene can include a GDL, a cathode catalyst layer, an anion-exchange membrane, and an anode catalyst layer as follows:

GDL:

Sigracet 39BC (5% PTFE treated microporous layer on carbon fiber, 0.325 mm-thick)

Catalyst Layer sprayed on GDL:

0.35 mg/cm2 of 100% Sigma Aldrich Cu (80 nm particle size)

19 wt. % anion-exchange polymer electrolyte (FumaTech FAA-3)

2-3 μm thickness

Membrane:

KOH-exchanged Ionomr AF1-HNN8-50-X AEM

50 μm thickness, >80 mS/cm conductivity, 33-37% water uptake

Anode:

IrOx-coated porous Ti (Proton Onsite)

In another example, an AEM-only MEA for the production of ethylene can include a GDL, a cathode catalyst layer, an anion-exchange membrane, and an anode catalyst layer as follows:

GDL:

Single or multiple, stacked 5-20% PTFE-treated microporous layer-coated carbon fiber substrate(s) (SGL Carbon, Freudenberg Performance Materials, AvCarb Material Solutions, or other GDL manufacturer, 0.25-0.5 mm thick)

Catalyst Layer coated on GDL:

0.1-3.0 mg/cm2 of pure Cu nanoparticles or Cu-based alloys (25-100 nm particle size) deposited via ultrasonic spray deposition, e-beam evaporation, magnetron-sputtering, or other analogous coating process 5-50 wt. % anion exchange or cation exchange polymer electrolyte (Fumatech BWT GmbH, Ionomr Innovations Inc, or other anion/cation exchange polymer electrolyte manufacturers)

1-5 μm thickness

Membrane:

KOH-exchanged anion exchange polymer membrane (Fumatech BWT GmbH, Ionomr Innovations Inc, or other anion-exchange polymer membrane manufacturers)

15-75 μm thickness, >60 mS/cm conductivity, 20-100% water uptake

Anode:

IrOx-coated porous Ti

The cathode catalyst layer of the MEA includes a catalyst configured for production of ethylene or other desired product. A catalyst configured for ethylene has a propensity to catalyze one or more methane production reactions preferentially over other reactions. Suitable catalysts include transition metals such as copper (Cu). According to various embodiments, the catalyst may be doped or undoped Cu or an alloy thereof. An MEA cathode catalyst described as containing copper or other transition metal is understood to include alloys, doped metals, and other variants of copper or other transition metals. In general, the catalysts described herein for hydrocarbon and oxygen-containing organic products are non-noble metal catalysts. Gold (Au), for example, may be used to catalyze carbon monoxide (CO) production. The conformation of the catalyst layer may be engineered to achieve a desired methane (or other desired product) production characteristics for the MEA. Conformation characteristics such as thickness, catalyst loading, and catalyst roughness can affect desired product production rate, desired production selectivity (e.g., selectivity of methane over other potential products, such as hydrogen, ethylene, etc.), and/or any other suitable characteristics of carbon dioxide reactor operation.

Examples of cathode catalyst layers for multi-electron products such as ethylene are given above. Further examples and examples of cathode catalyst layers for CO production include:

CO production: Au nanoparticles 4 nm in diameter supported on Vulcan XC72R carbon and mixed with TM1 anion exchange polymer electrolyte from Orion. Layer is about 15 μm thick, Au/(Au+C)=30%, TM1 to catalyst mass ratio of 0.32, mass loading of 1.4-1.6 mg/cm$^2$, estimated porosity of 0.47

Methane production: Cu nanoparticles of 20-30 nm size supported on Vulcan XC72R carbon, mixed with FAA-3 anion exchange solid polymer electrolyte from Fumatech. FAA-3 to catalyst mass ratio of 0.18. Estimated Cu nanoparticle loading of ~7.1 μg/cm$^2$, within a wider range of 1-100 μg/cm$^2$.

Ethylene/ethanol production: Cu nanoparticles of 25-80 nm size, mixed with FAA-3 anion exchange solid polymer electrolyte from Fumatech. FAA-3 to catalyst mass ratio of 0.10. Deposited either on Sigracet 39BC GDE for pure AEM or onto the polymer-electrolyte membrane. Estimated Cu nanoparticle loading of 270 μg/cm$^2$.

Bipolar MEA for methane production: The catalyst ink is made up of 20 nm Cu nanoparticles supported by Vulcan carbon (Premetek 40% Cu/Vulcan XC-72) mixed with FAA-3 anion exchange solid polymer electrolyte (Fumatech), FAA-3 to catalyst mass ratio of 0.18. The cathode is formed by the ultrasonic spray deposition of the catalyst ink onto a bipolar membrane including FAA-3 anion exchange solid polymer electrolyte spray-coated on Nafion (PFSA) 212 (Fuel Cell Etc) membrane. The anode is composed of IrRuOx which is spray-coated onto the opposite side of the bipolar membrane, at a loading of 3 mg/cm$^2$. A porous carbon gas diffusion layer (Sigracet 39BB) is sandwiched to the Cu catalyst-coated bipolar membrane to compose the MEA.

Bipolar MEA for ethylene production: The catalyst ink is made up of pure 80 nm Cu nanoparticles (Sigma Aldrich) mixed with FAA-3 anion exchange solid polymer electrolyte (Fumatech), FAA-3 to catalyst mass ratio of 0.09. The cathode is formed by the ultrasonic spray deposition of the catalyst ink onto a bipolar membrane including FAA-3 anion exchange solid polymer electrolyte spray-coated on Nafion (PFSA) 115 (Fuel Cell Etc) membrane. The anode is composed of IrRuOx which is spray-coated onto the opposite side of the bipolar membrane, at a loading of 3 mg/cm$^2$. A porous carbon gas diffusion layer (Sigracet 39BB) is sandwiched to the Cu catalyst-coated bipolar membrane to compose the MEA.

CO production: Au nanoparticles 4 nm in diameter supported on Vulcan XC72R carbon and mixed with TM1 anion exchange polymer electrolyte from Orion. Layer is about 14 micron thick, Au/(Au+C)=20%. TM1 to catalyst mass ratio of 0.32, mass loading of 1.4-1.6 mg/cm$^2$, estimated porosity of 0.54 in the catalyst layer.

CO production: Au nanoparticles 45 nm in diameter supported on Vulcan XC72R carbon and mixed with TM1 anion exchange polymer electrolyte from Orion. Layer is about 11 micron thick, Au/(Au+C)=60%. TM1 to catalyst mass ratio of 0.16, mass loading of 1.1-1.5 mg/cm$^2$, estimated porosity of 0.41 in the catalyst layer.

CO production: Au nanoparticles 4 nm in diameter supported on Vulcan XC72R carbon and mixed with TM1 anion exchange polymer electrolyte from Orion. Layer is about 25 micron thick, Au/(Au+C)=20%. TM1 to catalyst mass ratio of 0.32, mass loading of 1.4-1.6 mg/cm$^2$, estimated porosity of 0.54 in the catalyst layer.

The above MEAs examples may be implemented in the $CO_x$ reduction electrolyzers described below that are configured to increase concentration of a desired product in a product stream. First, in FIG. 1, an system with electrochemical cell and a recycle loop is shown. In the example of FIG. 1, the cell is configured to produce ethylene. The input of the cell includes a combination of the output from the previous pass and fresh $CO_2$. This system uses a lower $CO_2$ input flow than for a single-pass system, since a fraction of the reactant is gas that has been recycled through the system. The output is a mixture of ethylene, CO and $H_2$, as well as unreacted $CO_2$. $CO_2$ concentration is lower than that compared to a single-pass system, with the ratio of products:$CO_2$ dependent upon how much of the gas is recycled.

A recycling blower or other compressor may be used to help regulate the flow of gas into the system, and to compensate for pressure drop across the reactor. In the example of FIG. 1, the unreacted $CO_2$ is not separated from the output stream for recycle. As described above, the formation of ethylene uses a relatively small amount of input $CO_2$. Notably, the recycling of ethylene and other products along with unreacted $CO_2$ can help increase flow rate while limiting the amount of $CO_2$ input into the cell. Ethylene pressure in the recycle stream can help with maintaining a minimum flow rate to regulate water, pH, and other environmental conditions.

For 100 cm$^2$ cells, flow rates of at least 300 sccm, at least 450 sccm, or at least 700 sccm, with a maximum flow rate of 6000 sccm, through the cell may be used to maintain selectivity for ethylene. The ratio of new $CO_2$ to recycled gas depends upon the rate of the blower.

In the example of FIG. 1 (and FIGS. 2 and 3*a* discussed below), $CO_2$ is shown as the starting reactant. In other embodiments, CO or a mixture of CO and $CO_2$ may be used as the starting reactant. Also, in other embodiments the electrolyzer may be configured to produce another gas phase multielectron product such as methane, ethane, propane, or propylene. Further, in some embodiments, a recycle loop as described with respect to FIG. 1 may be implemented for CO production. In embodiments in which $CO_2$ is the starting reactant, the MEA may have a bipolar membrane or a cation exchange membrane to allow for recycle of $CO_2$ in the product stream. As discussed further below, $CO_2$ in electrolyzers with AEM-only MEAs is transported to the anode-side of the electrolyzer.

In some embodiments, a system may include a purification system downstream of the recycle loop to remove the remaining $CO_2$ and $H_2$ in the product stream. Purification systems are described in U.S. Provisional patent application Ser. No. 17/444,356, incorporated by reference herein. Ethylene purification systems are described further below.

In some embodiments, the unreacted $CO_2$ may be first separated from the product stream prior to recycling.

Figure 2:
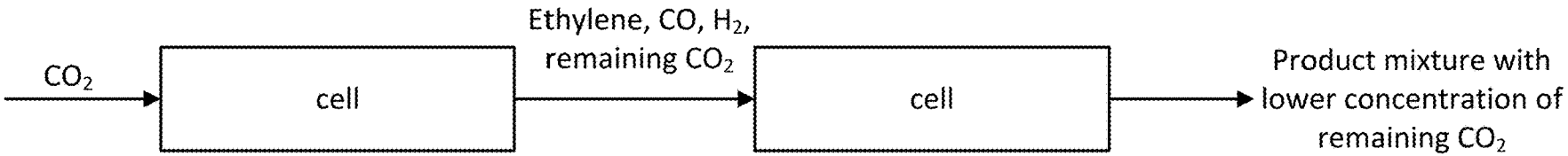
FIG. 2 shows an example of a system including multiple electrochemical cells in series according to certain embodiments.

In some embodiments, a direct air capture unit is provided upstream of the cell in FIG. 1 to supply $CO_2$ to the cell. Systems including direct air capture units are described further below with reference to FIG. 8. FIG. 2 shows another configuration in which multiple electrochemical cells in series are used to increase product concentration. In the example of FIG. 2, two cells are shown, however, three, four, or more cells may be used in series. By feeding the output of a first electrochemical cell as the inlet to a second, third . . . nth cell, the concentration of $CO_2$ will decrease, and concentration of products increase with each consecutive cell. The product concentration after the second cell in the series may be roughly estimated by taking the $CO_2$ from the output of the first cell and using the current efficiency to determine the conversion. The output of two cells in series will have twice the product concentration as after the first cell and so on for additional cells in series.

Comparative Example 1 shows total $CO_2$ utilization and output gas stream composition for two cells as in Example 1 in series. Table 4 compares the $CO_2$ utilization and output gas stream composition of Example 1 with Comparative Example 1.

TABLE 4

Single $CO_2$ cell compared with two $CO_2$ cells in series for CH4 production

| | Example 1: single cell $CH_4$ production | Comparative Example 1 - cells in series $CH_4$ production |
|---|---|---|
| Input $CO_2$ flow into cell 1 | 450 sccm | 450 sccm |
| Input $CO_2$ flow into cell 2 | NA | 492 sccm |
| Current efficiency cell 1 | 90% for $CH_4$<br>10% for $H_2$ | 90% for $CH_4$<br>10% for $H_2$ |
| Current efficiency cell 2 | NA | 90% for $CH_4$<br>10% for $H_2$ |
| Total $CO_2$ utilization | 21% | 42% |
| Output gas stream | 72.3% $CO_2$<br>19.2% $CH_4$<br>8.5% $H_2$ | 48.9% $CO_2$<br>35.4% $CH_4$<br>15.7% $H_2$ |
| Output gas flow rate | 492 sccm | 534 sccm |

Putting cells from Example 1 above in series results in a first cell of 100 $cm^2$ at 600 $mA/cm^2$ with $CO_2$ utilization of 21%, and an output gas stream composition of 19.2% methane, 8.5% $H_2$, and 72.3% $CO_2$ with a total flow rate of 492 sccm. The output of this first cell is then fed to a second cell also of 100 $cm^2$ area with 90% current efficiency for methane and 10% current efficiency for $H_2$ which results in a product stream from the second cell of 534 sccm total flow composed of 35.4% methane, 15.7% $H_2$, and 48.9% $CO_2$. The combined $CO_2$ utilization of both cells together is 42%. Additional cells in series further increases the concentration of methane and $H_2$ and decreases the concentration of $CO_2$, within the limit that $CO_2$ concentration does not go below zero, at which point the methane current efficiency will also drop to zero and the $H_2$ current efficiency will rise to 100%.

Putting cells from Example 3 above in series has a similar effect as shown in Table 5.

TABLE 5

Single $CO_2$ cell compared with $CO_2$ cells in series for $CH_2CH_2$ production

| | Example 3: single cell $CH_2CH_2$ production | Comparative Example 2 - cells in series $CH_2CH_2$ production |
|---|---|---|
| Input $CO_2$ flow into cell 1 | 450 sccm | 450 sccm |
| Input $CO_2$ flow into cell 2 | NA | 429 sccm |
| Current efficiency cell 1 | 90% for $CH_2CH_2$<br>10% for $H_2$ | 90% for $CH_2CH_2$<br>10% for $H_2$ |
| Current efficiency cell 2 | NA | 90% for $CH_2CH_2$<br>10% for $H_2$ |
| Total $CO_2$ utilization | 28% | 56% |
| Output gas stream | 78.7% $CO_2$<br>12.8% $CH_2CH_2$<br>8.5% $H_2$ | 48.6% $CO_2$<br>30.9% $CH_2CH_2$<br>20.6% $H_2$ |
| Output gas flow rate | 429 sccm | 408 sccm |

With multiple cells in series, the initial $CO_x$ flow rate is high to help with water management, with the multiple cells used to convert much of the $CO_x$. The examples show how the total gas flow rate can change (increase or decrease) between cells. If the total gas flow rate decreases below a critical level needed to prevent flooding, then additional gas can be added to the stream between cells to bring the total above the desired level. This additional gas could come from recycling the output of the system (as described with respect to FIG. 1) or it could be introduced from another source and could be comprised of $CO_2$, ethylene, $H_2$, etc. For implementations in which the gas flow increases between cells, in some embodiments, part of the gas stream may bypass downstream cells to maintain flow in the desired range.

According to various embodiments, between 300 sccm and 6000 sccm flow through a 100 $cm^2$ cell can be useful to maintain selectivity for ethylene and other many electron $CO_2$ reduction products (e.g. methane). In some embodiments, this may be between 450 sccm and 6000 sccm or 700 sccm and 6000 sccm. A flow rate of 3-60 $sccm/cm^2$, or 4.5-60 $sccm/cm^2$, or 7-60 $sccm/cm^2$ may be used for other sized cells.

In addition to flow rate adjustments, pressure and water content of the gas stream may be changed between cells. Water can be added to the stream with a humidifier or removed through phase separators, cooling the gas stream, and/or adsorbents. Pressure can be increased by a compressor between cells. In some embodiments, multiple cells in series are provided in a compact stack of cells as described below with respect to FIG. 3*b*.

In other embodiments, CO may be used as the starting reactant and/or the electrolyzer may be configured to produce another gas phase multielectron product such as methane, ethane, propane, or propylene. Further, in some embodiments, multiple cells in series may be used to concentrate CO as the desired product.

Figure 3A:
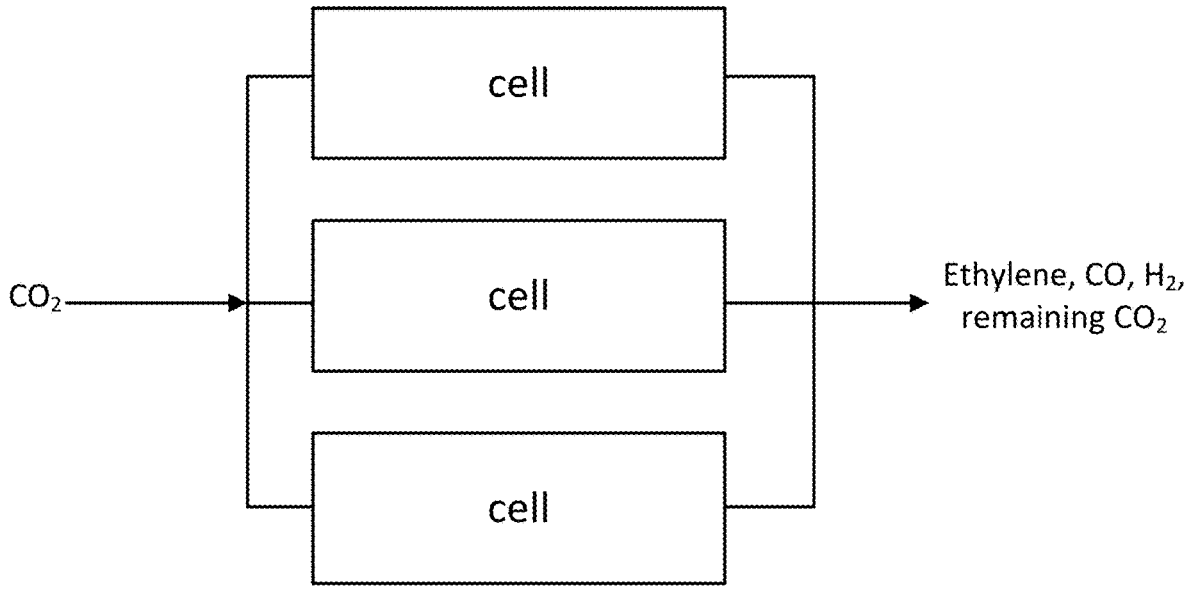
FIG. 3*a* shows an example of a system including multiple electrochemical cells stacked in parallel with a single $CO_2$ flow stream shared between the cells according to certain embodiments.

Any of the cells described herein may be one of a stack of cells. FIG. 3*a* shows multiple electrochemical cells stacked in parallel with a single $CO_2$ flow stream shared between the cells. This allows more efficient scale-up of the amount of product generated. The final concentration of ethylene is the same as for a single-pass cell, but the total volume of ethylene generated is increased with the addition of each cell. A recycle loop as described with respect to FIG. 1 could be implemented for individual cells in a stack and/or between stacks of cells.

Figure 3B:
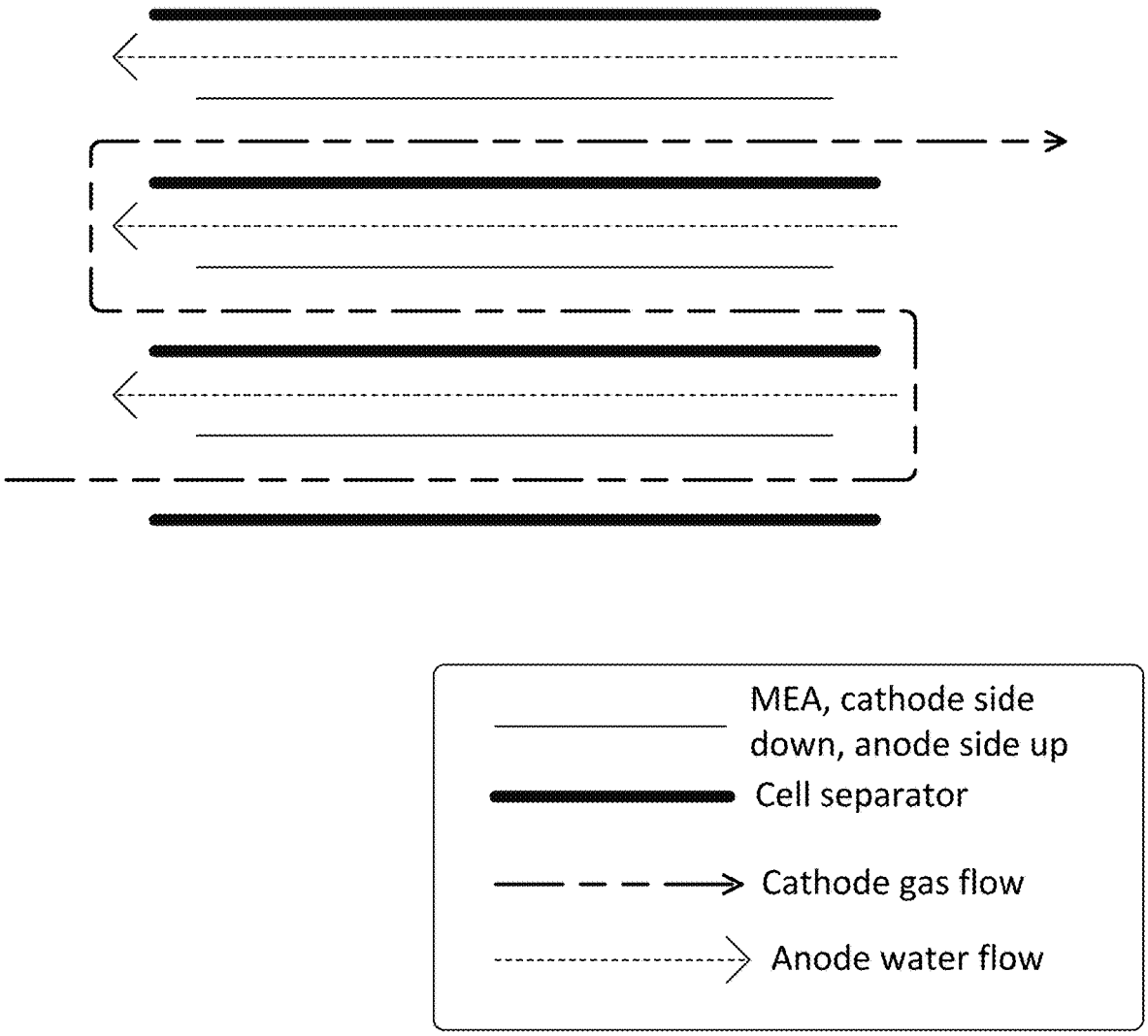
FIG. 3*b* shows an example of a system including multiple electrochemical cells arranged in a stacked and connected in series according to certain embodiments.

FIG. 3*b* shows multiple electrochemical cells arranged in a stacked and connected in series as described above with respect to FIG. 2. An MEA may be placed in the stack with the anode up and the cathode down (as in FIG. 3*b*) or the anode down and the cathode up, or in a vertical configuration.

An arrangement as in FIG. 3*b* can be used to achieve high CO or $CO_2$ utilization while maintaining a high gas flow rate through the cell to efficiently remove water. The design is more compact than unstacked cells connected in series and the balance of plant, such as power electronics flow controllers, temperature controllers, pressure controllers, etc. is simplified by only having one cell stack instead of multiple separate cells that each use their own controller. In the example of FIG. 3*b*, a 3-cell stack is shown. Stacks may have ones, tens, or hundreds of cells, according to various embodiments. In some embodiments, a whole stack is in series. In other embodiments, subsets of cells are in series and connected to other subsets in parallel. For example, in a 100 cell stack, the input cathode gas flow could run in series through every 10, 5, 3, or 2 cells and each block of cells plumbed in series put in parallel.

Figure 4:
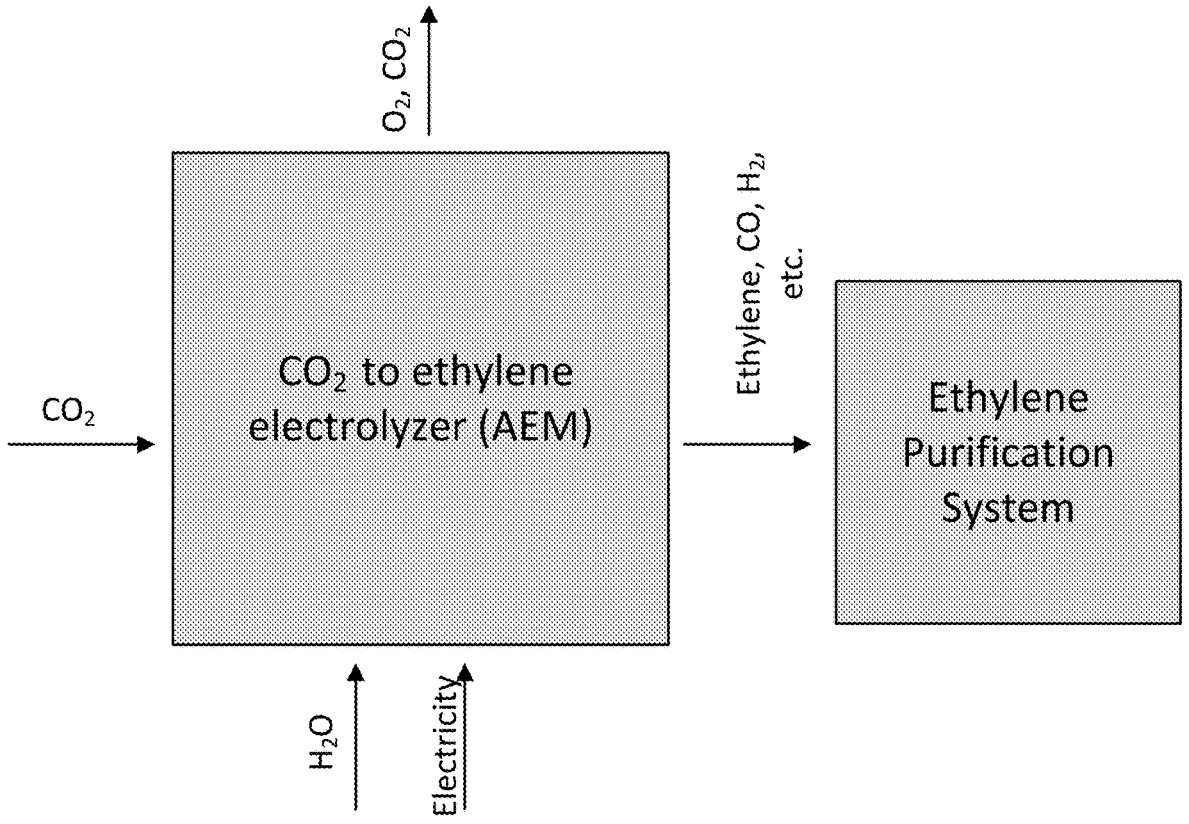
FIG. 4 shows an example of a system including a single stage $CO_2$ reduction electrolyzer with an AEM-only MEA according to certain embodiments.

In some embodiments, a carbon oxide reduction electrolyzer includes an MEA with only an anion exchange membrane (AEM). The AEM-only MEA can be used to remove $CO_2$ from the product gas stream to achieve a higher concentration of the desired product in the electrolyzer output. $CO_2$ reacts with hydroxide generated in the $CO_x$ reduction reaction to make bicarbonate. Bicarbonate is then transported through the anion-exchange membrane from the cathode to the anode side. This results in less $CO_2$ in the cathode output and higher concentration of $CO_x$ reduction products such as methane and ethylene. In some embodiments, the cathode output may have substantially no $CO_2$. The amount of $CO_2$ can depend on the initial starting $CO_2$. According to various embodiments, the cathode output may be less than 5 mole %, less than 1 mole %, or less than 0.1 mole %. FIG. 4 shows an example of a single stage $CO_2$ reduction electrolyzer with an AEM-only MEA. As can be seen, on the anode-side, $CO_2$ is mixed with $O_2$. The product stream includes ethylene, $H_2$, and CO.

In the example of FIG. 4, water is fed to the anode of an electrolyzer and is oxidized to oxygen. $H_2$ may be an anode-side feedstock in some embodiments. In some embodiments, carbon-containing anode feedstocks are used. These may be especially advantageous when performing $CO_2$ reduction in an AEM based electrolyzer. A liquid or gas feedstock containing carbon compounds is fed to the anode. The carbon compound is oxidized to make $CO_2$ resulting a stream of pure $CO_2$ coming from the anode of the AEM electrolyzer. According to various embodiments, the $CO_2$ may then be fed back into the cathode of the $CO_x$ electrolyzer, used in other applications, or sequestered. Examples of anode feedstocks are biogas, natural gas, $CO_2$ separated from biogas that contains trace methane and/or other hydrocarbons, municipal wastewater, alcohol or aqueous alcohol solutions, steam methane reforming waste streams, carbon monoxide, etc.

In embodiments in which water is used to feed the anode of the electrolyzer and oxidized to oxygen gas as shown in FIG. 4, the anode-side gas phase output stream of the electrolyzer contains oxygen and $CO_2$. In some embodiments, a gas separator can be used to separate the $CO_2$ and 02 with the $CO_2$ stream recycled back to the inlet of the electrolyzer to be reduced.

In a specific example, in a 100 $cm^2$ electrochemical cell at 600 $mA/cm^2$ with 90% current efficiency for ethylene and 10% current efficiency for $H_2$ at the input flow rate of 450 sccm, the cathode output stream has a flow rate of 104 sccm and contains approximately 60% ethylene and 40% hydrogen with only trace $CO_2$, with most of the unreacted $CO_2$ traveling to the anode side of the device.

In some embodiments, input flow rates of up to 900 sccm for a 100 $cm^2$ electrolyzer may be used without appreciable concentrations of $CO_2$ appearing in the cathode gas product stream. With an input flow rate of 910 sccm, the output stream contains 56% ethylene, 37.3% $H_2$, and 6.7% $CO_2$ and has a total flow rate of 113 sccm.

In the example of FIG. 4, the output stream is fed to an ethylene purification system. Ethylene purification systems are described further below.

In other embodiments, the electrolyzer may be configured to produce another gas phase multielectron product such as methane, ethane, propane, or propylene. Further, in some embodiments, an AEM-only MEA may be implemented for CO production.

Figure 5:
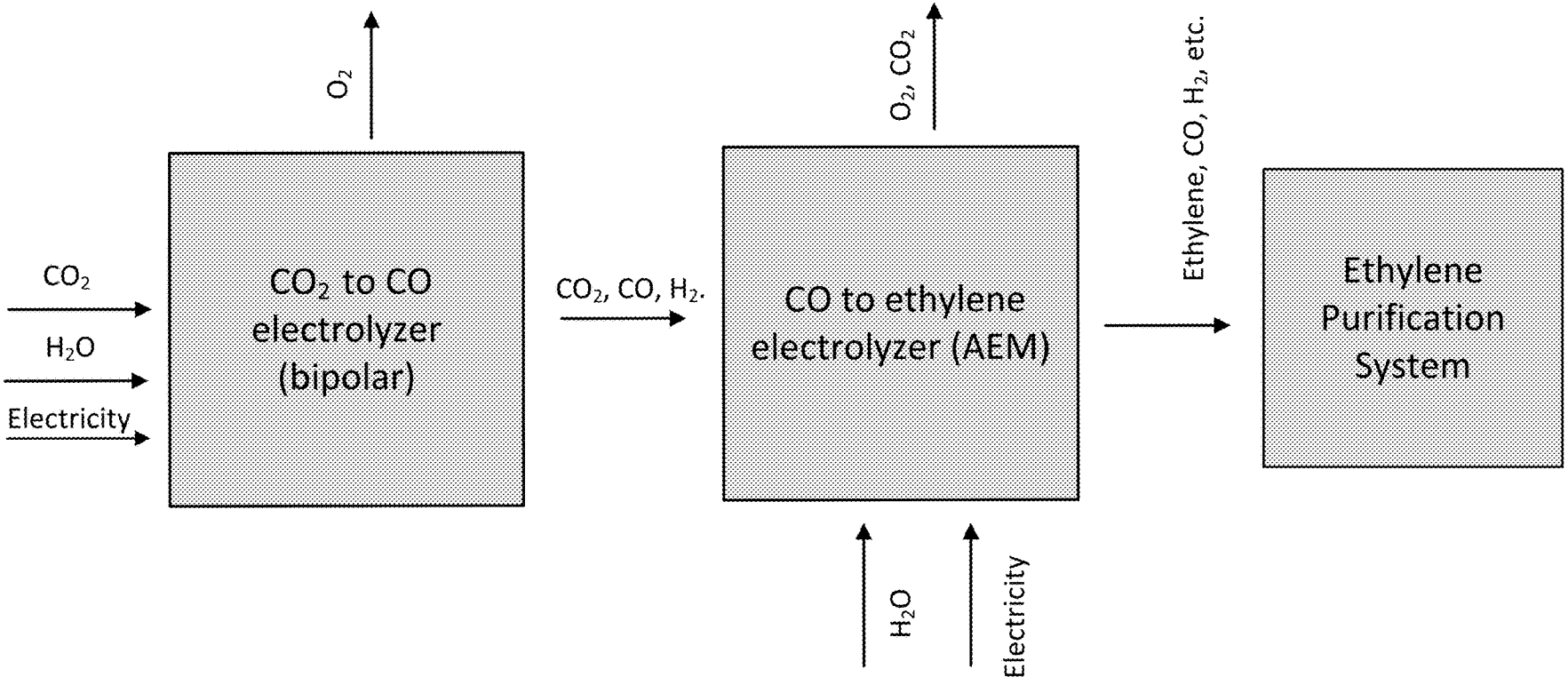
FIG. 5 shows an example of a system including a two-stage $CO_2$ reduction electrolyzer including an AEM-only MEA according to certain embodiments.

In some embodiments, two electrolyzers in series are configured differently to achieve a high concentration of product in the outlet stream. This may also result in performance improvements of the combined system over a single device. FIG. 5 shows another embodiment in which the AEM-only membrane is implemented in a such a two-stage system. In the example of FIG. 5, a first $CO_2$ electrolyzer may contain a bipolar or cation conducting membrane and be configured for CO production. An input of $CO_2$ to the cathode is reduced to CO. The reactor output then contains CO, a small amount of byproduct $H_2$, and unreacted $CO_2$. This output of the first electrolyzer is then fed to a second electrolyzer configured to produce ethylene and/or other many electron product(s) (e.g. methane, ethylene, etc.) and containing an AEM membrane. In the second electrolyzer, the CO and/or $CO_2$ is reduced to a many electron product and $CO_2$ in the form of carbonate or bicarbonate moves across the AEM membrane to the anode. The anode output contains the oxidation product and $CO_2$ that originally came from the cathode. The cathode output contains ethylene and/or other many electron product(s), hydrogen, and unreacted CO and $CO_2$. The $CO_2$ concentration may be very low or no $CO_2$ may be left in the stream because all or a large part of the $CO_2$ has been transported to the anode.

In a specific example, the first electrolyzer is a 75 $cm^2$ single cell configured for $CO_2$ to CO reduction using a bipolar membrane-based MEA. The input flow rate is 1500 sccm, the CO current efficiency is greater than 95% and the $H_2$ current efficiency is less than 5%. The output flow total is approximately 1515 sccm with a composition of approximately 15% CO, 1% $H_2$, and 84% $CO_2$. The output from the first electrolyzer is fed to a second electrolyzer configured for ethylene production containing an AEM based MEA. The second electrolyzer is 100 $cm^2$ and operating at 600 $mA/cm^2$ with a current efficiency of 90% ethylene and 10% $H_2$. The cathode outlet stream from the second electrolyzer contains 15.6% ethylene, 6.3% CO, 6.9% $H_2$, and 71.2% $CO_2$ and a total flow of 606 sccm total.

The reduction of CO is often kinetically easier than the reduction of other $CO_x$ species, so the second electrolyzer, which takes a combined CO and $CO_2$ feedstock, may operate at a lower voltage compared to the case where it is fed $CO_2$, carbonate and/or bicarbonate.

Between the first and second electrolyzer, additional gas may be added or removed from the stream and may be part of recycle loops going to and from other parts of the electrolyzer. Water may be removed or added to the gas stream via humidification, phase separation, or dehumidification. The pressure of the gas stream may be adjusted up or down using compressors or back flow regulators.

A two-stage system as described in FIG. 5 may also be used for CO production, with the AEM-only MEA configured for CO production rather than ethylene or other many electron product. In such embodiments, the first (bipolar) electrolyzer an output of product CO, unreacted $CO_2$, and byproduct $H_2$. This may all be fed to the second (AEM) electrolyzer, which will make CO and $H_2$. According to various embodiments, the output of the second electrolyzer may have more $H_2$ than CO or more CO than $H_2$. $CO_2$ will be removed from the stream in the AEM electrolyzer, so the product output will be $CO+H_2$, with most of the $CO_2$ removed.

According to various embodiments, the output of the second electrolyzer may be less than 30%, less than 5%, less than 1%, or less than 0.1% by mole $CO_2$. In the example of FIG. 5, the output stream is fed to an ethylene purification system. Ethylene purification systems are described further below.

Figure 6:
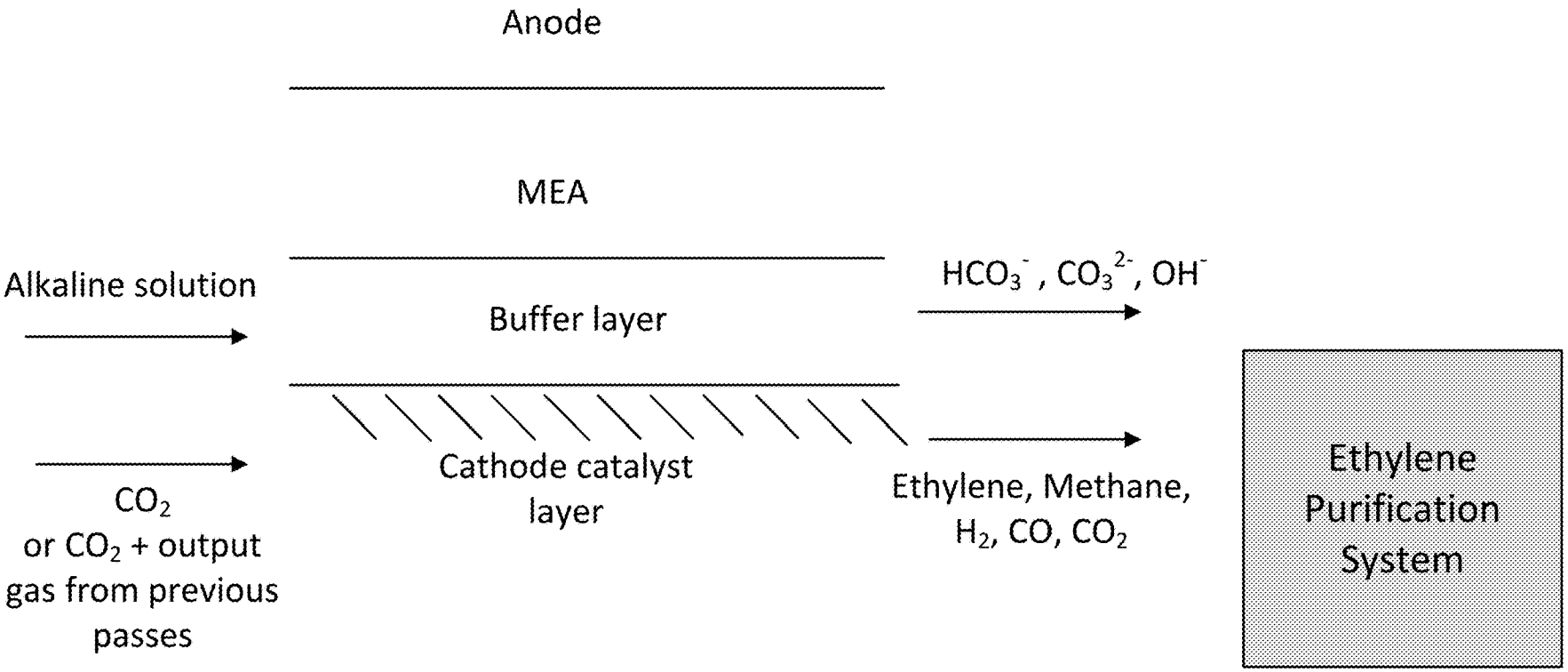
FIG. 6 shows an example of system including an electrolyzer that includes a buffer layer of an aqueous alkaline solution provided between the membrane and the cathode according to certain embodiments.

FIG. 6 shows an example of an electrolyzer that includes a buffer layer of an aqueous alkaline solution provided between the membrane and the cathode. Examples of solutions include KOH, NaOH, $NaHCO_3$, and $KHCO_3$ solutions. Cesium-containing solutions may also be used. The buffer layer removes $CO_2$ from the product gas stream and mitigates $H_2$ production by providing an alkaline environment to decrease proton activity. $CO_2$ reacts with $OH^-$ in the buffer layer to make bicarbonate. Bicarbonate is then transported through the anion-exchange membrane from the cathode to the anode side or transported out of the cathode side by flowing the liquid in the buffer layer. This results in less $CO_2$ in the cathode output. The buffer layer also helps to maintain high pH at the cathode and suppress $H_2$ production. Since $H_2$ is the product of a 2-electron process, the suppression of $H_2$ production will lead to the increase of $CO_x$ reduction products (e.g., methane, ethylene). In some embodiments, AEM-only MEAs or bipolar membrane MEAs are used. In the example of FIG. 6, the output is fed to an ethylene purification system, described further below.

A cell including a liquid buffer as described above can be set up as a single cell or multiple cells with a single pass or multiple passes as described above with respect to FIGS. 1-3*b*. The gaseous input of the electrochemical cell includes pure $CO_2$ for a single pass or a combination of the output from the previous pass and fresh $CO_2$ for multiple passes. As described above, a multiple pass system uses a lower $CO_2$ input flow than for a single-pass system, since a fraction of the reactant is gas that has been recycled through the system.

The cathode liquid input includes the alkaline solution, which can be in a single pass or circulated from the outlet of the buffer layer if there is enough $OH^-$ available to capture $CO_2$. The gaseous output includes a mixture of $CO_x$ reduction products, as well as a lower concentration of $CO_2$ and $H_2$ compared to a system without the alkaline buffer layer, with the ratio of products:$CO_2$ dependent upon the concentration of alkaline species in the buffer layer and the gas flow rate in the gas stream. The liquid output includes $CO_3^{2-}$, $HCO_3$ that are formed by the reaction of $CO_2$ and $OH^-$, as well as extra $OH^-$ that is not reacted.

System

Figure 7:
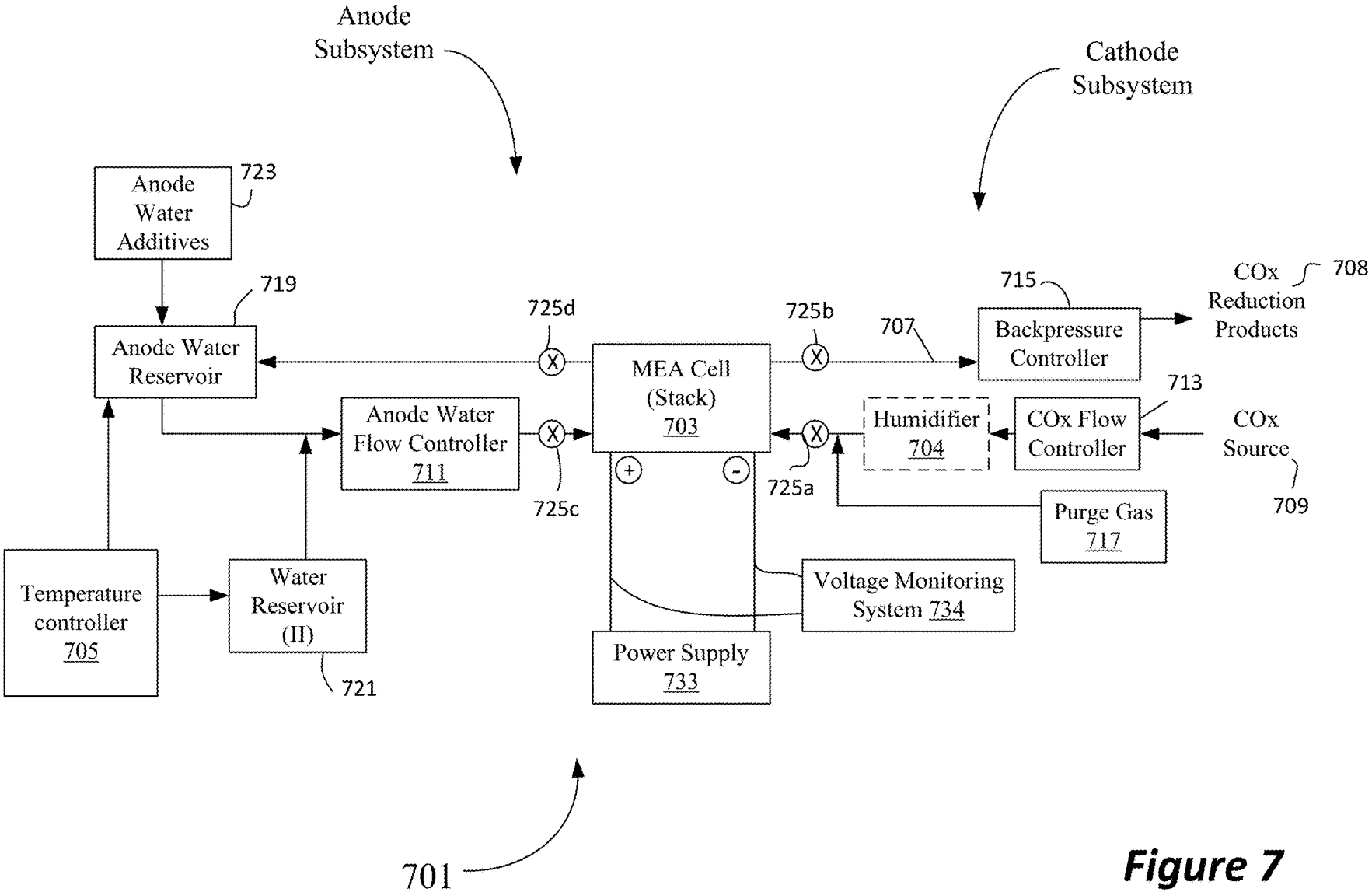
FIG. 7 shows an example of a system for controlling the operation of a carbon oxide reduction reactor according to certain embodiments.

FIG. 7 depicts a system 701 for controlling the operation of a carbon oxide reduction reactor 703 that may include a cell including a MEA such as any one or more of those described herein with respect to FIGS. 1-6. The reactor may contain multiple cells or MEAs arranged in a stack. System 701 includes an anode subsystem that interfaces with an anode of reduction reactor 703 and a cathode subsystem that interfaces with a cathode of reduction reactor 703.

As depicted, the cathode subsystem includes a carbon oxide source 709 configured to provide a feed stream of carbon oxide to the cathode of reduction reactor 703, which, during operation, may generate an output stream that includes product(s) of a reduction reaction at the cathode. The product stream may also include unreacted carbon oxide and/or hydrogen. See 708.

The carbon oxide source 709 is coupled to a carbon oxide flow controller 713 configured to control the volumetric or mass flow rate of carbon oxide to reduction reactor 703. One or more other components may be disposed on a flow path from flow carbon oxide source 709 to the cathode of reduction reactor 703. For example, an optional humidifier 704 may be provided on the path and configured to humidify the carbon oxide feed stream. Humidified carbon oxide may moisten one or more polymer layers of an MEA and thereby avoid drying such layers. Another component that may be disposed on the flow path is a purge gas inlet coupled to a purge gas source 717. In certain embodiments, purge gas source 717 is configured to provide purge gas during periods when current is paused to the cell(s) of reduction reactor 703. In some implementations, flowing a purge gas over an MEA cathode facilitates recovery of catalyst activity and/or selectivity. This may be due, at least in part, to flushing certain reaction intermediates off catalyst active sites and/or remove water from the cathode. Examples of purge gases include carbon dioxide, carbon monoxide, hydrogen, nitrogen, argon, helium, oxygen, and mixtures of any two or more of these.

During operation, the output stream from the cathode flows via a conduit 707 that connects to a backpressure controller 715 configured to maintain pressure at the cathode side of the cell within a defined range (e.g., about 10 to 800 psig or 50 to 800 psig, depending on the system configuration). The output stream may provide the reaction products 108 to one or more components (not shown) for separation and/or concentration.

In certain embodiments, the cathode subsystem is configured to controllably recycle unreacted carbon oxide from the outlet stream back to the cathode of reduction reactor 703. In some implementations, the output stream is processed to remove reduction product(s) and/or hydrogen before recycling the carbon oxide. Depending upon the MEA configuration and operating parameters, the reduction product(s) may be carbon monoxide, hydrogen, hydrocarbons such as methane and/or ethylene, oxygen-containing organic compounds such as formic acid, acetic acid, and any combinations thereof. In certain embodiments, one or more components, not shown, for removing water from the product stream are disposed downstream form the cathode outlet. Examples of such components include a phase separator configured to remove liquid water from the product gas stream and/or a condenser configured to cool the product stream gas and thereby provide a dry gas to, e.g., a downstream process when needed. In some implementations, recycled carbon oxide may mix with fresh carbon oxide from source 709 upstream of the cathode.

As depicted in FIG. 7, an anode subsystem is configured to provide an anode feed stream to an anode side of the carbon oxide reduction reactor 703. In certain embodiments, the anode subsystem includes an anode water source, not shown, configured to provide fresh anode water to a recirculation loop that includes an anode water reservoir 719 and an anode water flow controller 711. The anode water flow controller 711 is configured to control the flow rate of anode water to or from the anode of reduction reactor 703. In the depicted embodiment, the anode water recirculation loop is coupled to components for adjusting the composition of the anode water. These may include a water reservoir 721 and/or an anode water additives source 723. Water reservoir 721 is configured to supply water having a composition that is different from that in anode water reservoir 719 (and circulating in the anode water recirculation loop). In one example, the water in water reservoir 721 is pure water that can dilute solutes or other components in the circulating anode water. Pure water may be conventional deionized water even ultrapure water having a resistivity of, e.g., at least about 15 MOhm-cm or over 18.0 MOhm-cm. Anode water additives source 723 is configured to supply solutes such as salts and/or other components to the circulating anode water.

During operation, the anode subsystem may provide water or other reactant to the anode of reactor 703, where it at least partially reacts to produce an oxidation product such as oxygen. The product along with unreacted anode feed material is provided in a reduction reactor outlet stream. Not shown in FIG. 7 is an optional separation component that may be provided on the path of the anode outlet stream and configured to concentrate or separate the oxidation product from the anode product stream.

Other control features may be included in system 701. For example, a temperature controller may be configured to heat and/or cool the carbon oxide reduction reactor 703 at appropriate points during its operation. In the depicted embodiment, a temperature controller 705 is configured to heat and/or cool anode water provided to the anode water recirculation loop. For example, the temperature controller 705 may include or be coupled to a heater and/or cooler that may heat or cool water in anode water reservoir 719 and/or water in reservoir 721. In some embodiments, system 701 includes a temperature controller configured to directly heat and/or cool a component other than an anode water component. Examples of such other components in the cell or stack and the carbon oxide flowing to the cathode.

Depending upon the phase of the electrochemical operation, including whether current is paused to carbon oxide reduction reactor 703, certain components of system 701 may operate to control non-electrical operations. For example, system 701 may be configured to adjust the flow rate of carbon oxide to the cathode and/or the flow rate of anode feed material to the anode of reactor 703. Components that may be controlled for this purpose may include carbon oxide flow controller 713 and anode water controller 711.

In addition, depending upon the phase of the electrochemical operation including whether current is paused, certain components of system 701 may operate to control the composition of the carbon oxide feed stream and/or the anode feed stream. For example, water reservoir 721 and/or anode water additives source 723 may be controlled to adjust the composition of the anode feed stream. In some cases, additives source 723 may be configured to adjust the concentration of one or more solutes such as one or more salts in an aqueous anode feed stream.

In some cases, a temperature controller such controller 705 is configured to adjust the temperature of one or more components of system 701 based on a phase of operation. For example, the temperature of cell 703 may be increased or decreased during break-in, a current pause in normal operation, and/or storage.

In some embodiments, a carbon oxide electrolytic reduction system is configured to facilitate removal of a reduction cell from other system components. This may be useful with the cell needs to be removed for storage, maintenance, refurbishment, etc. In the depicted embodiments, isolation valves 725*a* and 725*b* are configured to block fluidic communication of cell 703 to a source of carbon oxide to the cathode and backpressure controller 715, respectively. Additionally, isolation valves 725*c* and 725*d* are configured to block fluidic communication of cell 703 to anode water inlet and outlet, respectively.

The carbon oxide reduction reactor 703 may also operate under the control of one or more electrical power sources and associated controllers. See, block 733. Electrical power source and controller 733 may be programmed or otherwise configured to control current supplied to and/or to control voltage applied to the electrodes in reduction reactor 703. The current and/or voltage may be controlled to apply a current at a desired current density. A system operator or other responsible individual may act in conjunction with electrical power source and controller 133 to fully define profiles of current applied to reduction reactor 103.

In certain embodiments, the electrical power source and controller acts in concert with one or more other controllers or control mechanisms associated with other components of system 701. For example, electrical power source and controller 733 may act in concert with controllers for controlling the delivery of carbon oxide to the cathode, the delivery of anode water to the anode, the addition of pure water or additives to the anode water, and any combination of these features. In some implementations, one or more controllers are configured to control or operate in concert to control any combination of the following functions: applying current and/or voltage to reduction cell 703, controlling backpressure (e.g., via backpressure controller 115), supplying purge gas (e.g., using purge gas component 717), delivering carbon oxide (e.g., via carbon oxide flow controller 713), humidifying carbon oxide in a cathode feed stream (e.g., via humidifier 704), flow of anode water to and/or from the anode (e.g., via anode water flow controller 711), and anode water composition (e.g., via anode water source 105, pure water reservoir 721, and/or anode water additives component 723).

In the depicted embodiment, a voltage monitoring system 734 is employed to determine the voltage across an anode and cathode of an MEA cell or across any two electrodes of a cell stack, e.g., determining the voltage across all cells in a multi-cell stack.

Figure 9:
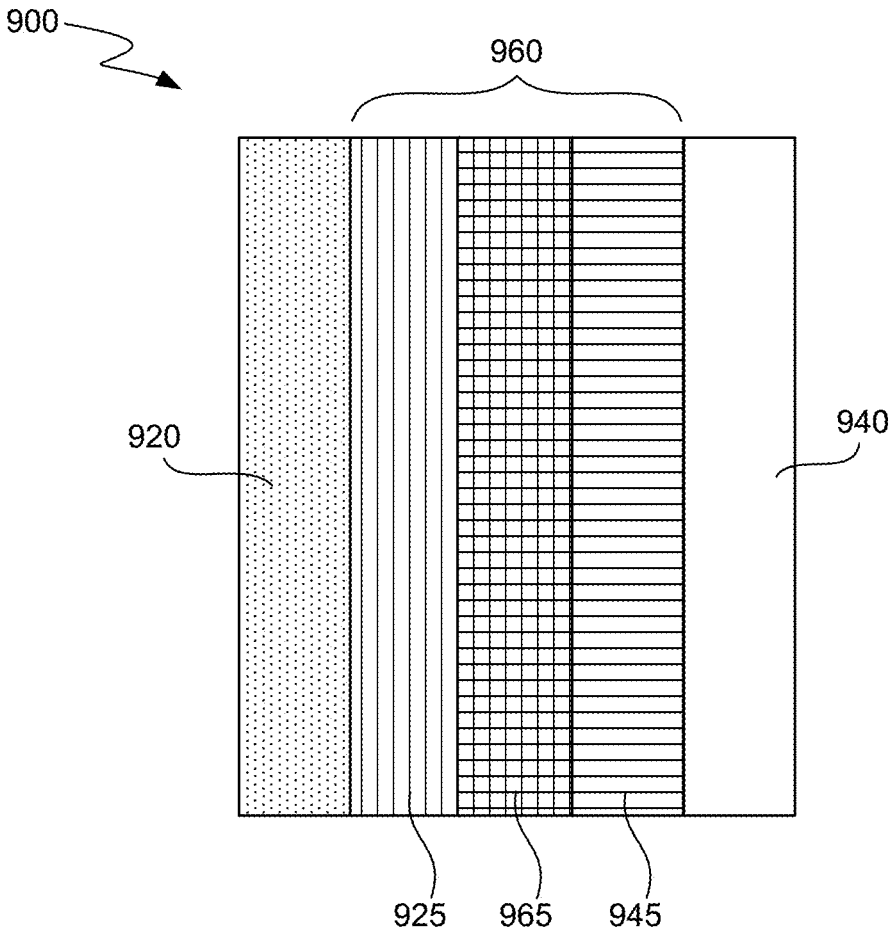
FIG. 9 shows an example of a MEA for use in $CO_x$ reduction according to various embodiments.

An electrolytic carbon oxide reduction system such as that depicted in FIG. 9 may employ a control system that includes one or more controllers and one or more controllable components such as pumps, sensors, dispensers, valves, and power supplies. Examples of sensors include pressure sensors, temperature sensors, flow sensors, conductivity sensors, voltmeters, ammeters, electrolyte composition sensors including electrochemical instrumentation, chromatography systems, optical sensors such as absorbance measuring tools, and the like. Such sensors may be coupled to inlets and/or outlets of an MEA cell (e.g., in a flow field), in a reservoir for holding anode water, pure water, salt solution, etc., and/or other components of an electrolytic carbon oxide reduction system.

Among the various functions that may be controlled by one or more controllers are: applying current and/or voltage to a carbon oxide reduction cell, controlling backpressure on an outlet from a cathode on such cell, supplying purge gas to a cathode inlet, delivering carbon oxide to the cathode inlet, humidifying carbon oxide in a cathode feed stream, flowing anode water to and/or from the anode, and controller anode feed composition. Any one or more of these functions may have a dedicated controller for controlling its function alone. Any two or more of these functions may share a controller. In some embodiments, a hierarchy of controllers is employed, with at least one master controller providing instructions to two or more component controllers. For example, a system may comprise a master controller configured to provide high level control instructions to (i) a power supply to a carbon oxide reduction cell, (ii) a cathode feed stream flow controller, and (iii) an anode feed stream flow controller. For example, a programmable logic controller (PLC) may be used to control individual components of the system.

In certain embodiments, a control system is configured to apply current to a carbon oxide reduction cell comprising an MEA in accordance with a set current as described herein. In certain embodiments, a control system is configured to control the flow rate of one or more feed streams (e.g., a cathode feed stream such as a carbon oxide flow and an anode feed stream) in concert with a current schedule. In some embodiments, current and/or voltage may be regulated to be regularly paused as described in U.S. patent application Ser. No. 16/719,359, filed on Dec. 18, 2019, and incorporated by reference herein for all purposes.

In certain embodiments, a control system may maintain salt concentration at defined levels and/or recover and recirculate anode water. In certain embodiments, the salt concentration is adjusted in concert with a schedule of applied current pauses to an MEA cell. Under control of the control system, the system may, for example, (a) recirculate anode water flowing out of an anode, (b) adjust the composition and/or flow rate of anode water into the anode, (c) move water from cathode outflow back to anode water, and/or (d) adjust the composition and/or flow rate of water recovered from the cathode stream, before returning to the anode. Note that the (d) may account for carbon oxide reduction products in recovered water from the cathode. However, in some implementations, this need not be considered as some reduction products may subsequently oxidize to harmless products at the anode.

A controller may include any number of processors and/or memory devices. The controller may contain control logic such software or firmware and/or may execute instructions provided from another source. A controller may be integrated with electronics for controlling operation the electrolytic cell before, during, and after reducing a carbon oxide. The controller may control various components or subparts of one or multiple electrolytic carbon oxide reduction systems. The controller, depending on the processing requirements and/or the type of system, may be programmed to control any of the processes disclosed herein, such as delivery of gases, temperature settings (e.g., heating and/or cooling), pressure settings, power settings (e.g., electrical voltage and/or current delivered to electrodes of an MEA cell), liquid flow rate settings, fluid delivery settings, and dosing of purified water and/or salt solution. These controlled processes may be connected to or interfaced with one or more systems that work in concert with the electrolytic carbon oxide reduction system.

In various embodiments, a controller comprises electronics having various integrated circuits, logic, memory, and/or software that receive instructions, issue instructions, control operations described herein. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a process on one or more components of an electrolytic carbon oxide reduction system. The operational parameters may, in some embodiments, be part of a recipe defined by process engineers to accomplish one or more processing steps during generation of a particular reduction product such as carbon monoxide, hydrocarbons, and/or other organic compounds.

The controller, in some implementations, may be a part of or coupled to a computer that is integrated with, coupled to the system, otherwise networked to the system, or a combination thereof. For example, the controller may utilize instructions stored remotely (e.g., in the "cloud") and/or execute remotely. The computer may enable remote access to the system to monitor current progress of electrolysis operations, examine a history of past electrolysis operations, examine trends or performance metrics from a plurality of electrolysis operations, to change parameters of current processing, to set processing steps to follow a current processing, or to start a new process. In some examples, a remote computer (e.g. a server) can provide process recipes to a system over a network, which may include a local network or the internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations.

The controller may be distributed, such as by comprising one or more discrete controllers that are networked together and working towards a common purpose, such as applying current to an MEA cell and other process controls described herein. An example of a distributed control system for such purposes includes one or more processors on a system for electrolytically reducing a carbon oxide and one or more processors located remotely (such as at the platform level or as part of a remote computer) that combine to control a process.

In certain embodiments, an electrolytic carbon oxide reduction system is configured and controlled to avoid precipitating salt within an MEA. Precipitated salt can block channels and/or have other impacts that degrade an MEA cell's performance. In some cases, a cell may become too dry, e.g., at the cathode side, because dry gaseous reactant removes too much water from the MEA, particularly on the cathode side. This issue, which may cause salt precipitation, may be addressed by controlling the water partial pressure in the gas inlet stream (e.g., by humidifying the gaseous carbon oxide source gas). In some cases, a salt concentration in anode water is sufficiently high that it promotes salt precipitation in the MEA. This issue may be addressed by flushing the MEA with pure water during a current pause.

In certain embodiments, an electrolytic carbon dioxide reduction system as described herein uses carbon dioxide received directly from air. The system includes a direct air $CO_2$ capture subsystem and a carbon dioxide reduction electrolyzer subsystem. The system is configured so that $CO_2$ from the capture subsystem supplies $CO_2$, directly or indirectly, to the cathode side of the electrolyzer subsystem. The carbon dioxide reduction electrolyzer subsystem may include any of the carbon dioxide reduction reactors and systems described above.

The system may be designed so that air or other gas is provided under specified conditions to the $CO_2$ capture subsystem. In certain embodiments, fans, vacuum pumps, or simply wind are used to deliver air to the $CO_2$ capture subsystem.

In certain embodiments, the $CO_2$ capture subsystem comprises two stages: a first stage in which air is contacted with a sorbent that removes $CO_2$ from air (phase 1), and second stage in which heat, electricity, pressure, and/or humidity is applied to the sorbent to release $CO_2$ and/or water (phase 2). In some implementations, the $CO_2$ capture subsystem employs a solid or liquid absorbent or adsorbent to capture the $CO_2$ in phase 1. In various implementations, phase 1 is performed at ambient conditions or near ambient conditions. In phase 2, a temperature, electrical, pressure, and/or moisture swing is applied, causing the absorbed or adsorbed $CO_2$, and optionally water, to be released. Further description and examples of $CO_2$ capture sub-systems are described in U.S. Provisional Patent Application No. 63/060,583, incorporated by reference herein.

Depending on the configuration of the $CO_2$ capture subsystem and its operating conditions, it can produce $CO_2$ from air at a high concentration of, e.g., about 90 mole % or greater. In some cases, the $CO_2$ capture subsystem is configured to produce $CO_2$ at a relatively lower concentration, which is still sufficient for $CO_2$ reduction electrolyzers to operate.

As indicated, captured and subsequently released $CO_2$ is feedstock that is delivered directly or indirectly to the cathode side of the $CO_2$ reduction electrolyzer. In certain embodiments, water captured from the air is also used in the feedstock of the $CO_2$ electrolyzer.

In certain embodiments, an air capture $CO_2$ electrolysis system is configured to operate in a manner that delivers $CO_2$ from a direct air capture subsystem in a substantially pure stream of, e.g., about 99 mole % $CO_2$ or greater. In certain embodiments, the system is configured to operate using a lower concentration of $CO_2$ to the electrolyzer, e.g., about 98 mole % $CO_2$ or greater, or about 90 mole % $CO_2$ or greater, or even about 50 mole % $CO_2$ or greater. In some cases, quite low $CO_2$ concentrations are used as the feedstock. Such concentrations are still substantially greater than the atmospheric concentration of carbon dioxide, which is about 0.035 mole %. In certain embodiments, the system is configured to operate using a $CO_2$ concentration of about 5-15 mole %, which is mixed with air or another gas such as nitrogen.

In certain embodiments, the output of the $CO_2$ capture subsystem contains only $CO_2$ and other components in air such as nitrogen, oxygen, water, argon, or any combination. In all cases, the $CO_2$ is present at a concentration that is greater than its concentration in air. In certain embodiments, the output of the $CO_2$ capture subsystem contains no sulfur.

A direct air capture unit and $CO_2$ electrolyzer can be integrated in several ways depending on the type of air capture technology. Heat and mass transfer components may be integrated in the overall air capture $CO_2$ electrolysis system.

For example, in some designs, $CO_2$ reduction electrolyzer is configured to receive $CO_2$ from and provide heat and/or humidity to the direct air capture subsystem. The provided heat may release captured $CO_2$ during phase 2 of a direct air capture subsystem employing a temperature swing desorption mechanism. Humidified electrolyzer product gas can be used to release captured $CO_2$ during phase 2 of a direct air capture subsystem employing a moisture swing desorption mechanism.

In certain embodiments, the $CO_2$ electrolyzer is designed or configured to receive dilute $CO_2$ (e.g., no greater than about 50 mole % $CO_2$) as an input.

Direct air capture units can be designed with multiple sorbent vessels. To receive a continuous stream of $CO_2$ (and optionally water) from the air capture subsystem, at least two different vessels are operated to be at a different stage of sorption/desorption during operation of the overall air capture $CO_2$ electrolysis system. For instance, while one sorbent vessel is taking in air to capture $CO_2$, another may be heated to release $CO_2$; as each vessel continues through the sorption/desorption cycle, the sorption vessel that was taking in $CO_2$ will vent $CO_2$ and vice versa. The addition of many vessels at different points in the cycle can deliver a continuous stream of inputs to the $CO_2$ electrolyzer and accept a continuous stream of air containing $CO_2$ and moisture and/or heat and/or vacuum.

Direct air capture units can be sized to deliver the desired volume of $CO_2$ flow for a $CO_2$ electrolyzer. This may involve employing multiple sorbent-containing vessels. For example, a direct air capture subsystem may be configured to deliver 750 slpm $CO_2$. Such subsystem may couple to a 200-cell electrochemical stack composed of 1000 cm2 membrane-electrode assemblies operated at 300 mA/cm2 and 3 V/cell to produce 378 slpm CO and 42 slpm hydrogen given 90% $CO_2$ to CO current efficiency of the process. As described above, unreacted $CO_2$ at the outlet of the electrolyzer may be recycled to the inlet to increase carbon efficiency. Operated continuously, the combined air capture and electrolyzer unit may produce approximately 675 kg/day CO. In general, in some designs, an air capture $CO_2$ electrolyzer system is configured to output at least about 100 kg/day CO and/or other $CO_2$ reduction product(s). in some designs, an air capture $CO_2$ electrolyzer system is configured to output at least about 500 kg/day CO and/or other $CO_2$ reduction product(s).

In certain embodiments, systems employing a carbon oxide electrolyzer and optional optionally a direct air capture of carbon dioxide unit also include a module configured to capture water from air or an atmosphere. In some embodiments, the module configured to capture water form air utilize solar energy from photovoltaics and/or thermal solar along with hygroscopic material. In certain embodiments, the module configured to capture water is an ambient dehumidifier such as a hydropanel (available from, e.g., Zero Mass Water, Inc. of Scottsdale, AZ).

Figure 8:
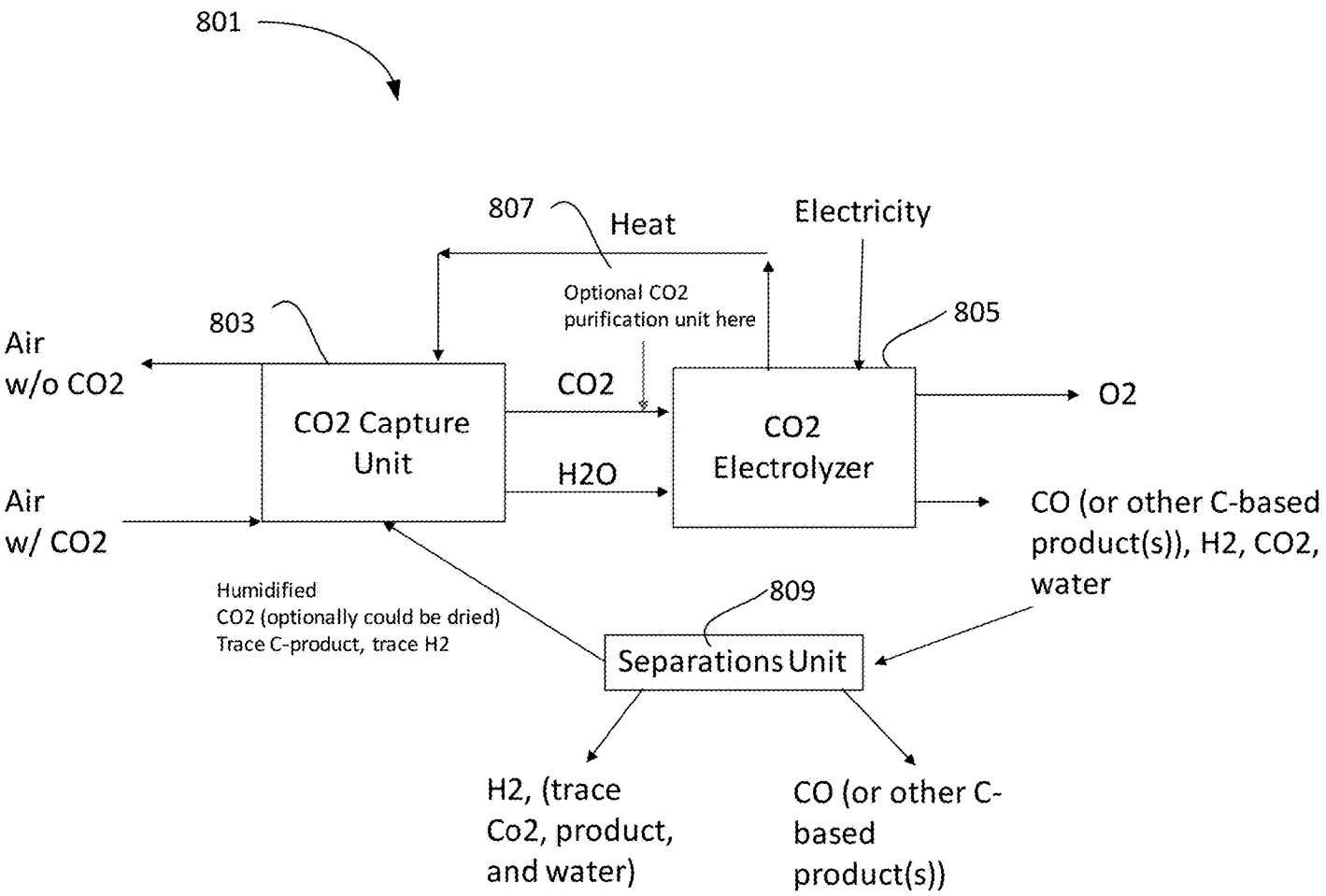
FIG. 8 shows an example of a system including a direct air $CO_2$ capture subsystem and an $CO_2$ reduction electrolyzer subsystem.

FIG. 8 illustrates an air capture $CO_2$ electrolyzer system 801 comprising a direct air $CO_2$ capture subsystem 803 and an $CO_2$ reduction electrolyzer subsystem 805. As illustrated direct air $CO_2$ capture subsystem 803 is configured to receive, during sorption phase 1, air containing $CO_2$ under, e.g., atmospheric conditions (about 0.035 mole % $CO_2$) optionally with humidity, and release air with most $CO_2$ removed and optionally with much humidity removed.

Direct air $CO_2$ capture subsystem 803 is configured to release, during phase 2, $CO_2$ and optionally water. At least the $CO_2$, and optionally the water, are provided as inputs to the $CO_2$ electrolyzer 805. The $CO_2$ released from direct air capture subsystem 803 during phase 2 is provided to the cathode side of electrolyzer 805. As depicted, an optional $CO_2$ purification unit 807 is interposed between direct air $CO_2$ capture subsystem 803 and electrolyzer 805. The water optionally provided by direct air $CO_2$ capture subsystem 803 may be directed to the cathode side (as humidity in the $CO_2$ feedstock) or anode side (as reactant) of electrolyzer 805.

In the depicted embodiment, electrolyzer 805 is configured to receive electricity (to drive the $CO_2$ reduction reaction and the anode oxidation reaction). Also, electrolyzer 805 is configured to provide excess heat from the electrolysis reaction to direct air $CO_2$ capture subsystem 703 and drive phase 2 ($CO_2$ release from the sorbent). $CO_2$ electrolyzer 805 is configured to output oxygen (the anode reaction product when water is the reactant) and one or more $CO_2$ reduction products, which may include CO and/or other carbon-based products as described above with respect to FIGS. 1-7. As depicted, system 801 is configured to provide the electrolyzer output to a separations unit 809, configured to separate CO and/or other carbon-based electrolysis products from hydrogen, $CO_2$, water, and/or other components. In the depicted embodiment, system 801 is configured to deliver humidified $CO_2$ from separations unit 809 to direct air $CO_2$ capture subsystem 803. Any of the carbon dioxide electrolyzers described herein with respect to FIGS. 1-7 may be located downstream from a direct air $CO_2$ capture subsystem as shown in FIG. 8.

In certain embodiments, methods and systems configured to receive a mixture containing ethylene and modifying the mixture to produce purified ethylene are provided. The input may be a gaseous mixture obtained from a carbon oxide electrolyzer system such as one of the carbon oxide electrolyzer systems described herein with respect to FIGS. 1-7.

Figure 12A:
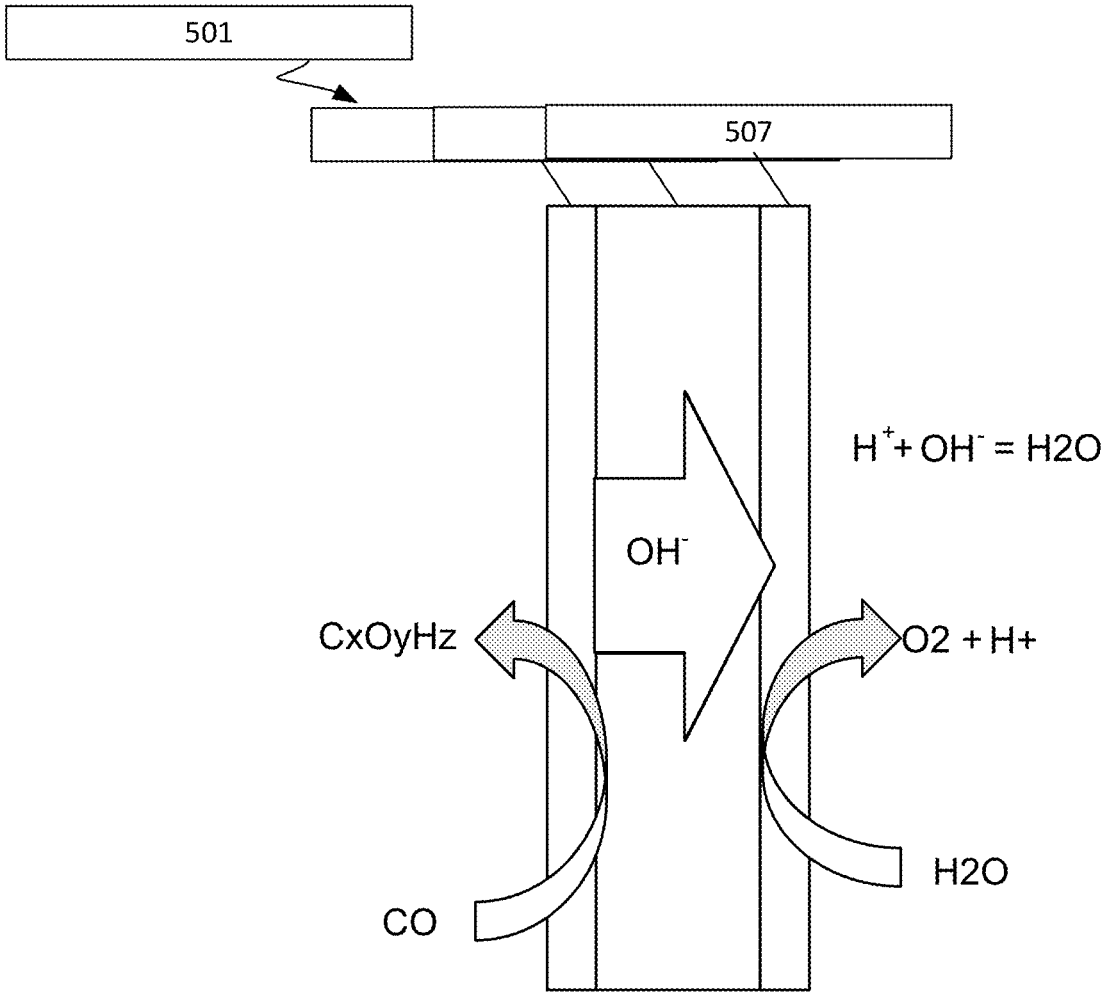
Figure 12B:
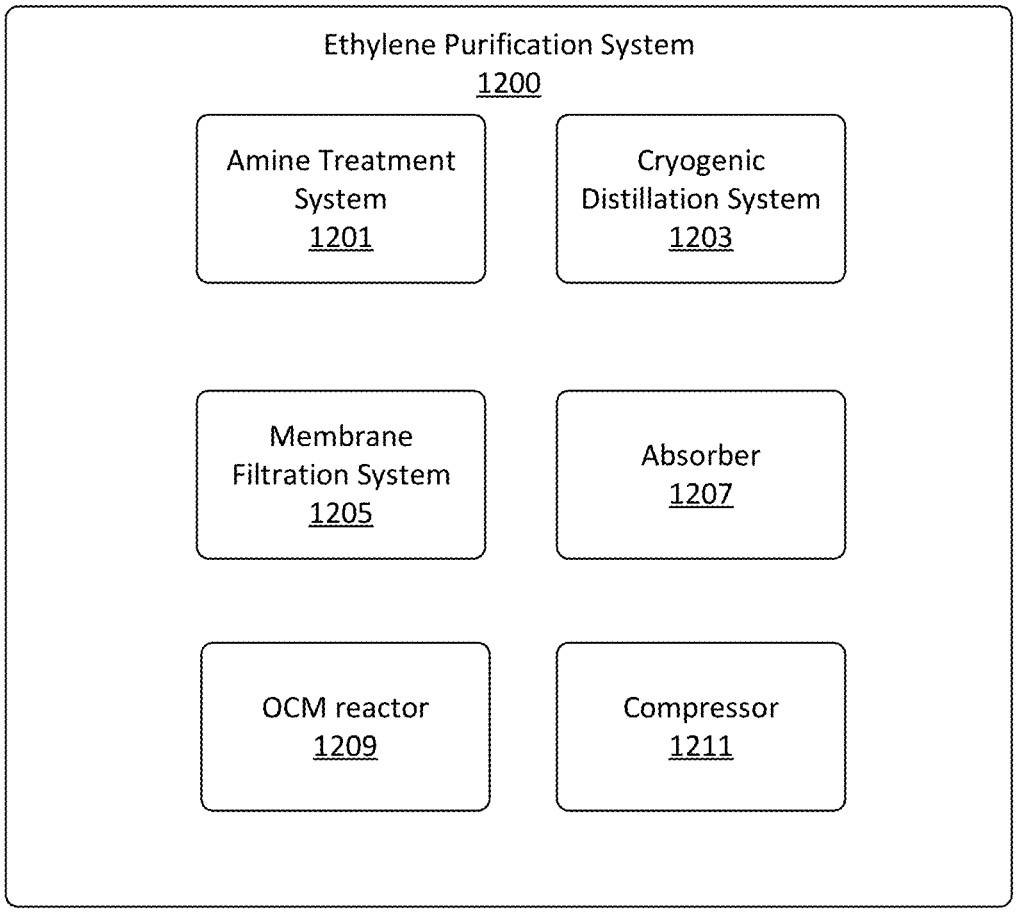
FIG. 12B shows a schematic example of components of an ethylene purification system.

FIG. 12B shows a block diagram an example of an ethylene purification system 1200. The ethylene purification system 1200 may have one or more of the following subsystems or components: an amine treatment system 1201, a cryogenic distillation system 1203, one or more membrane filtration systems 1205, one or more absorbers 1207, an oxidative coupling of methane (OCM) reactor 1209, and a compressor 1211. Examples of how the components may be used for ethylene purification are discussed further below with references to FIGS. 13A to 13C.

In some implementations, an ethylene purification system is configured to produce relatively pure ethylene, without necessarily producing a relatively pure stream of any other components produced by the electrolyzer. In some implementations, an ethylene purification system is configured to produce relatively pure ethylene along with a relatively pure stream of one or more other components such as hydrogen, carbon monoxide, carbon dioxide, methane, ethanol, or any combination thereof.

In various embodiments, an ethylene purification system includes one or more components or subsystems for (a) absorbing and separating carbon dioxide, (b) separating ethylene from one or more other components by membrane filtration, (c) fractional distillation to separate ethylene and methane, (d) chemically converting methane to ethylene, and (e) any combination of (a)-(d). In some embodiments, an amine or ionic liquid is used to absorb carbon dioxide. In some embodiments, a membrane filtration component is configured to separate carbon monoxide and hydrogen from ethylene (optionally along with methane).

Ethylene produced as described here may have various applications. For example, it can be used to produce ethylene oxide and, in some cases, reaction products of ethylene oxide such as monoethylene glycol and polyethylene glycol.

In certain embodiments described in this section, the input gas includes ethylene and typically some methane and unreacted carbon dioxide. Other components that may be present include hydrogen, carbon monoxide water, ethanol, and any combination thereof.

As an example, an inlet stream to an ethylene purification system may have a composition of the follow mol %: hydrogen (4.75%), methane (23.72%), carbon monoxide (0%), carbon dioxide (50.73%), ethylene (9.49%), ethyl alcohol (4.75%), and water (6.57%). A composition such as this may be produced by a carbon dioxide electrolyzer system as described above with respect to FIGS. 1-7.

Pathway 1: Cryogenic Distillation for Ethylene Separation

In some embodiments, ethylene is separated from other components by a pathway including absorption of carbon dioxide and subsequent fractional distillation to remove hydrogen, carbon monoxide, and/or methane to produce purified ethylene. As an example, the process may include the following sequence of operations:

Operation 1: Condensation of liquid products to remove ethanol and water

Operation 2: $CO_2$ removal

Operation 3: Distillation—removal of hydrogen, CO and methane

Figure 13A:
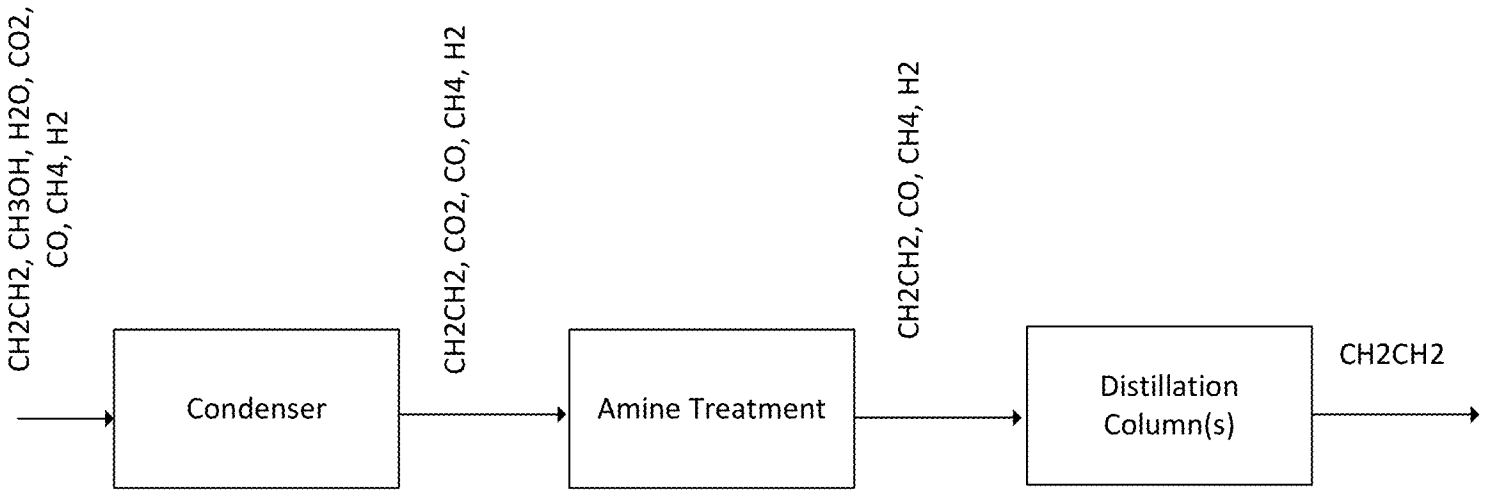
FIGS. 13A-13C illustrate example ethylene purification systems.

Operation 3 (alternate or optional): Methane conversion to ethylene by oxidative coupling of methane An example system is shown in FIG. 13A. The separation process to remove water and ethanol from an input stream may be implemented in various ways. In some embodiments, it is implemented in a two-step process of condensation and then a molecular sieve absorption process to further remove the water and ethanol. In some embodiments, the condensation of water and ethyl alcohol is accomplished using compression of the input stream. In some embodiments, the condensation of water and ethyl alcohol is accomplished using an absorption column, e.g., a countercurrent column with water as on stream. The column optionally includes a catalyst. In some implementations, thermal equilibrium is reached in the column and both outlet streams have the same temperature (e.g., about 25° C. to 50° C.).

Figure 14:
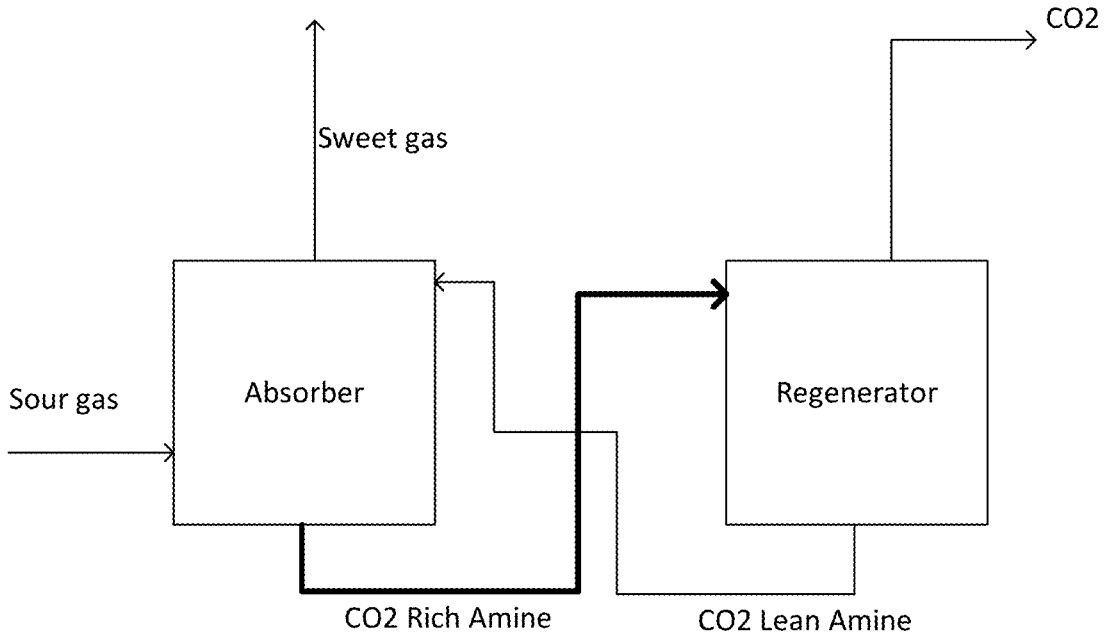
FIG. 14 shows example components of an amine treatment system.

In some cases, carbon dioxide is removed from a gas stream using an amine such as diethanolamine, monoethanolamine, dimethylamine, piperazine, 2-aminopropanol, diisopropanolamine, aminoethoxyethanol, and/or methyl diethanolamine, or by an ionic liquid. In some implementations, the concentration of a chosen amine is at least about 10 times greater than the concentration of carbon dioxide. In some embodiments, the amine-containing liquid has about 50-80 mole percent amine in an aqueous solution. FIG. 14 shows an example of an amine treatment system including an absorber and a regenerator. Amine solution absorbs $CO_2$ from the sour gas to produce a sweet gas stream (i.e., a gas free $CO_2$) as a product. The regenerator strips the $CO_2$ from the $CO_2$-rich amine. The regenerator strips the $CO_2$ and the lean amine is recycled for reuse in the absorber.

Example working conditions for an amine-based carbon dioxide removal process:

Absorber: about 35° C. to 50° C. and about 5 atm to 205 atm of absolute pressure;

Regenerator: about 100° C. to 126° C. and about 1.4 atm to 1.7 atm of absolute pressure at a tower bottom.

In some implementations, a temperature difference of about 5° C. or more is maintained between the lean amine and sour gas. If the temperature difference is closer, the condensation of hydrocarbons may occur.

Various approaches may be employed to demethanizing an ethylene and methane containing stream. In some embodiments, a cryogenic distillation process is performed. See e.g., U.S. Pat. No. 3,902,329 (King III, et al.), which is incorporated herein by reference in its entirety. In some embodiments, cryogenic distillation is conducted at a temperature of about −90° C. or lower.

In some implementations, an ethylene/methane gas mixture is pressurized in the compressor (e.g., to a pressure of about 100 bar and an outlet temperature of about 15° C.). The gas mixture is cooled with the chilled water. Then, by, e.g., throttling the compressed gas mixture with a throttle valve, the outlet gas may be substantially cooled (e.g., to a temperature of about −100° C.).

Below is presented an example process for separation of methane from the ethylene by cryogenic distillation:

20-30 plates or more

Temperature: −90° C. to −105° C. on the plate at which the condensate is returned to the column.

Pressure: 25 bar to 40 bar or higher

98% Efficiency

In some examples, a cryogenic distillation column has the following design parameters:

Diameter:0.085 m

Height:6.8 m

Stages:17

Stage efficiency:80%

Reflux ratio:1.129

Vapor linear velocity:3 m/s

Separation efficiency:98%

In some embodiments, the process removes hydrogen from ethylene (and optionally other components) via membrane separation.

In some embodiments, the process employs oxidative coupling of methane (OCM) to ethylene. OCM may be performed on a methane-containing steam after the separation of methane and ethylene. This process can produce ethane, CO, $H_2$, and $CO_2$ as unwanted byproducts. Besides the temperature of the reaction, an important parameter is the amount of oxygen that reacts with the methane.

OCM may include some of or all the below-presented reactions. See e.g., Bhatia, Subhash & Thien, Chua & Mohamed, Abdul. (2009). Oxidative coupling of methane (OCM) in a catalytic membrane reactor and comparison of its performance with other catalytic reactors. Chemical Engineering Journal-CHEM ENG J. 148. 525-532. 10.1016/j.cej.2009.01.008, which is incorporated herein by reference in its entirety.

$$CH_4+2O_2 \rightarrow CO_2+2H_2O \quad \text{Step 1:}$$

$$2CH_4+0.5O_2 \rightarrow C_2H_6+H_2O \quad \text{Step 2:}$$

$$CH_4+O_2 \rightarrow CO+H_2O+H_2 \quad \text{Step 3:}$$

$$CO+0.5O_2 \rightarrow CO_2 \quad \text{Step 4:}$$

$$C_2H_6+0.5O_2 \rightarrow C_2H_4+H_2O \quad \text{Step 5:}$$

$$C_2H_4+2O_2 \rightarrow 2CO+2H_2O \quad \text{Step 6:}$$

$$C_2H_8 \rightarrow C_2H_4+H_2 \quad \text{Step 7:}$$

$C_2H_4+2H_2O \rightarrow 2CO+4H_2$ Step 8:

$CO+H_2O \rightarrow CO_2+H_2$ Step 9:

$CO_2+H_2 \rightarrow CO+H_2O$ Step 10:

The yield of this process is dependent on reaction conditions and the oxygen ratio. The amounts of methane and oxygen may be chosen to promote reactions in, e.g., steps 2 and 5. In certain embodiments, this process occurs in the catalyst membrane reactor consisting of disk-shaped planar BSCF membranes.

Examples of OCM reactor designs and operation are presented in the following table taken from X. Tan, K. Li, in Handbook of Membrane Reactors: Reactor Types and Industrial Applications, 2013, which is incorporated herein by reference in its entirety.

| Material | T (° C.) | Geometry | Catalyst | $S_{C2}$ (%) | $Y_{C2}$ (%) | References |
|---|---|---|---|---|---|---|
| $Bi_{1.5}Y_{0.3}Sm_{0.2}O_{3-3}$ | 900 | Tubular | — | 54 | 35 | Akin and Lin, 2002 |
| BSCF | 850 | Tubular | La—Sr/CaO | 66 | 15 | Wang et al., 2005 |
| BSCF | 900 | Disk | La—SrCaO | 65 | 18 | Oliver et al., 2009 |
| LSCF | 950 | Hollow fiber | — | 43.8 | 15.3 | Tan and Li, 2006 |
| LSCF | 975 | Hollow fiber | $SrTi_{0.9}Li_{0.1}O_3$ | 40 | 21 | Tan et al., 2007 |
| LSCF | 900 | Hollow fiber | $Bi_{1.5}Y_{0.3}Sm_{0.2}O_{3-\delta}$ | 70 | 39 | Othman et al., 2018 |
| BCF2 | 800 | Hollow fiber | Mn—$Na_2WO_4/SO_2$ | 50 | 17 | Czuprat et al., 2010 |
| BCGCF | 250 | Tubular | Na—W—Mn | 67.4 | 34.7 | Bhatia et al., 2009 |

In various embodiments, the OCM temperature is in a range for the steam cracking of ethane to produce ethylene. The analysis shows that operating at a temperature range of 850° C. –950° C. and steam to hydrocarbon ratio of 0.3-0.5 produces good ethylene yield while minimizing byproducts. In some embodiments, the OCM-cracking reaction is conducted in a tubular reactor and at elevated pressure (e.g., about 2 to 2.5 bar).

In certain embodiments, about 0.3 of the methane is converted to ethylene (molar), which may be about the amount of ethylene present in a typical inlet feed. Therefore, by utilization of the above process, the produced amount of ethylene is almost doubled.

In some embodiments, a process includes an operation of separating steam and hydrogen from the formed ethylene. An absorption counter flow column may be employed for this operation. As an example, process conditions may include a pressure of about 5 to 50 bar (e.g., about 10 bar) and a temperature of about 150 to 500 C (e.g., about 300 C). In some embodiments, an absorption column with an adequate volume flow of the water separates nearly 100% of water and hydrogen from the gas.

Pathway 2: Usage of the Membranes for Ethylene Separation

In some embodiments, ethylene is separated from other components by a pathway including membrane separation of gas streams to produce an ethylene-rich stream. As an example, such process may include the following sequence of operations:

- Operation 1: Condensation of liquid products to remove ethanol and water
- Operation 2: $CO_2$ removal with amine treatment
- Operation 3: $CO+H_2$ Removal with membrane separation
- Operation 4: Ethylene separation from methane with membrane separation.

Figure 13B:
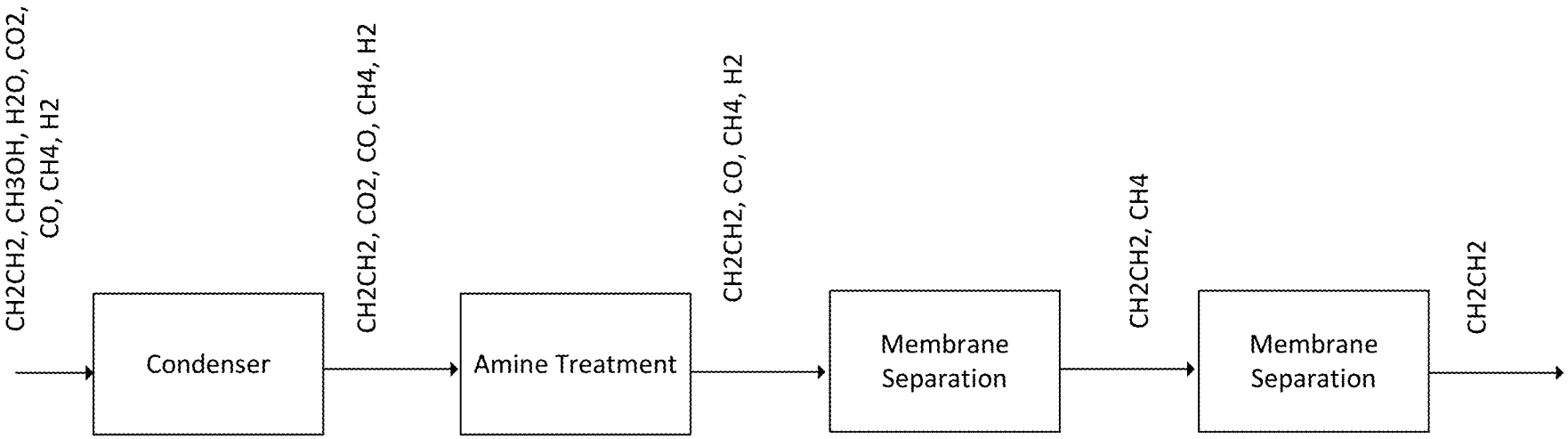

An example system is shown in FIG. 13B. In some implementations, operations 1 and 2 are performed in the same manner as in the above-described pathway that employed cryogenic distillation. Operations 3 and 4 are performed using membranes designed or configured to separate gaseous components from one another. In certain embodiments, suitable membranes are provided by Membrane Technology & Research, Inc. of Newark, CA The design may include a compression stage that removes ethanol and water prior to membrane separation.

Membrane Stage to Remove Non-Hydrocarbons

A first membrane may separate nearly 100% of $H_2$, $CO_2$, ethanol, and water. It may not significantly separate $CH_4$ from $C_2H_4$.

As an example, starting from an initial gas mixture of 50.7 mol % $CO_2$, 23.7 mol % $CH_4$, and 9.5 mol % $C_2H_4$, the resulting product stream contains 64.7 mol % $CH_4$ and 30.5 mol % $C_2H_4$, with most of the remaining gas being $CO_2$ (3.7%). To reduce loss of the $CH_4/C_2H_4$ mixture in a permeate stream, a two-stage separation design may be employed.

In some embodiments, the membrane is a hollow fiber membrane comprising polypropylene (PP), polyethylene (PE), polytetrafluoroethylene (PTFE), PVDF, polysulfone (PS), polyetherimide (PEI), or any combination thereof. In some embodiments, the membrane has a porosity of about 50-70% (e.g., about 60%). In some embodiments, the membrane has a mean pore size of about 2 to 3 μm. Example conditions are 10 bar pressure and an inlet stream at 30° C. A cooling process may occur in the membrane.

Ethylene Methane Separation

In certain embodiments, a methane-ethylene separation membrane includes a metal-organic membrane for separation at the room temperature. In certain embodiments, a methane-ethylene membrane separation, has an adsorption selectivity of 12 to 20 at 296 K. An adsorption selectivity=20 represents the 95% separation process efficiency.

The membrane may include a microporous metal-organic framework (e.g., $Zn_4L(DMA)_4$ (UTSA-33, H8L=1,2,4,5-tetra (5-isophthalic acid)benzene,DMA=N,N'-dimethylacetamide)) with small pores of about 4.8 to 6.5 Å (He, Yabing, et al. "A microporous metal-organic framework for highly selective separation of acetylene, ethylene, and ethane from methane at room temperature." Chemistry-A European Journal 18.2 (2012): 613, which is incorporated herein by reference in its entirety).

In some implementations, after the methane separation, the methane is subjected to OCM to increase the yield of ethylene.

Pathway 3: Usage of Filtration Membranes and Cryogenic Distillation for Ethylene Separation In certain embodiments, a membrane filter is employed to separate methane and ethylene from other components such as hydrogen, carbon monoxide, and carbon dioxide. In some embodiments, a methane-ethylene mixture is subsequently separated by cryogenic distillation into relatively pure streams of ethylene and methane. In some implementations, a separate membrane filter is employed to separate hydrogen from carbon monoxide, carbon dioxide, and optionally other components.

In some implementations, a process may include the following operations:

- Operation 1: Compression of gas stream to enable condensation of ethyl alcohol and water
- Operation 2: Removal of water and ethyl alcohol in countercurrent absorption column with catalyst
- Operation 3: Membrane filtration to separate methane and ethylene from other gases such as carbon dioxide, carbon monoxide, and hydrogen
- Operation 4 (optional): Membrane filtration to separation hydrogen from carbon monoxide and carbon dioxide.
- Operation 5: Cryogenic distillation to separate methane and ethane (optionally use the cooled methane output stream as a cooling utility)

Figure 13C:
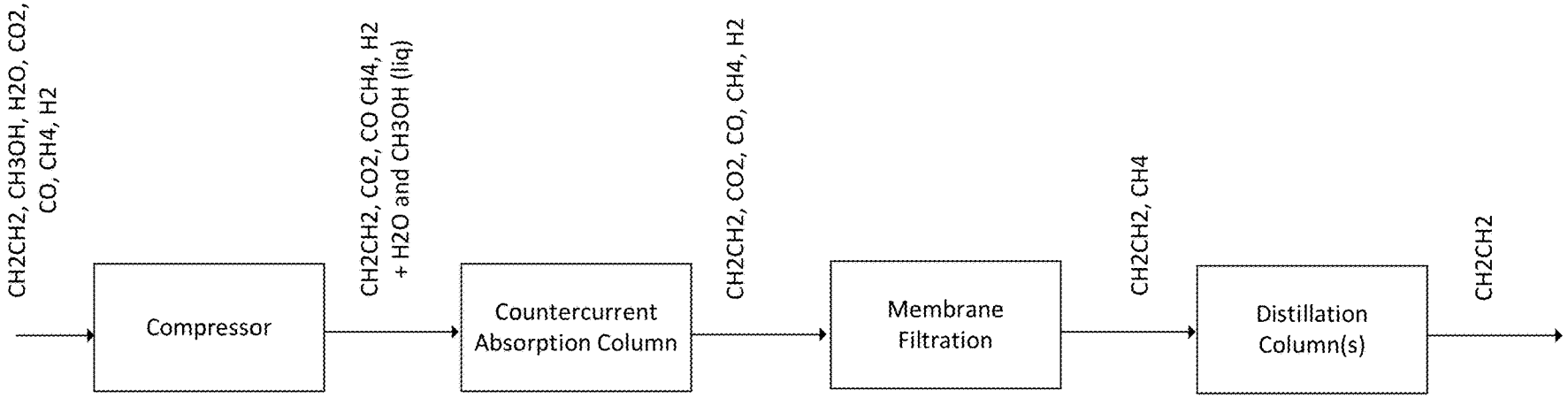

An example system is shown in FIG. 13C.

MEA Overview

The above description references MEAs including bipolar and AEM-only MEAs. Further description of MEAs that may be used with various embodiments of the systems and methods described herein, including cation-exchange membrane-only MEAs, are provided below.

In various embodiments, an MEA contains an anode layer, a cathode layer, electrolyte, and optionally one or more other layers. The layers may be solids and/or gels. The layers may include polymers such as ion-conducting polymers.

When in use, the cathode of an MEA promotes electrochemical reduction of $CO_x$ by combining three inputs: $CO_x$, ions (e.g., protons) that chemically react with $CO_x$, and electrons. The reduction reaction may produce CO, hydrocarbons, and/or oxygen and hydrogen containing organic compounds such as methanol, ethanol, and acetic acid. When in use, the anode of an MEA promotes an electrochemical oxidation reaction such as electrolysis of water to produce elemental oxygen and protons. The cathode and anode may each contain catalysts to facilitate their respective reactions.

The compositions and arrangements of layers in the MEA may promote high yield of a $CO_x$ reduction products. To this end, the MEA may facilitate any one or more of the following conditions: (a) minimal parasitic reduction reactions (non-$CO_x$ reduction reactions) at the cathode; (b) low loss of $CO_x$ reactants at anode or elsewhere in the MEA; (c) maintain physical integrity of the MEA during the reaction (e.g., prevent delamination of the MEA layers); (d) prevent $CO_x$ reduction product cross-over; (e) prevent oxidation production (e.g., $O_2$) cross-over; (f) maintain a suitable environment at the cathode for oxidation; (g) provide pathway for desired ions to travel between cathode and anode while blocking undesired ions; and (h) minimize voltage losses. As explained herein, the presence of salts or salt ions in the MEA can facilitate some of all of these conditions.

$CO_x$ Reduction Considerations

Polymer-based membrane assemblies such as MEAs have been used in various electrolytic systems such as water electrolyzers and in various galvanic systems such as fuel cells. However, $CO_x$ reduction presents problems not encountered, or encountered to a lesser extent, in water electrolyzers and fuel cells.

For example, for many applications, an MEA for $CO_x$ reduction requires a lifetime on the order of about 50,000 hours or longer (approximately five years of continuous operation), which is significantly longer than the expected lifespan of a fuel cell for automotive applications; e.g., on the order of 5,000 hours. And for various applications, an MEA for $CO_x$ reduction employs electrodes having a relatively large surface area by comparison to MEAs used for fuel cells in automotive applications. For example, MEAs for $CO_x$ reduction may employ electrodes having surface areas (without considering pores and other nonplanar features) of at least about 500 $cm^2$.

$CO_x$ reduction reactions may be implemented in operating environments that facilitate mass transport of particular reactant and product species, as well as to suppress parasitic reactions. Fuel cell and water electrolyzer MEAs often cannot produce such operating environments. For example, such MEAs may promote undesirable parasitic reactions such as gaseous hydrogen evolution at the cathode and/or gaseous $CO_2$ production at the anode.

In some systems, the rate of a $CO_x$ reduction reaction is limited by the availability of gaseous $CO_x$ reactant at the cathode. By contrast, the rate of water electrolysis is not significantly limited by the availability of reactant: liquid water tends to be easily accessible to the cathode and anode, and electrolyzers can operate close to the highest current density possible.

MEA Configurations

In certain embodiments, an MEA has a cathode layer, an anode layer, and a polymer electrolyte membrane (PEM) between the anode layer and the cathode layer. The polymer electrolyte membrane provides ionic communication between the anode layer and the cathode layer, while preventing electronic communication, which would produce a short circuit. The cathode layer includes a reduction catalyst and a first ion-conducting polymer. The cathode layer may also include an ion conductor and/or an electron conductor. The anode layer includes an oxidation catalyst and a second ion-conducting polymer. The anode layer may also include an ion conductor and/or an electron conductor. The PEM includes a third ion-conducting polymer.

In certain embodiments, the MEA has a cathode buffer layer between the cathode layer and the polymer electrolyte membrane. The cathode buffer includes a fourth ion-conducting polymer.

In certain embodiments, the MEA has an anode buffer layer between the anode layer and the polymer electrolyte membrane. The anode buffer includes a fifth ion-conducting polymer.

In connection with certain MEA designs, there are three available classes of ion-conducting polymers: anion-conductors, cation-conductors, and mixed cation-and-anion-conductors. In certain embodiments, at least two of the first, second, third, fourth, and fifth ion-conducting polymers are from different classes of ion-conducting polymers.

Ion-Conducting Polymers for MEA Layers

The term "ion-conducting polymer" is used herein to describe a polymer electrolyte having greater than about 1 mS/cm specific conductivity for anions and/or cations. The term "anion-conductor" describes an ion-conducting polymer that conducts anions primarily (although there will still be some small amount of cation conduction) and has a transference number for anions greater than about 0.85 at around 100 micron thickness. The terms "cation-conductor" and/or "cation-conducting polymer" describe an ion-conducting polymer that conducts cations primarily (e.g., there can still be an incidental amount of anion conduction) and has a transference number for cations greater than approximately 0.85 at about 100 micron thickness. For an ion-conducting polymer that is described as conducting both anions and cations (a "cation-and-anion-conductor"), neither the anions nor the cations have a transference number greater than approximately 0.85 or less than approximately 0.15 at about 100 micron thickness. To say a material conducts ions (anions and/or cations) is to say that the material is an ion-conducting material or ionomer. Examples of ion-conducting polymers of each class are provided in the below Table 1.

Ion-Conducting Polymers

| Class | Description | Common Features | Examples |
|---|---|---|---|
| A. Anion-conducting | Greater than approximately 1 mS/cm specific conductivity for anions, which have a transference number greater than approximately 0.85 at around 100 micron thickness | Positively charged functional groups are covalently bound to the polymer backbone | aminated tetramethyl polyphenylene; poly(ethylene-co-tetrafluoroethylene)-based quaternary ammonium polymer; quaternized poly sulfone |
| B. Conducts both anions and cations | Greater than approximately 1 mS/cm conductivity for ions (including both cations and anions), which have a transference number between approximately 0.15 and 0.85 at around 100 micron thickness | Salt is soluble in the polymer and the salt ions can move through the polymer material | polyethylene oxide; polyethylene glycol, poly(vinylidene fluoride); polyurethane |
| C. Cation-conducting | Greater than approximately 1 mS/cm specific conductivity for cations, which have a transference number greater than approximately 0.85 at around 100 micron thickness | Negatively-charged functional groups are covalently bound to the polymer backbone | perfluorosulfonic acid polytetrafluoroethylene co-polymer; sulfonated poly(ether ketone); poly(styrene sulfonic acid-co-maleic acid) |

Further examples of polymeric structures that can include an ionizable moiety or an ionic moiety and be used as ion-conducting polymers in the MEAs of the electrolyzers described herein are provided in U.S. patent application Ser. No. 17/247,036, filed Nov. 24, 2020, incorporated by reference herein. Charge conduction through the material can be controlled by the type and amount of charge (e.g., anionic and/or cationic charge on the polymeric structure) provided by the ionizable/ionic moieties. In addition, the composition can include a polymer, a homopolymer, a copolymer, a block copolymer, a polymeric blend, other polymer-based forms, or other useful combinations of repeating monomeric units. As described further in U.S. patent application Ser. No. 17/247,036, an ion conducting polymer layer may include one or more of crosslinks, linking moieties, and arylene groups according to various embodiments. In some embodiments, two or more ion conducting polymers (e.g., in two or more ion conducting polymer layers of the MEA) may be crosslinked.

Bipolar MEA for COx Reduction

In certain embodiments, the MEA includes a bipolar interface with an anion-conducting polymer on the cathode side of the MEA and an interfacing cation-conducting polymer on the anode side of the MEA. In some implementations, the cathode contains a first catalyst and an anion-conducting polymer. In certain embodiments, the anode contains a second catalyst and a cation-conducting polymer. In some implementations, a cathode buffer layer, located between the cathode and polymer electrolyte membrane (PEM), contains an anion-conducting polymer. In some embodiments, an anode buffer layer, located between the anode and PEM, contains a cation-conducting polymer.

During operation, an MEA with a bipolar interface moves ions through a polymer-electrolyte, moves electrons through metal and/or carbon in the cathode and anode layers, and moves liquids and gas through pores in the layers.

In embodiments employing an anion-conducting polymer in the cathode and/or in a cathode buffer layer, the MEA can decrease or block unwanted reactions that produce undesired products and decrease the overall efficiency of the cell. In embodiments employing a cation-conducting polymer in the anode and/or in an anode buffer layer can decrease or block unwanted reactions that reduce desired product production and reduce the overall efficiency of the cell.

For example, at levels of electrical potential used for cathodic reduction of $CO_2$, hydrogen ions may be reduced to hydrogen gas. This is a parasitic reaction; current that could be used to reduce $CO_2$ is used instead to reduce hydrogen ions. Hydrogen ions may be produced by various oxidation reactions performed at the anode in a $CO_2$ reduction reactor and may move across the MEA and reach the cathode where they can be reduced to produce hydrogen gas. The extent to which this parasitic reaction can proceed is a function of the concentration of hydrogen ions present at the cathode. Therefore, an MEA may employ an anion-conducting material in the cathode layer and/or in a cathode buffer layer. The anion-conducting material at least partially blocks hydrogen ions from reaching catalytic sites on the cathode. As a result, parasitic production of hydrogen gas generation is decreased and the rate of CO or other product production and the overall efficiency of the process are increased.

Another reaction that may be avoided is reaction of carbonate or bicarbonate ions at the anode to produce $CO_2$.

Aqueous carbonate or bicarbonate ions may be produced from $CO_2$ at the cathode. If such ions reach the anode, they may react with hydrogen ions to produce and release gaseous $CO_2$. The result is net movement of $CO_2$ from the cathode to the anode, where it does not react and is lost with oxidation products. To prevent the carbonate and bicarbonate ion produced at the cathode from reaching the anode, the anode and/or an anode buffer layer may include a cation-conducting polymer, which at least partially blocks the transport of negative ions such as bicarbonate ions to the anode.

Thus, in some designs, a bipolar membrane structure raises the pH at the cathode to facilitate $CO_2$ reduction while a cation-conducting polymer such as a proton-exchange layer prevents the passage of significant amounts of $CO_2$ and $CO_2$ reduction products (e.g., bicarbonate) to the anode side of the cell.

An example MEA 200 for use in $CO_x$ reduction is shown in FIG. 9. The MEA 900 has a cathode layer 920 and an anode layer 940 separated by an ion-conducting polymer layer 960 that provides a path for ions to travel between the cathode layer 920 and the anode layer 940. In certain embodiments, the cathode layer 920 includes an anion-conducting polymer and/or the anode layer 940 includes a cation-conducting polymer. In certain embodiments, the cathode layer and/or the anode layer of the MEA are porous. The pores may facilitate gas and/or fluid transport and may increase the amount of catalyst surface area that is available for reaction.

The ion-conducting layer 960 may include two or three sublayers: a polymer electrolyte membrane (PEM) 965, an optional cathode buffer layer 925, and/or an optional anode buffer layer 945. One or more layers in the ion-conducting layer may be porous. In certain embodiments, at least one layer is nonporous so that reactants and products of the cathode cannot pass via gas and/or liquid transport to the anode and vice versa. In certain embodiments, the PEM layer 965 is nonporous. Example characteristics of anode buffer layers and cathode buffer layers are provided elsewhere herein. In some embodiments, the ion-conducting layer 960 includes only a PEM and may be an anion-exchange membrane or cation-exchange membrane.

Figure 10:
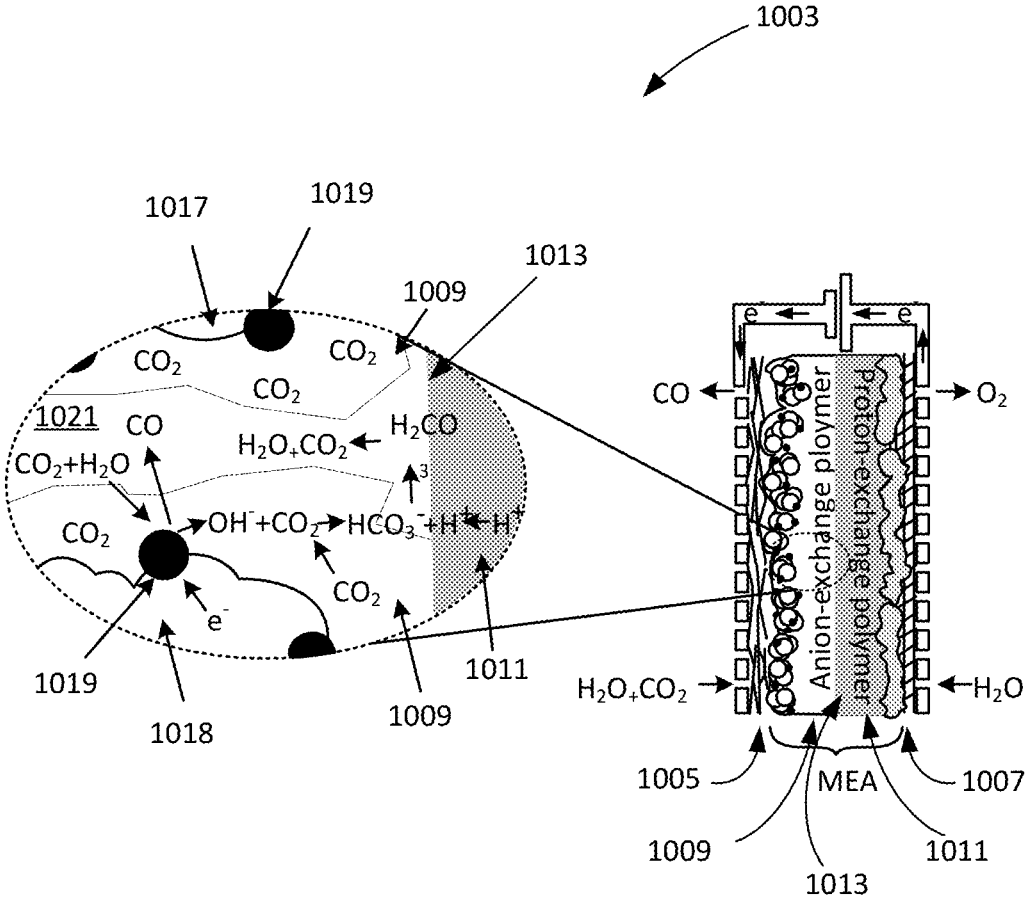
FIG. 10 shows an example of a $CO_2$ electrolyzer configured to receive water and $CO_2$ as a reactant at a cathode and expel CO as a product according to certain embodiments.

FIG. 10 shows $CO_2$ electrolyzer 1003 configured to receive water and $CO_2$ (e.g., humidified or dry gaseous $CO_2$) as a reactant at a cathode 1005 and expel CO as a product. Electrolyzer 1003 is also configured to receive water as a reactant at an anode 1007 and expel gaseous oxygen. Electrolyzer 1003 includes bipolar layers having an anion-conducting polymer 1009 adjacent to cathode 1005 and a cation-conducting polymer 1011 (illustrated as a proton-exchange membrane) adjacent to anode 1007.

As illustrated in the magnification inset of a bipolar interface 1013 in electrolyzer 1003, the cathode 1005 includes an anion exchange polymer (which in this example is the same anion-conducting polymer 1009 that is in the bipolar layers) electronically conducting carbon support particles 1017, and metal nanoparticles 1019 supported on the support particles. $CO_2$ and water are transported via pores such as pore 1021 and reach metal nanoparticles 1019 where they react, in this case with hydroxide ions, to produce bicarbonate ions and reduction reaction products (not shown). $CO_2$ may also reach metal nanoparticles 1019 by transport within anion exchange polymer 1015.

Hydrogen ions are transported from anode 1007, and through the cation-conducting polymer 1011, until they reach bipolar interface 1013, where they are hindered from further transport toward the cathode by anion exchange polymer 1009. At interface 1013, the hydrogen ions may react with bicarbonate or carbonate ions to produce carbonic acid ($H_2CO_3$), which may decompose to produce $CO_2$ and water. As explained herein, the resulting $CO_2$ may be provided in gas phase and should be provided with a route in the MEA back to the cathode 1005 where it can be reduced. The cation-conducting polymer 1011 hinders transport of anions such as bicarbonate ions to the anode where they could react with protons and release $CO_2$, which would be unavailable to participate in a reduction reaction at the cathode.

As illustrated, a cathode buffer layer having an anion-conducting polymer may work in concert with the cathode and its anion-conductive polymer to block transport of protons to the cathode. While MEAs employing ion conducting polymers of appropriate conductivity types in the cathode, the anode, cathode buffer layer, and if present, an anode buffer layer may hinder transport of cations to the cathode and anions to the anode, cations and anions may still come in contact in the MEA's interior regions, such as in the membrane layer.

As illustrated in FIG. 10, bicarbonate and/or carbonate ions combine with hydrogen ions between the cathode layer and the anode layer to form carbonic acid, which may decompose to form gaseous $CO_2$. It has been observed that MEAs sometime delaminate, possibly due to this production of gaseous $CO_2$, which does not have an easy egress path.

The delamination problem can be addressed by employing a cathode buffer layer having pores. One possible explanation of its effectiveness is that the pores create paths for the gaseous carbon dioxide to escape back to the cathode where it can be reduced. In some embodiments, the cathode buffer layer is porous but at least one layer between the cathode layer and the anode layer is nonporous. This can prevent the passage of gases and/or bulk liquid between the cathode and anode layers while still preventing delamination. For example, the nonporous layer can prevent the direct passage of water from the anode to the cathode.

Anion Exchange Membrane-Only MEA for $CO_x$ Reduction

In some embodiments, an MEA does not contain a cation-conducting polymer layer. In such embodiments, the electrolyte is not a cation-conducting polymer and the anode, if it includes an ion-conducting polymer, does not contain a cation-conducting polymer. Examples are provided herein.

An anion-exchange membrane (AEM)-only (AEM-only) MEA allows conduction of anions across the MEA. In embodiments in which none of the MEA layers has significant conductivity for cations, hydrogen ions have limited mobility in the MEA. In some implementations, an AEM-only membrane provides a high pH environment (e.g., at least about pH 7) and may facilitate $CO_2$ and/or CO reduction by suppressing the hydrogen evolution parasitic reaction at the cathode. As with other MEA designs, the AEM-only MEA allows ions, notably anions such as hydroxide ions, to move through polymer-electrolyte. The pH may be lower in some embodiments; a pH of 4 or greater may be high enough to suppress hydrogen evolution. The AEM-only MEA also permits electrons to move to and through metal and carbon in catalyst layers. In embodiments, having pores in the anode layer and/or the cathode layer, the AEM-only MEA permits liquids and gas to move through pores.

In certain embodiments, the AEM-only MEA comprises an anion-exchange polymer electrolyte membrane with an electrocatalyst layer on either side: a cathode and an anode. In some embodiments, one or both electrocatalyst layers also contain anion-exchange polymer-electrolyte.

In certain embodiments, an AEM-only MEA is formed by depositing cathode and anode electrocatalyst layers onto porous conductive supports such as gas diffusion layers to form gas diffusion electrodes (GDEs) and sandwiching an anion-exchange membrane between the gas diffusion electrodes.

In certain embodiments, an AEM-only MEA is used for $CO_2$ reduction. The use of an anion-exchange polymer electrolyte avoids low pH environment that disfavors $CO_2$ reduction. Further, water is transported away from the cathode catalyst layer when an AEM is used, thereby preventing water build up (flooding) which can block reactant gas transport in the cathode of the cell.

Water transport in the MEA occurs through a variety of mechanisms, including diffusion and electro-osmotic drag. In some embodiments, at current densities of the $CO_2$ electrolyzers described herein, electro-osmotic drag is the dominant mechanism. Water is dragged along with ions as they move through the polymer electrolyte. For a cation-exchange membrane such as Nafion membrane, the amount of water transport is well characterized and understood to rely on the pre-treatment/hydration of the membrane. Protons move from positive to negative potential (anode to cathode) with each carrying 2-4 water molecules with it, depending on pretreatment. In anion-exchange polymers, the same type of effect occurs. Hydroxide, bicarbonate, or carbonate ions moving through the polymer electrolyte will 'drag' water molecules with them. In the anion-exchange MEAs, the ions travel from negative to positive voltage, so from cathode to anode, and they carry water molecules with them, moving water from the cathode to the anode in the process.

In certain embodiments, an AEM-only MEA is employed in CO reduction reactions. Unlike the $CO_2$ reduction reaction, CO reduction does not produce carbonate or bicarbonate anions that could transport to the anode and release valuable reactant.

Figure 11:
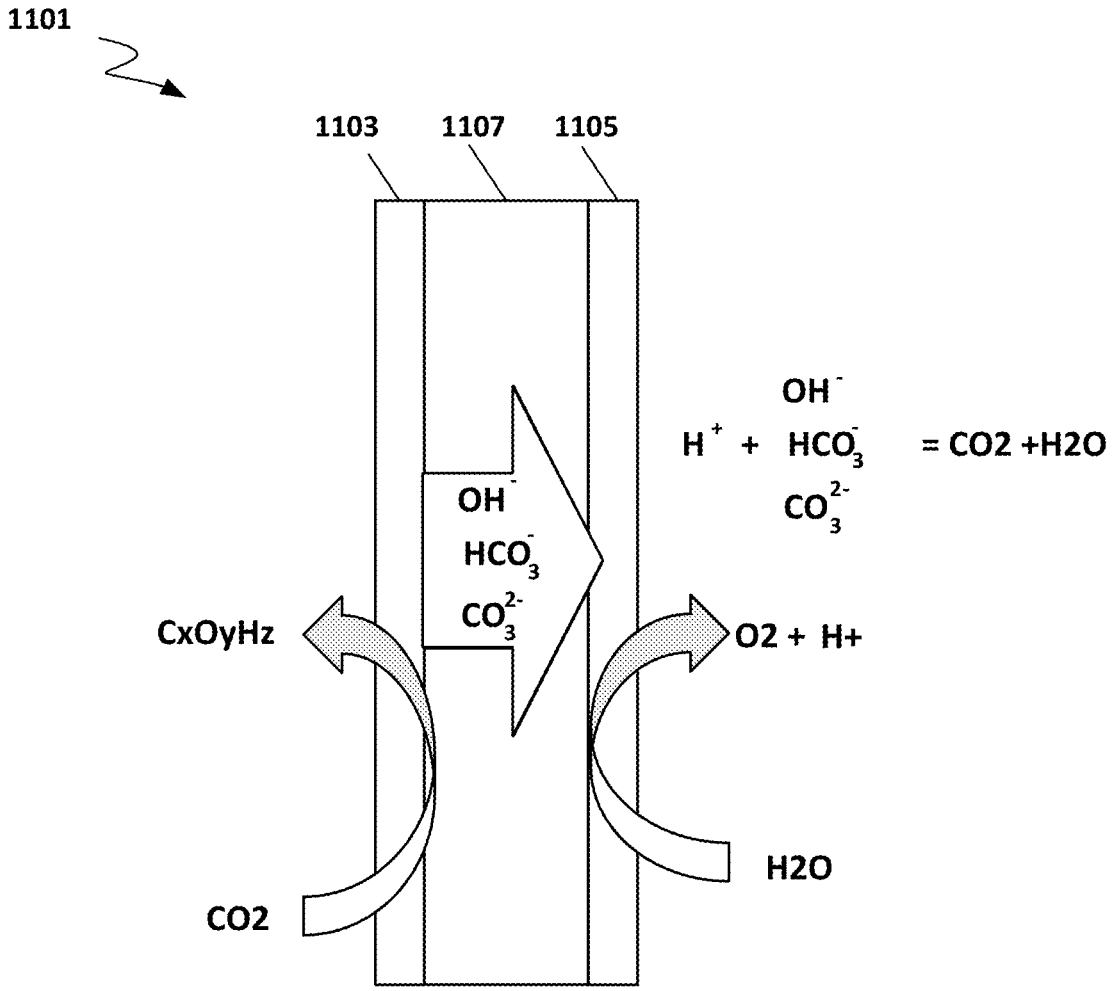
FIGS. 11 and 12A show example constructions of $CO_x$ reduction MEAs according to certain embodiments.

FIG. 11 illustrates an example construction of a $CO_x$ reduction MEA 1101 having a cathode catalyst layer 1103, an anode catalyst layer 1105, and an anion-conducting PEM 1107. In certain embodiments, cathode catalyst layer 1103 includes metal catalyst particles (e.g., nanoparticles) that are unsupported or supported on a conductive substrate such as carbon particles. In some implementations, cathode catalyst layer 1103 additionally includes an anion-conducting polymer. The metal catalyst particles may catalyze $CO_x$ reduction, particularly at pH greater than a threshold pH, which may be pH 4-7, for example, depending on the catalyst. In certain embodiments, anode catalyst layer 405 includes metal oxide catalyst particles (e.g., nanoparticles) that are unsupported or supported on a conductive substrate such as carbon particles. In some implementations, anode catalyst layer 1103 additionally includes an anion-conducting polymer. Examples of metal oxide catalyst particles for anode catalyst layer 1105 include iridium oxide, nickel oxide, nickel iron oxide, iridium ruthenium oxide, platinum oxide, and the like. Anion-conducting PEM 1107 may comprise any of various anion-conducting polymers such as, for example, HNN5/HNN8 by Ionomr, FumaSep by Fumatech, TM1 by Orion, PAP-TP by W7energy, Sustainion by Dioxide Materials, and the like. These and other anion-conducting polymer that have an ion exchange capacity (IEC) ranging from 1.1 to 2.6 mmol/g, working pH ranges from 0-14, bearable solubility in some organic solvents, reasonable thermal stability and mechanical stability, good ionic conductivity/ASR and acceptable water uptake/swelling ratio may be used. The polymers may be chemically exchanged to certain anions instead of halogen anions prior to use. In some embodiments, the anion-conducting polymer may have an IEC of 1 to 3.5 mmol/g.

As illustrated in FIG. 11, $CO_x$ such as $CO_2$ gas may be provided to cathode catalyst layer 1103. In certain embodiments, the $CO_2$ may be provided via a gas diffusion electrode. At the cathode catalyst layer 1103, the $CO_2$ reacts to produce reduction product indicated generically as $C_xO_yH_z$. Anions produced at the cathode catalyst layer 403 may include hydroxide, carbonate, and/or bicarbonate. These may diffuse, migrate, or otherwise move to the anode catalyst layer 1105. At the anode catalyst layer 1105, an oxidation reaction may occur such as oxidation of water to produce diatomic oxygen and hydrogen ions. In some applications, the hydrogen ions may react with hydroxide, carbonate, and/or bicarbonate to produce water, carbonic acid, and/or $CO_2$. Fewer interfaces give lower resistance. In some embodiments, a highly basic environment is maintained for $C_2$ and $C_3$ hydrocarbon synthesis.

FIG. 12 illustrates an example construction of a CO reduction MEA 1201 having a cathode catalyst layer 1203, an anode catalyst layer 1205, and an anion-conducting PEM 1207. Overall, the constructions of MEA 1201 may be similar to that of MEA 1101 in FIG. 11. However, the cathode catalyst may be chosen to promote a CO reduction reaction, which means that different reduction catalysts would be used in CO and $CO_2$ reduction embodiments.

In some embodiments, an AEM-only MEA may be advantageous for CO reduction. The water uptake number of the AEM material can be selected to help regulate moisture at the catalyst interface, thereby improving CO availability to the catalyst. AEM-only membranes can be favorable for CO reduction due to this reason. Bipolar membranes can be more favorable for $CO_2$ reduction due to better resistance to $CO_2$ dissolving and crossover in basic anolyte media.

In various embodiments, cathode catalyst layer 1203 includes metal catalyst particles (e.g., nanoparticles) that are unsupported or supported on a conductive substrate such as carbon particles. In some implementations, cathode catalyst layer 1203 additionally includes an anion-conducting polymer. In certain embodiments, anode catalyst layer 1205 includes metal oxide catalyst particles (e.g., nanoparticles) that are unsupported or supported on a conductive substrate such as carbon particles. In some implementations, anode catalyst layer 1203 additionally includes an anion-conducting polymer. Examples of metal oxide catalyst particles for anode catalyst layer 1205 may include those identified for the anode catalyst layer 1105 of FIG. 11. Anion-conducting PEM 1207 may comprise any of various anion-conducting polymer such as, for example, those identified for the PEM 1107 of FIG. 11.

As illustrated in FIG. 12, CO gas may be provided to cathode catalyst layer 12. In certain embodiments, the CO may be provided via a gas diffusion electrode. At the cathode catalyst layer 1203, the CO reacts to produce reduction product indicated generically as $C_xO_yH_z$.

Anions produced at the cathode catalyst layer 1203 may include hydroxide ions. These may diffuse, migrate, or otherwise move to the anode catalyst layer 1205. At the anode catalyst layer 1205, an oxidation reaction may occur such as oxidation of water to produce diatomic oxygen and hydrogen ions. In some applications, the hydrogen ions may react with hydroxide ions to produce water.

While the general configuration of the MEA 1201 is similar to that of MEA 1201, there are certain differences in the MEAs. First, MEAs may be wetter for CO reduction, helping keep the polymer electrolyte hydrated. Also, for $CO_2$ reduction, a significant amount of $CO_2$ may be transferred to the anode for an AEM-only MEA such as shown in FIG. 12. For CO reduction, there is less likely to be significant CO gas crossover. In this case, the reaction environment could be very basic. MEA materials, including the catalyst, may be selected to have good stability in high pH environment. In some embodiments, a thinner membrane may be used for CO reduction than for $CO_2$ reduction.

As a person skilled in the art will recognize from the previous detailed description and from the figures and claims, modifications and changes can be made to the disclosed embodiments of the disclosure without departing from the scope of this disclosure defined in the following claims.

What is claimed is:

1. A system for producing a gas phase product, comprising:

a carbon oxide ($CO_x$) reduction reactor comprising a membrane electrode assembly (MEA) that comprises one or more ion conductive polymer layers and a cathode catalyst for facilitating chemical reduction of $CO_x$ to ethylene, the $CO_x$ reduction reactor configured to receive a feed stream comprising $CO_x$ and outlet a gas phase product stream comprising ethylene; and a recycle loop configured to recycle, without separation, a portion of the gas phase product stream such that the feed stream comprises a mixture of the portion of the gas phase product stream and fresh $CO_x$; and an ethylene purification system configured to receive a mixture containing ethylene from the $CO_x$ reduction reactor and produce a purified stream having a higher ethylene concentration than the mixture.

2. The system of claim 1, wherein the recycle loop comprises a compressor.

3. The system of claim 1, wherein the $CO_x$ is carbon dioxide ($CO_2$).

4. The system of claim 1, wherein the MEA is a bipolar MEA.

5. The system of claim 1, wherein the MEA is an anion-exchange membrane (AEM)-only MEA.

6. The system of claim 1, wherein the MEA is a cation-exchange membrane-only MEA.

7. The system of claim 1, wherein the MEA comprises a liquid buffer layer disposed between the cathode catalyst and the one or more ion conductive polymer layers.

8. The system of claim 7, wherein the liquid buffer is an aqueous alkaline solution.

9. The system of claim 8, wherein the aqueous alkaline solution is solution of one of KOH, NaOH, $NaHCO_3$, and $KHCO_3$.

10. The system of claim 1, wherein the $CO_x$ reduction reactor comprises a stack of electrochemical cells each comprising an MEA.

11. The system of claim 1, wherein the ethylene purification system comprises one or more components or subsystems for (a) absorbing and separating carbon dioxide, (b) separating ethylene from one or more other components by membrane filtration, (c) fractional distillation to separate ethylene and methane, or (d) chemically converting methane to ethylene, or (e) any combination of (a)-(d).

12. The system of claim 1, wherein the cathode catalyst for facilitating chemical reduction of $CO_x$ to ethylene comprises copper.

13. The system of claim 1, wherein the mixture containing ethylene comprises CO, $CO_2$, and $H_2$.

14. The system of claim 1, further comprising one or more additional $CO_x$ reduction reactors stacked in parallel with the $CO_x$ reduction reactor.

15. The system of claim 14, wherein the recycle loop is configured to recycle, without separation, a portion of gas phase product stream from the one or more additional $CO_x$ reduction reactors.

16. The system of claim 1, wherein the $CO_x$ is CO.

17. The system of claim 1, wherein the $CO_x$ is a mixture of CO and $CO_2$.

18. The system of claim 1, further comprising an air capture subsystem upstream of the $CO_x$ reduction reactor.

19. The system of claim 1, wherein the cathode catalyst is in one of the one or more ion conductive polymer layers.

20. The system of claim 19, wherein the cathode catalyst is in an anion conductive polymer layer.

* * * * *